US010847904B2

(12) United States Patent
Sato et al.

(10) Patent No.: US 10,847,904 B2
(45) Date of Patent: Nov. 24, 2020

(54) ELECTRIC WIRE WITH TERMINAL AND METHOD OF MANUFACTURING ELECTRIC WIRE WITH TERMINAL

(71) Applicant: Yazaki Corporation, Tokyo (JP)

(72) Inventors: Tomoya Sato, Shizuoka (JP); Naoki Ito, Shizuoka (JP); Yasunori Nabeta, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/400,079

(22) Filed: May 1, 2019

(65) Prior Publication Data

US 2019/0372244 A1 Dec. 5, 2019

(30) Foreign Application Priority Data

Jun. 4, 2018 (JP) ..... 2018-106717

(51) Int. Cl.
*H01R 4/10* (2006.01)
*H01R 4/18* (2006.01)
*H01R 43/048* (2006.01)

(52) U.S. Cl.
CPC ..... *H01R 4/185* (2013.01); *H01R 43/048* (2013.01)

(58) Field of Classification Search
CPC ..... H01R 4/185; H01R 4/20; H01R 4/2495; H01R 43/048; H01R 43/28; H01R 4/184
USPC ..... 439/878, 877, 442
See application file for complete search history.

(56) References Cited

U.S. PATENT DOCUMENTS

| | | | | |
|---|---|---|---|---|
| 3,566,008 | A | 2/1971 | Ettlinger et al. | |
| 7,828,611 | B2 | 11/2010 | Nakamura et al. | |
| 8,342,894 | B2 * | 1/2013 | Uchiyama | H01R 43/048 439/882 |
| 8,622,774 | B2 * | 1/2014 | Seifert | H01R 4/185 439/882 |
| 9,437,938 | B2 * | 9/2016 | Ohnuma | H01R 4/185 |
| 9,502,784 | B2 * | 11/2016 | Ohnuma | H01R 4/62 |
| 10,587,071 | B2 * | 3/2020 | Masui | H01R 9/03 |
| 2007/0238353 | A1 * | 10/2007 | Yamaoka | H01R 13/4364 439/595 |
| 2008/0168653 | A1 * | 7/2008 | Chikyu | H01R 43/0486 29/863 |
| 2009/0036004 | A1 * | 2/2009 | Bowen | H01R 13/115 439/849 |
| 2010/0035482 | A1 | 2/2010 | Nakamura et al. | |

(Continued)

FOREIGN PATENT DOCUMENTS

| | | |
|---|---|---|
| CN | 101645543 A | 2/2010 |
| DE | 20 2015 008 963 U1 | 6/2016 |

(Continued)

*Primary Examiner* — Abdullah A Riyami
*Assistant Examiner* — Nelson R. Burgos-Guntin
(74) *Attorney, Agent, or Firm* — Sughrue Mion, PLLC

(57) ABSTRACT

An electric wire with terminal includes: an electric wire including a core wire having a plurality of element wires, and a covering that covers the core wire in a state in which an end portion of the core wire is exposed; and a crimp terminal including a core wire crimping portion crimped to the core wire in a state in which a distal end of the core wire protrudes to the outside. A distal end of the core wire has a bonding portion at which element wires are bonded together, and the bonding portion is formed by shearing and deforming distal ends of the element wires.

11 Claims, 51 Drawing Sheets

(56) References Cited

U.S. PATENT DOCUMENTS

2010/0192366 A1* 8/2010 Ito ..... H01R 43/058 29/753
2010/0248559 A1* 9/2010 Fukase ..... H01R 4/185 439/878
2012/0034826 A1* 2/2012 Ishikawa ..... H01R 13/055 439/733.1
2013/0040509 A1* 2/2013 Mitose ..... H01R 4/185 439/877
2013/0213710 A1* 8/2013 Ohnuma ..... H01R 4/185 174/84 C
2013/0240265 A1* 9/2013 Itou ..... H01R 4/70 174/84 C
2013/0252488 A1* 9/2013 Ito ..... H01R 4/188 439/877
2013/0273787 A1* 10/2013 Mitose ..... H01R 4/185 439/878
2014/0224535 A1* 8/2014 Otsuka ..... H01R 4/185 174/74 R
2014/0235118 A1* 8/2014 Bleicher ..... H01R 4/18 439/878
2014/0335745 A1* 11/2014 Kawamura ..... H01R 4/10 439/878
2014/0349501 A1* 11/2014 Aizawa ..... H01R 4/72 439/190
2015/0079825 A1* 3/2015 Miyamoto ..... H01R 4/206 439/152
2015/0155673 A1* 6/2015 Kawamura ..... H01R 43/02 29/860
2015/0340772 A1* 11/2015 Kawamura ..... H01R 4/18 439/877
2015/0364835 A1* 12/2015 Tonoike ..... H01R 43/0488 439/879
2015/0364837 A1* 12/2015 Yagi ..... B23K 26/24 439/879
2016/0261054 A1* 9/2016 Sato ..... H01R 4/70
2016/0285187 A1* 9/2016 Oba ..... H01R 4/023
2016/0359245 A1* 12/2016 Aoki ..... H01R 4/185
2016/0372841 A1* 12/2016 Sato ..... H01R 13/52
2017/0005417 A1* 1/2017 Aoki ..... H01R 4/62
2017/0047677 A1* 2/2017 Bhagyanathan Sathianathan ..... H01R 13/432
2017/0179614 A1* 6/2017 Kitagawa ..... H01R 4/185
2017/0179615 A1* 6/2017 Shinohara ..... H01R 4/185
2017/0179616 A1* 6/2017 Anma ..... H01R 43/058
2017/0179617 A1* 6/2017 Yoshida ..... H01R 4/185
2017/0179618 A1* 6/2017 Yoshida ..... H01R 4/185
2017/0179619 A1* 6/2017 Nakata ..... H01R 4/185
2018/0034185 A1* 2/2018 Nagasaka ..... H01R 13/428
2018/0358713 A1* 12/2018 Okuda ..... H01R 4/184
2018/0375276 A1* 12/2018 Onuma ..... H01R 43/005

FOREIGN PATENT DOCUMENTS

EP 3 270 464 A1 1/2018
JP 2010-225529 A 10/2010
JP 2011-192465 A 9/2011
JP 2013-134850 A 7/2013
JP 2014-17103 A 1/2014
JP 2014-164946 A 9/2014

* cited by examiner

ELECTRIC WIRE WITH TERMINAL AND METHOD OF MANUFACTURING ELECTRIC WIRE WITH TERMINAL

CROSS-REFERENCE TO RELATED APPLICATION(S)

The present application claims priority to and incorporates by reference the entire contents of Japanese Patent Application No. 2018-106717 filed in Japan on Jun. 4, 2018.

BACKGROUND OF THE INVENTION

1. Field of the Invention

The present invention relates to an electric wire with terminal and a method of manufacturing an electric wire with terminal.

2. Description of the Related Art

Conventionally, electric wires with terminals are known. Japanese Patent Application Laid-open No. 2010-225529 discloses a technology of an electric wire with a terminal clamp, in which a terminal clamp is attached to a terminal portion of an electric wire having a core wire formed by stranding a plurality of metal element wires, and a cutting end surface of the core wire is soldered. In Japanese Patent Application Laid-open No. 2010-225529, the terminal portion of the core wire is soldered by a flow method in which the terminal portion is dipped in a solder tank storing molten solder therein.

It is desired for an electric wire with terminal that electric performance be improved with a simple configuration. For example, the configuration can be simplified if an electric resistance can be reduced without adding an additional material such as solder or an additional member.

SUMMARY OF THE INVENTION

It is an object of the present invention to provide an electric wire with terminal and a method of manufacturing an electric wire with terminal, which are capable of improving electric performance with a simple configuration.

An electric wire with terminal according to one aspect of the present invention includes an electric wire including a core wire having a plurality of element wires, and a covering that covers the core wire in a state in which an end portion of the core wire is exposed; and a crimp terminal including a core wire crimping portion crimped to the core wire in a state in which a distal end of the core wire protrudes to an outside, wherein the distal end of the core wire has a bonding portion at which the element wires are bonded together, and the bonding portion is formed by shearing and deforming distal ends of the element wires.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Referring to the accompanying drawings, an electric wire with terminal and a method of manufacturing an electric wire with terminal according to embodiments of the present invention are described in detail below. The present invention is not limited by the embodiments. Components in the following embodiments include the ones that can be easily conceived by a person skilled in the art and the ones that are substantially the same.

First Embodiment

Figure 1:
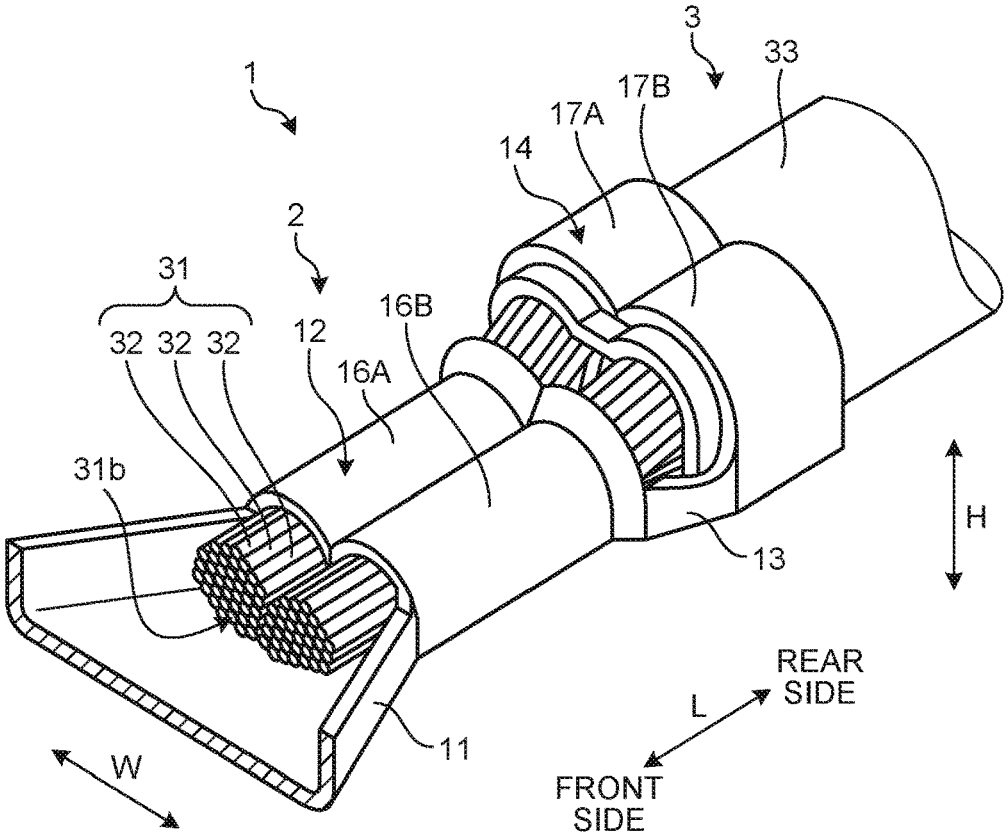
FIG. 1 is a perspective view of an electric wire with terminal according to a first embodiment.
Figure 2:
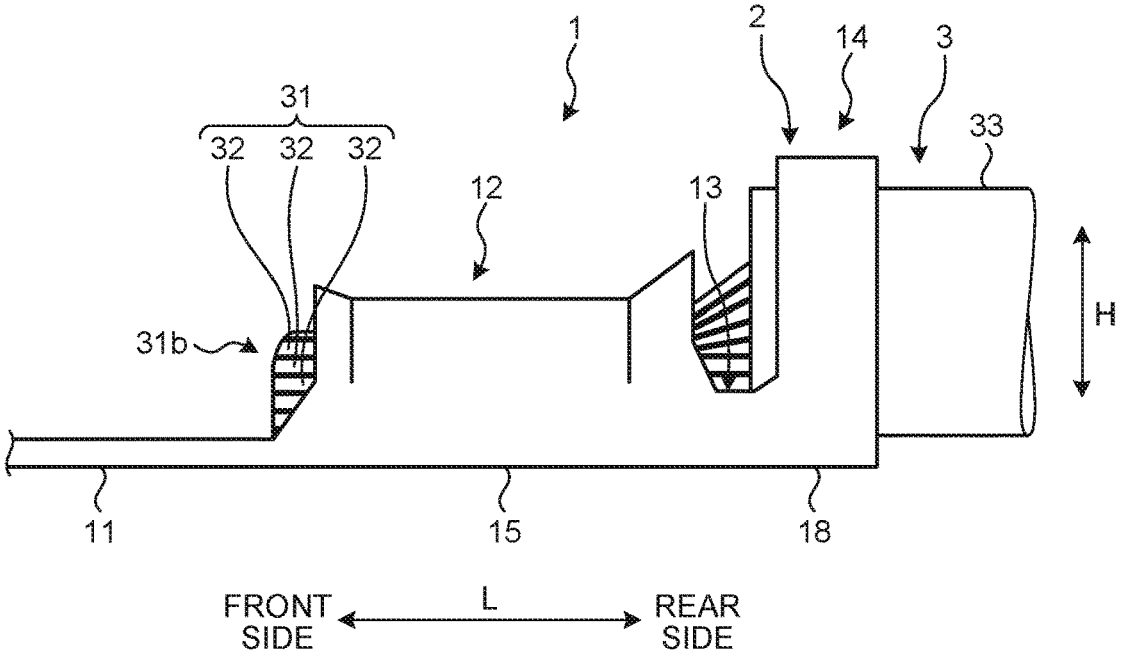
FIG. 2 is a side view of the electric wire with terminal according to the first embodiment.
Figure 3:
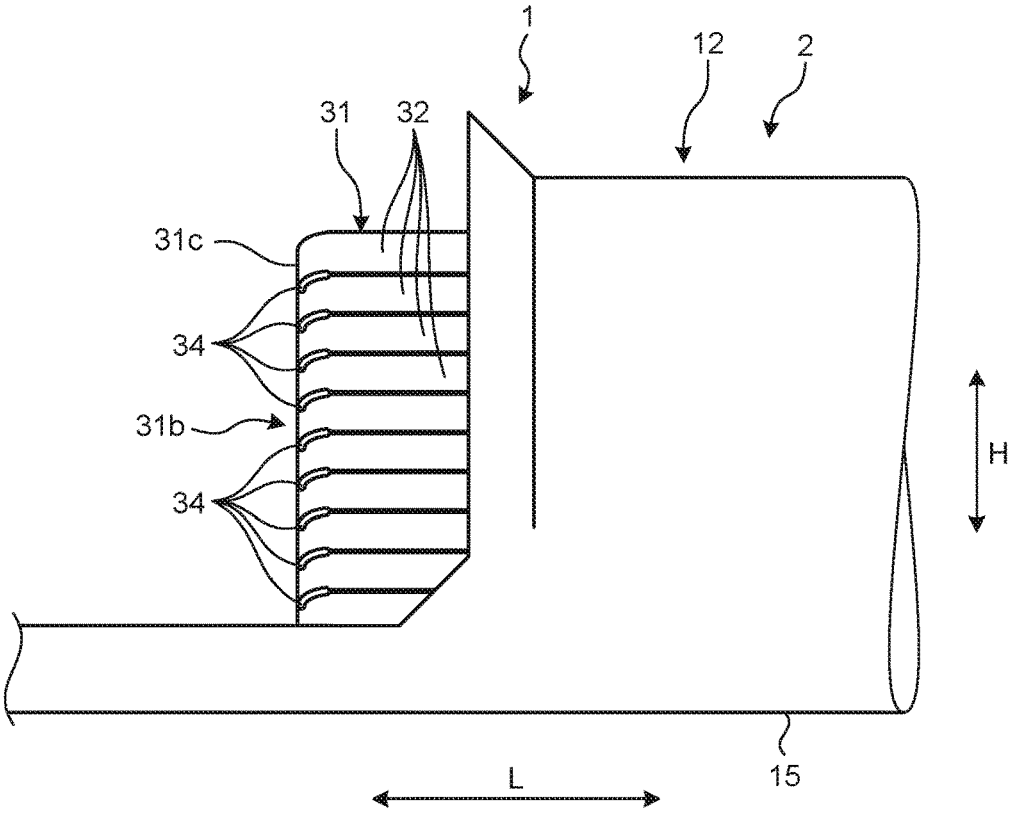
FIG. 3 is an enlarged view of a main part of the electric wire with terminal according to the first embodiment.
Figure 4:
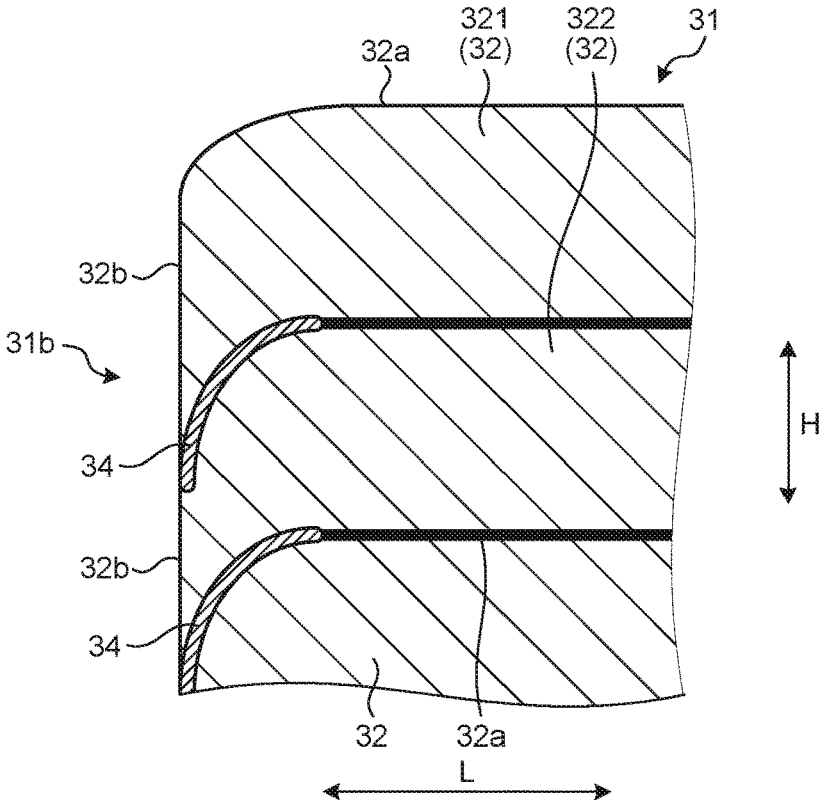
FIG. 4 is a cross-sectional view illustrating a bonding portion of the electric wire with terminal according to the first embodiment.
Figure 5:
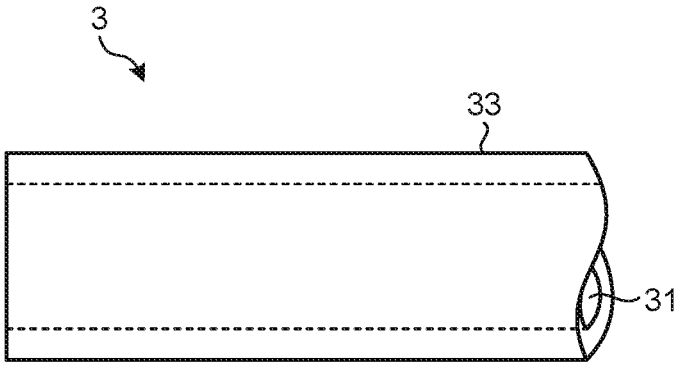
FIG. 5 is a plan view of the electric wire according to the first embodiment.
Figure 6:
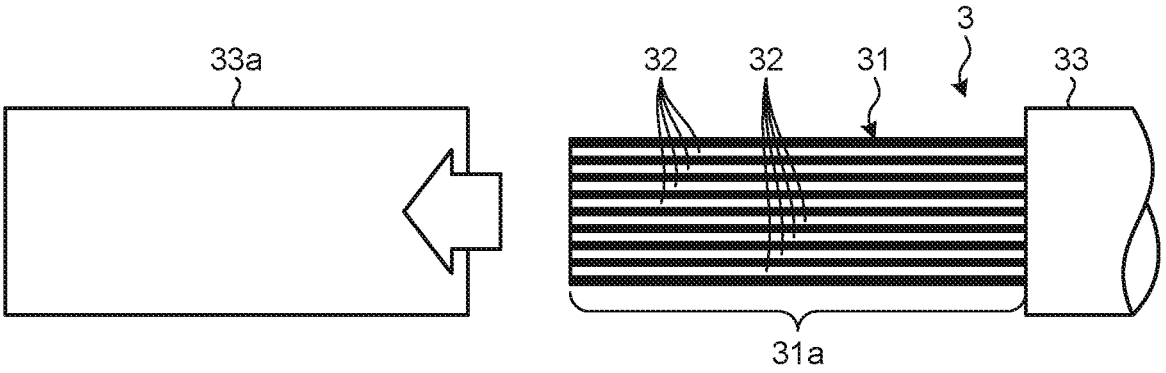
FIG. 6 is a diagram for describing a removal step in the first embodiment.
Figure 7:
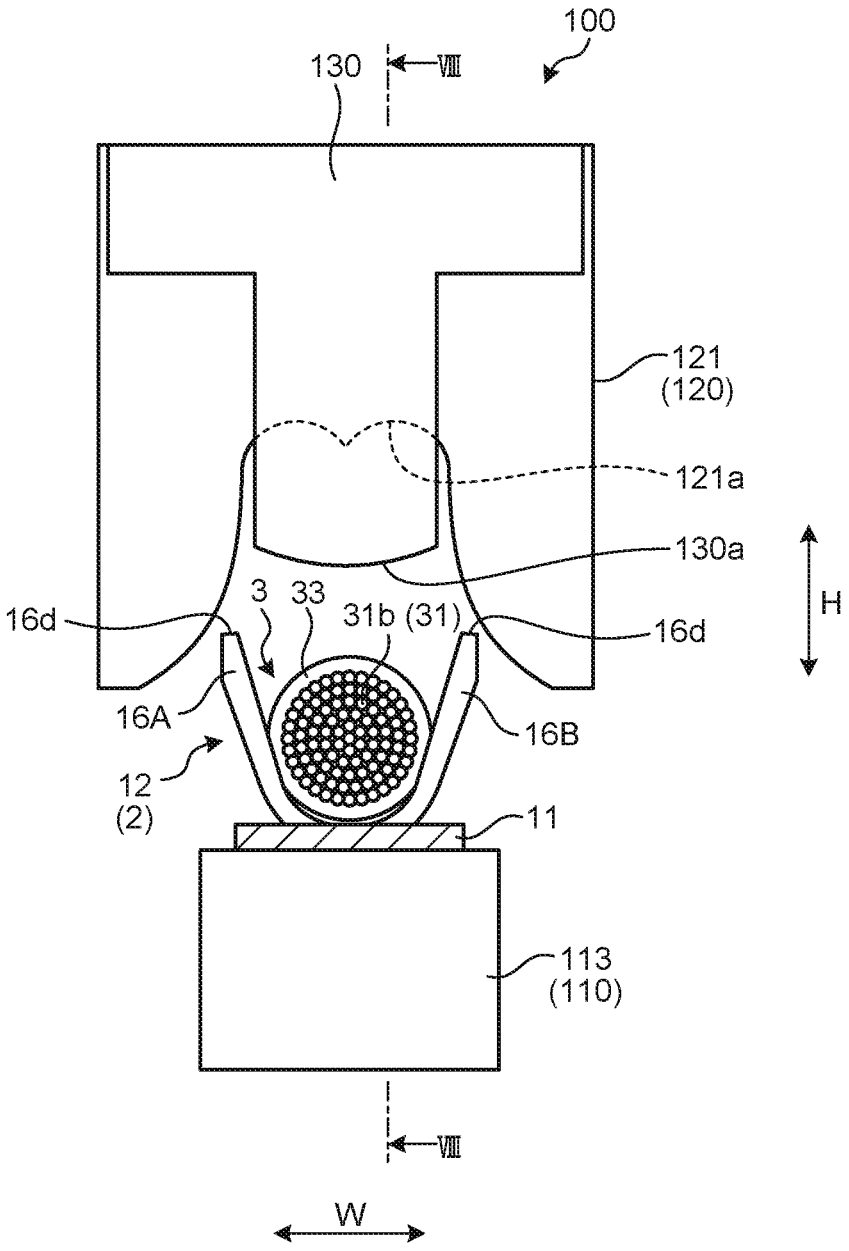
FIG. 7 is a front view of a terminal crimping apparatus according to the first embodiment.
Figure 8:
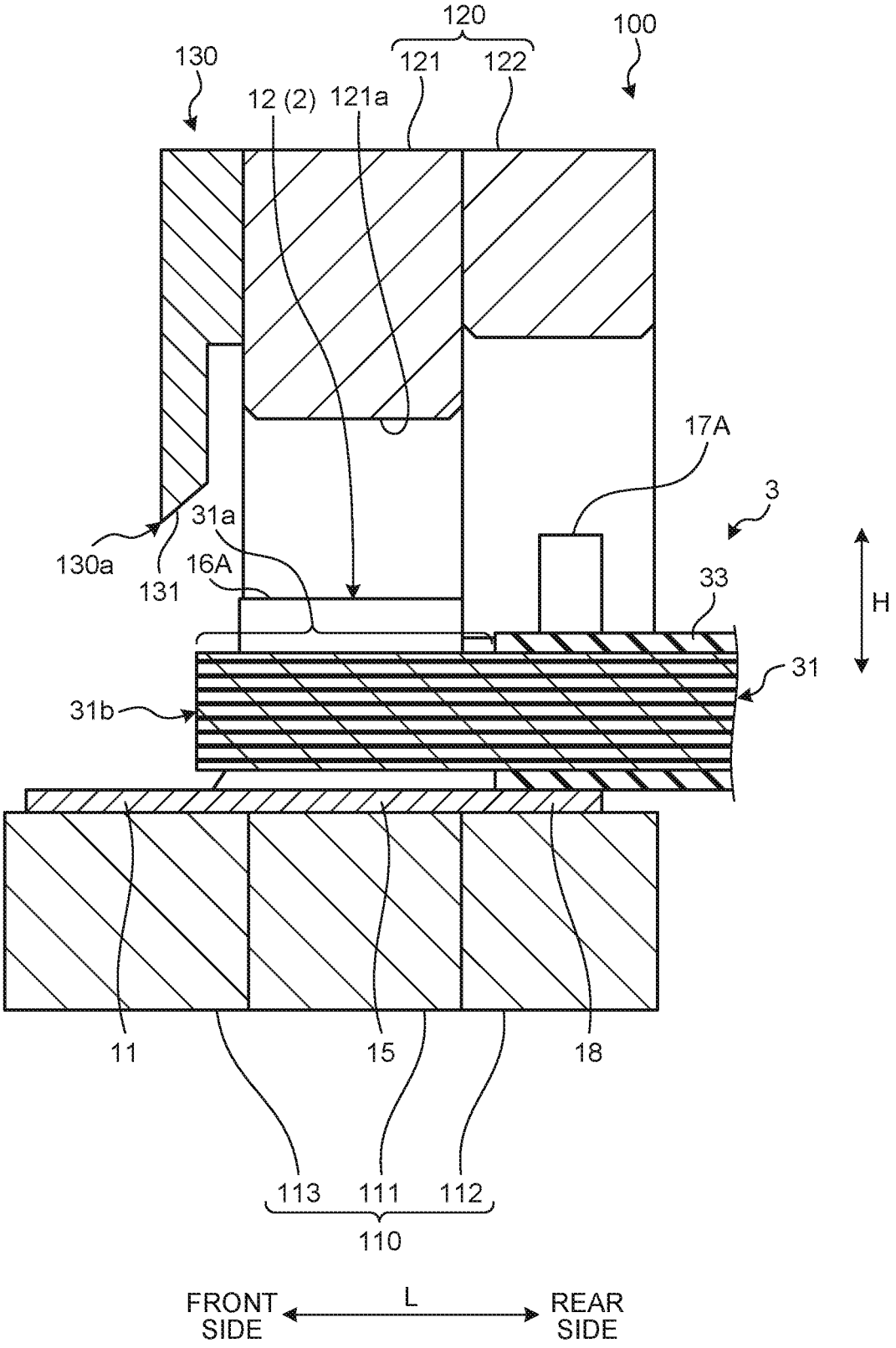
FIG. 8 is a cross-sectional view of the terminal crimping apparatus according to the first embodiment.
Figure 9:
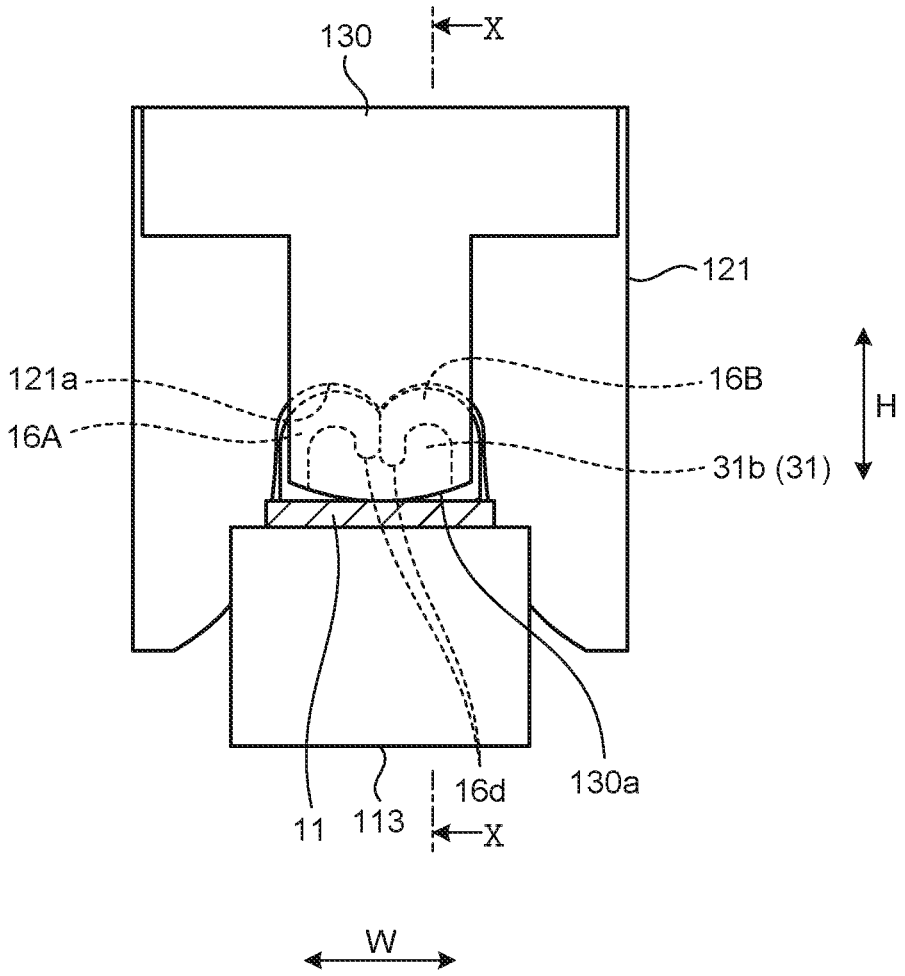
FIG. 9 is a front view illustrating a crimping step and a bonding step in the first embodiment.
Figure 10:
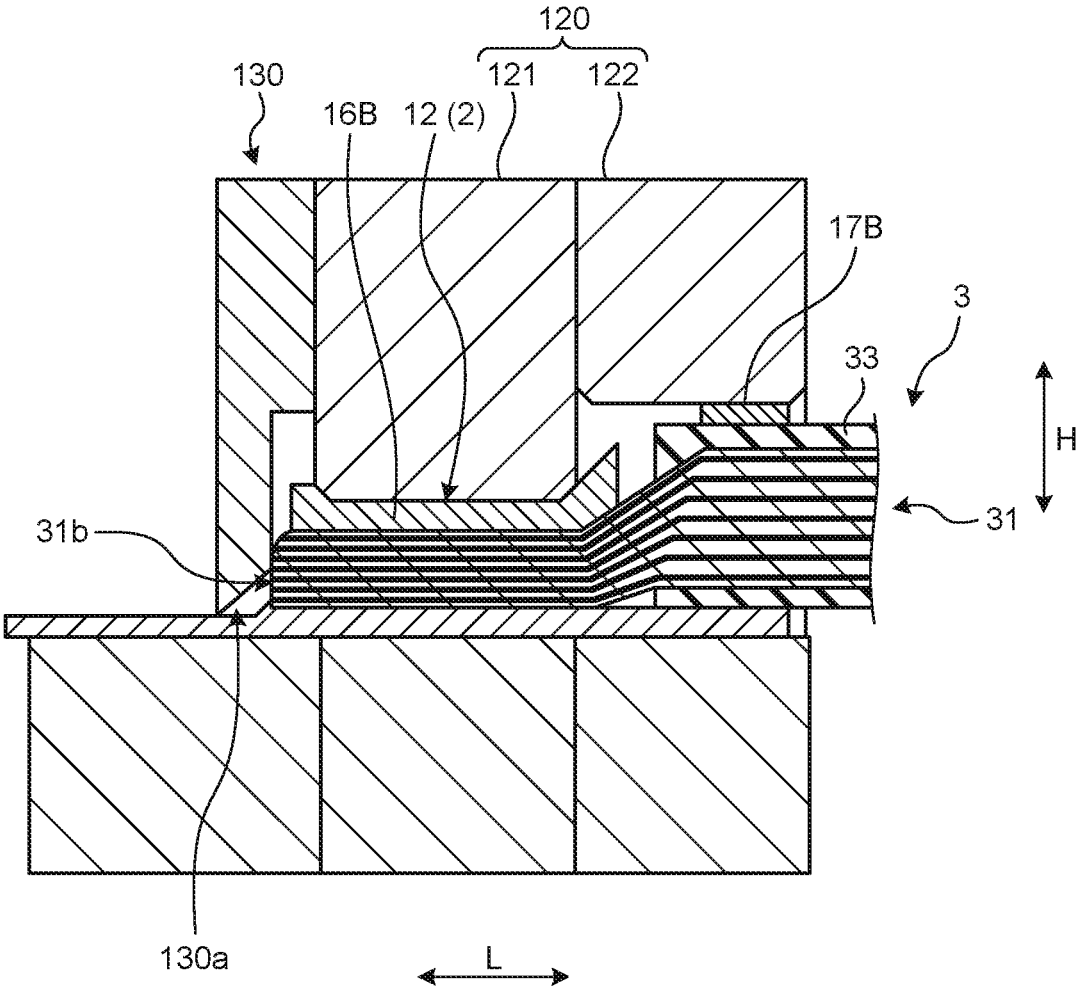
FIG. 10 is a cross-sectional view illustrating the crimping step and the bonding step in the first embodiment.
Figure 11:
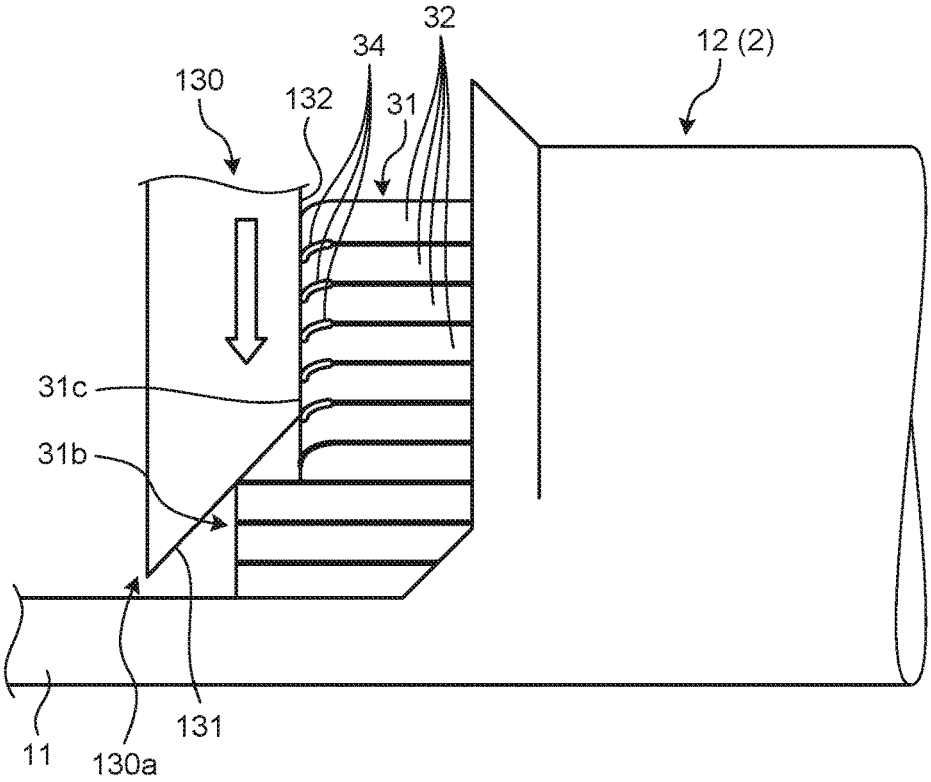
FIG. 11 is a side view illustrating the bonding step in the first embodiment.
Figure 12:
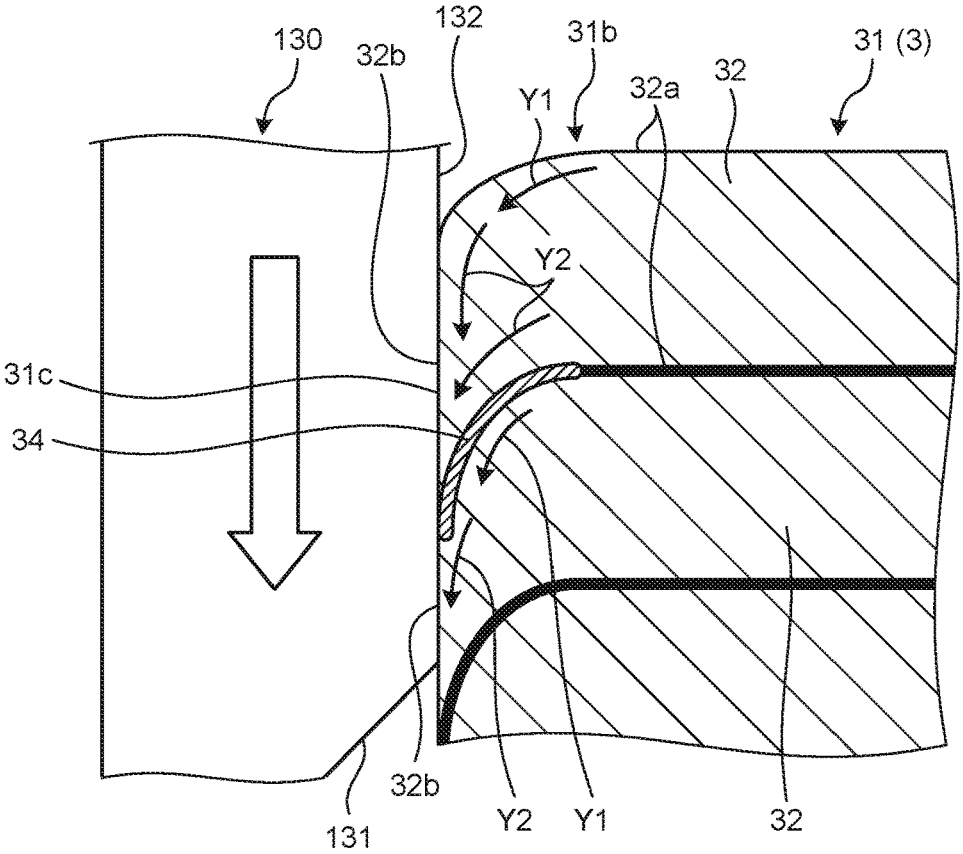
FIG. 12 is a cross-sectional view for describing the bonding step in the first embodiment.

Referring to FIG. 1 to FIG. 23, a first embodiment is described. The first embodiment relates to an electric wire with terminal and a method of manufacturing an electric wire with terminal. FIG. 1 is a perspective view of an electric wire with terminal according to the first embodiment. FIG. 2 is a side view of the electric wire with terminal according to the first embodiment. FIG. 3 is an enlarged view of a main part of the electric wire with terminal according to the first embodiment. FIG. 4 is a cross-sectional view illustrating a bonding portion of the electric wire with terminal according to the first embodiment. FIG. 5 is a plan view of an electric wire according to the first embodiment. FIG. 6 is a plan view of the electric wire according to the first embodiment. FIG. 7 is a front view of a terminal crimping apparatus according to the first embodiment. FIG. 8 is a cross-sectional view of the terminal crimping apparatus according to the first embodiment. FIG. 9 is a front view illustrating a crimping step and a bonding step in the first embodiment. FIG. 10 is a cross-sectional view illustrating the crimping step and the bonding step in the first embodiment. FIG. 11 is a side view illustrating the bonding step in the first embodiment. FIG. 12 is a cross-sectional view for describing the bonding step in the first embodiment. FIG. 8 illustrates a cross section taken along the line VIII-VIII in FIG. 7. FIG. 10 illustrates a cross section taken along the line X-X in FIG. 9.

As illustrated in FIG. 1 and FIG. 2, an electric wire with terminal 1 in the first embodiment includes a crimp terminal 2 and an electric wire 3. The crimp terminal 2 is a terminal to be crimped to the electric wire 3. The crimp terminal 2 is electrically connected to a counterpart terminal (not shown) while being integrated with the electric wire 3. In the electric wire 3 to be crimped, a covering 33 is removed at an end portion thereof, and a predetermined length of a core wire 31 is exposed. The core wire 31 in the first embodiment is a collection of a plurality of element wires 32. The element wires 32 are formed by conductive metal, such as copper and aluminum. The crimp terminal 2 is crimped to an end portion of the electric wire 3 and is thus electrically connected to the exposed core wire 31.

The crimp terminal 2 is formed from a conductive metal plate (for example, a copper plate or copper alloy plate) as base metal. The crimp terminal 2 is formed into a predetermined shape that can be connected to a counterpart terminal or the electric wire 3 by punching or bending of the base metal. The crimp terminal 2 has a coupling portion 11, a core wire crimping portion 12, a coupling portion 13, and a covering crimping portion 14.

In the following description, the longitudinal direction of the crimp terminal 2 is referred to as "first direction L". The first direction L is an insertion direction of the crimp terminal 2 and a counterpart terminal and is an axial direction of the electric wire 3. The width direction of the crimp terminal 2 is referred to as "second direction W". The second direction W is a direction orthogonal to the first direction L. A direction orthogonal to both the first direction L and the second direction W is referred to as "third direction H". The third direction H is a height direction of the crimp terminal 2. The third direction H is a direction in which the core wire crimping portion 12 is pressed by a first die 110 and a second die 120 at a crimping step described later. In the first direction L, the distal end side of the core wire 31 is referred to as "front side", and the side opposite to the front side is referred to as "rear side".

The coupling portion 11, the core wire crimping portion 12, the coupling portion 13, and the covering crimping portion 14 are arranged along the first direction L in this order. The coupling portion 11 is disposed in the front part of the crimp terminal 2. The core wire crimping portion 12 is crimped to the core wire 31 of the electric wire 3. The covering crimping portion 14 is crimped to the covering 33 of the electric wire 3. The core wire crimping portion 12 and the covering crimping portion 14 are continuous through the coupling portion 13. The coupling portion 11 extends from the core wire crimping portion 12 to the front side. The core wire crimping portion 12 has a bottom portion 15 and a pair of swaging pieces 16A and 16B. The pair of swaging pieces 16A and 16B are pieces extending from ends of the bottom portion 15. The covering crimping portion 14 has a pair of swaging pieces 17A and 17B.

The core wire crimping portion 12 in the first embodiment is crimped to the core wire 31 in a state in which a distal end 31*b* of the core wire 31 protrudes to the outside. A part of the core wire 31 including the distal end 31*b* protrudes from the core wire crimping portion 12 to the front side.

As illustrated in FIG. 3 and FIG. 4, the distal end 31*b* of the core wire 31 has a bonding portion 34. The bonding portion 34 is a part at which a plurality of element wires 32 are bonded together. Specifically, the bonding portion 34 is a part at which an element wire 321 and an element wire 322 adjacent thereto are metal-bonded as illustrated in FIG. 4. The bonding portion 34 in the first embodiment is formed by shearing and deforming a distal end of the element wire 32 as described later. In the electric wire with terminal 1 in the first embodiment, the element wires 32 are electrically connected to each other through the bonding portion 34. Thus, in the electric wire with terminal 1, an electric performance is improved due to reduction in electric resistance.

Now, a method of manufacturing an electric wire with terminal according to the first embodiment is described in detail. The method of manufacturing an electric wire with terminal according to the first embodiment includes a removal step, installation step, a bonding step, and a crimping step.

Removal Step

The removal step is a step for removing a part of the covering 33 from the electric wire 3 to expose the core wire 31. FIG. 5 illustrates the electric wire 3 before a part of the covering 33 is removed. In the electric wire 3 illustrated in FIG. 5, the entire core wire 31 excluding an end surface of the core wire 31 is covered by the covering 33. As illustrated in FIG. 6, at the removal step, a terminal portion 33*a* of the covering 33 is removed from the electric wire 3. When the terminal portion 33*a* is removed, an end portion 31*a* of the core wire 31 is exposed from the covering 33. For example, the cross-sectional shape of the core wire 31 and the cross-sectional shape of each element wire 32 are circular. The cross-sectional shape of the core wire 31 and the cross-sectional shape of the element wire 32 are not limited to be circular.

Installation Step

The installation step is a step for installing the electric wire 3 on the crimp terminal 2. At the installation step, the crimp terminal 2 and the electric wire 3 are installed on a first die 110 of the terminal crimping apparatus 100. As illustrated in FIG. 7 and FIG. 8, the terminal crimping apparatus 100 includes a first die 110, a second die 120, and a machining tool 130. The first die 110 is a fixed die, and supports the crimp terminal 2. The second die 120 is a movable die, and moves in the vertical direction relative to the first die 110.

As illustrated in FIG. 8, the first die 110 includes a first anvil 111, a second anvil 112, and a third anvil 113. The first anvil 111 supports the core wire crimping portion 12. The second anvil 112 supports the covering crimping portion 14. The third anvil 113 supports the coupling portion 11 and a terminal connecting portion (not shown). The terminal connecting portion is a part of the crimp terminal 2 to be connected to a counterpart terminal. The terminal connecting portion is continuous to the core wire crimping portion 12 through the coupling portion 11.

The second die 120 includes a first crimper 121 and a second crimper 122. The first crimper 121 is opposed to the first anvil 111. The first crimper 121 swages the core wire crimping portion 12 to crimp the core wire crimping portion 12 to the core wire 31. The second crimper 122 is opposed to the second anvil 112. The second crimper 122 swages the covering crimping portion 14 to crimp the covering crimping portion 14 to the covering 33.

The machining tool 130 is a member configured to form the bonding portion 34 at the distal end 31*b* of the core wire 31. The machining tool 130 in the first embodiment is a compression blade formed of metal. The machining tool 130 is fixed to the front surface side of the first crimper 121. In other words, the machining tool 130 is disposed on an end surface of the second die 120 on the side opposite to the second crimper 122. A blade edge 130*a* of the machining tool 130 is a single-edged blade. Specifically, a surface of the blade edge 130*a* on one side is an inclined surface 131 that is inclined to one side with respect to the vertical direction. The inclined surface 131 is inclined so as to be away from the first crimper 121 as approaching the distal end of the machining tool 130. The other surface of the blade edge 130*a* is parallel to the vertical direction. As illustrated in FIG. 7, the distal end of the blade edge 130*a* is slightly curved downward. The position of the blade edge 130*a* of the machining tool 130 is set such that the bonding step is performed in parallel to the crimping step.

At the installation step, the crimp terminal 2 is placed on the top surface of the first die 110. As illustrated in FIG. 7 and FIG. 8, the core wire crimping portion 12 of the crimp terminal 2 has a bottom portion 15, a first swaging piece 16A, and a second swaging piece 16B. The core wire crimping portion 12 is formed into a U shape. The bottom portion 15 is a site serving as a bottom wall of the core wire crimping portion 12 formed into a U shape. The first swaging piece 16A and the second swaging piece 16B are sites serving as side walls of the core wire crimping portion 12 formed into a U shape. The first swaging piece 16A extends from one end of the bottom portion 15 in the second direction W. The second swaging piece 16B extends from the other end of the bottom portion 15 in the second direction W.

The covering crimping portion 14 has a pair of swaging pieces 17A and 17B (see FIG. 1) similarly to the core wire crimping portion 12. The swaging pieces 17A and 17B of the covering crimping portion 14 are formed so as to be apart from the swaging pieces 16A and 16B of the core wire crimping portion 12.

As illustrated in FIG. 8, the crimp terminal 2 is placed on the first die 110 such that the core wire crimping portion 12 is opposed to the first anvil 111 and the covering crimping portion 14 is opposed to the second anvil 112. More specifically, the crimp terminal 2 is placed such that the bottom portion 15 is supported by the first anvil 111 and the distal ends of the pair of swaging pieces 16A and 16B are opposed to the first crimper 121.

The electric wire 3 is installed on the crimp terminal 2 supported by the first die 110. The electric wire 3 is installed on the crimp terminal 2 such that the end portion 31*a* of the core wire 31 is opposed to the bottom portion 15 of the core wire crimping portion 12 and the covering 33 is opposed to the bottom portion 18 of the covering crimping portion 14. The electric wire 3 is installed such that at least the distal end 31*b* protrudes from the core wire crimping portion 12 to the front side. The electric wire 3 is installed such that the distal end 31*b* is opposed to the inclined surface 131 of the machining tool 130 in the third direction H.

Crimping Step

In the method of manufacturing an electric wire with terminal according to the first embodiment, the crimping step and the bonding step described later are performed in parallel. First, the crimping step is described. The crimping step is a step for crimping the core wire crimping portion 12 to the core wire 31. At the crimping step, the core wire crimping portion 12 is crimped to the core wire 31, and the covering crimping portion 14 is crimped to the covering 33. At the crimping step, the crimp terminal 2 and the electric wire 3 are sandwiched between the first die 110 and the second die 120. The first die 110 and the second die 120 crimp the swaging pieces 16A and 16B to the core wire 31, and crimp the swaging pieces 17A and 17B to the covering 33. At the crimping step, the second die 120 moves downward toward the first die 110.

The first crimper 121 has curved surfaces 121*a* for deforming the swaging pieces 16A and 16B. The curved surfaces 121*a* deform the swaging pieces 16A and 16B into a curved shape such that distal ends 16d of the swaging pieces 16A and 16B face the first die 110. The first crimper 121 deforms the swaging pieces 16A and 16B such that the core wire 31 is wrapped by the pair of swaging pieces 16A and 16B and the bottom portion 15. FIG. 9 and FIG. 10 illustrate a state in which the second die 120 is located at the bottom dead center at the crimping step.

As illustrated in FIG. 9, the first crimper 121 in the first embodiment performs swaging called "B crimp". The swaging pieces 16A and 16B are curved such that the cross-sectional shape of the core wire crimping portion 12 has a B shape. The distal ends 16d of the swaging pieces 16A and 16B face downward and are pressed against the core wire 31. The swaging pieces 16A and 16B press the core wire 31 toward the bottom portion 15. The swaging pieces 16A and 16B wrap the core wire 31 and compress the core wire 31. The swaging pieces 17A and 17B of the covering crimping portion 14 are crimped to the covering 33 by being deformed similarly to the swaging pieces 16A and 16B.

Bonding Step

The bonding step is a step for forming the bonding portions 34 on the element wires 32 constituting the core wire 31 of the electric wire 3. At the bonding step in the first embodiment, the bonding portions 34 are formed on the core wire 31 by the machining tool 130. When the second die 120 is lowered at the crimping step, the machining tool 130 is lowered together with the second die 120. As illustrated in FIG. 11 and FIG. 12, the machining tool 130 shears and deforms the element wires 32 to form the bonding portions 34.

More specifically, the inclined surface 131 and a side surface 132 of the machining tool 130 contact with the distal end 31*b* of the core wire 31. The inclined surface 131 and the side surface 132 are lowered while slidingly moving on a distal end surface 31*c* of the distal end 31*b*. As illustrated in FIG. 12, the distal end of each element wire 32 is dragged downward by the machining tool 130 and sheared and deformed. Due to the shearing deformation, an outer peripheral surface 32*a* of the element wire 32 is extended as indicated by the arrow Y1, and an oxide film of the outer peripheral surface 32*a* is broken such that a new surface is exposed. The oxide film is also broken by the sliding of adjacent element wires 32, and a new surface is exposed. The oxide film is also broken by compression of the element wire 32, and a new surface is exposed. The new surfaces of adjacent element wires 32 come in contact with each other and adheres to form a bonding portion 34.

A distal end surface 32*b* of the element wire 32 is also extended as indicated by the arrows Y2. Thus, an oxide film on the distal end surface 32*b* of the element wire 32 is broken, and a new surface is exposed. At adjacent element wires 32, new surfaces of the distal end surfaces 32*b* or a new surface of the distal end surface 32*b* and a new surface of the outer peripheral surface 32*a* are metal-bonded to form a bonding portion 34. The machining tool 130 in the first embodiment may cut away the distal end of each element wire 32 to expose a new surface. Specifically, the machining tool 130 may cause shear failure of each element wire 32 such that a new distal end surface 32*b* is formed on the element wire 32 to generate a new surface. In this manner, in the electric wire with terminal 1 in the first embodiment, at the distal end surface 31*c* of the core wire 31, the distal ends of the element wires 32 are sheared and deformed in the common direction. The direction of the shearing deformation of the element wires 32 is the movement direction of the machining tool 130 and is a direction toward the bottom portion 15 along the third direction H.

The machining tool 130 in the first embodiment is configured such that bonding portions 34 can be formed on element wires 32 from the upper end to the lower end of the core wire 31. Specifically, the machining tool 130 is configured to contact with substantially all element wires 32 from an element wire 32 at the upper end to an element wire 32 at the lower end to shear and deform the wires. Thus, when the bonding step is completed, as illustrated in FIG. 3, bonding portions 34 are formed on substantially all element wires 32 from the element wire 32 at the upper end to the element wire 32 at the lower end. As a result, substantially all the element wires 32 are metal-bonded together. Thus, in the electric wire with terminal 1 in the first embodiment, the electric resistance between the element wires 32 is reduced. The core wire crimping portion 12 is also metal-bonded to the inner element wires 32 through element wires 32 located at the outer peripheral part of the core wire 31. Thus, the electric resistance between the core wire crimping portion 12 and the core wire 31 is also reduced.

Figure 13:
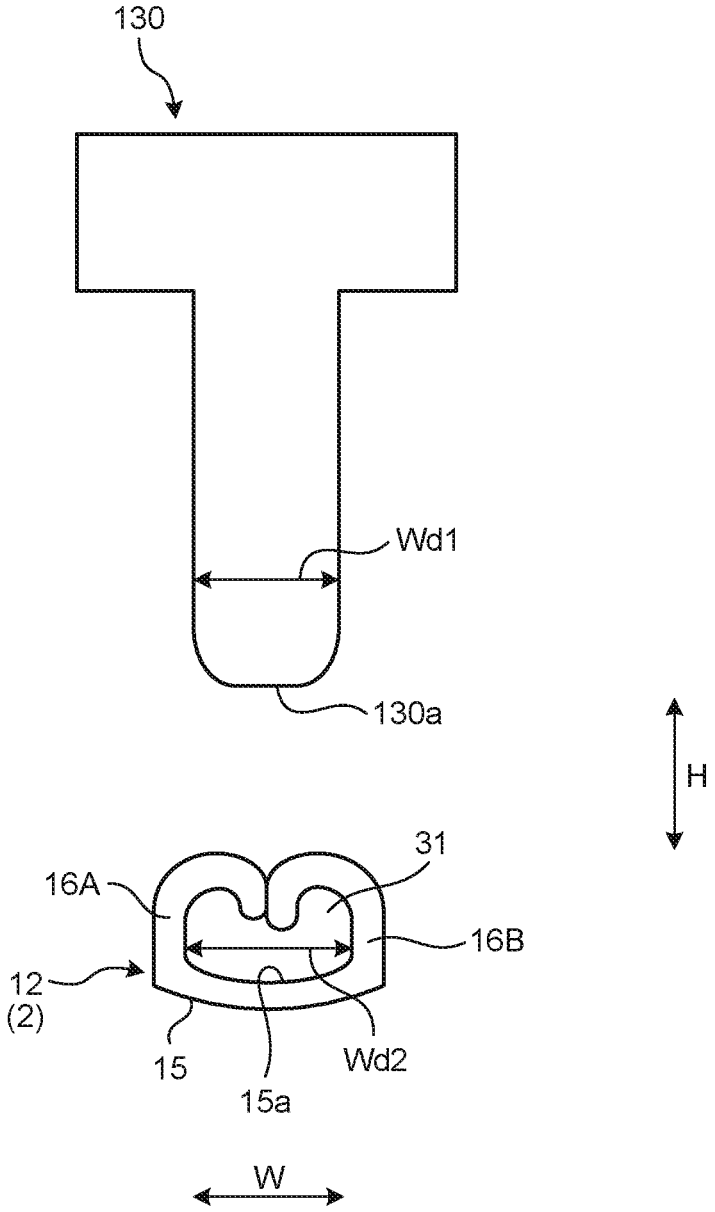
FIG. 13 is a front view illustrating an example of a shape of a machining tool.

The shape of the machining tool 130 is not limited to the shape exemplified above. For example, the shape of the machining tool 130 may conform to the cross-sectional shape of the core wire crimping portion 12. FIG. 13 illustrates an example of the shape of the machining tool 130. The shape of a blade edge 130*a* of the machining tool 130 corresponds to the cross-sectional shape of the bottom portion 15. More specifically, the cross-sectional shape of an inner surface 15*a* of the bottom portion 15 is a shape curved downward. The shape of the blade edge 130*a* of the machining tool 130 is a curved shape conforming to the curved shape of the inner surface 15*a*. The blade edge 130*a* has a curved shape in which a center portion thereof in the second direction W protrudes downward with respect to both end portions. In this manner, the interference between the machining tool 130 and the bottom portion 15 at the bonding step is suppressed.

A width Wd1 of the machining tool 130 is smaller than a width Wd2 of the bottom portion 15. For example, the width Wd2 of the bottom portion 15 is a distance from the inner surface of the first swaging piece 16A to the inner surface of the second swaging piece 16B. Because the width Wd1 of the machining tool 130 is smaller than the width Wd2 of the bottom portion 15, the interference between the machining tool 130 and the crimp terminal 2 at the bonding step is suppressed.

Figure 14:
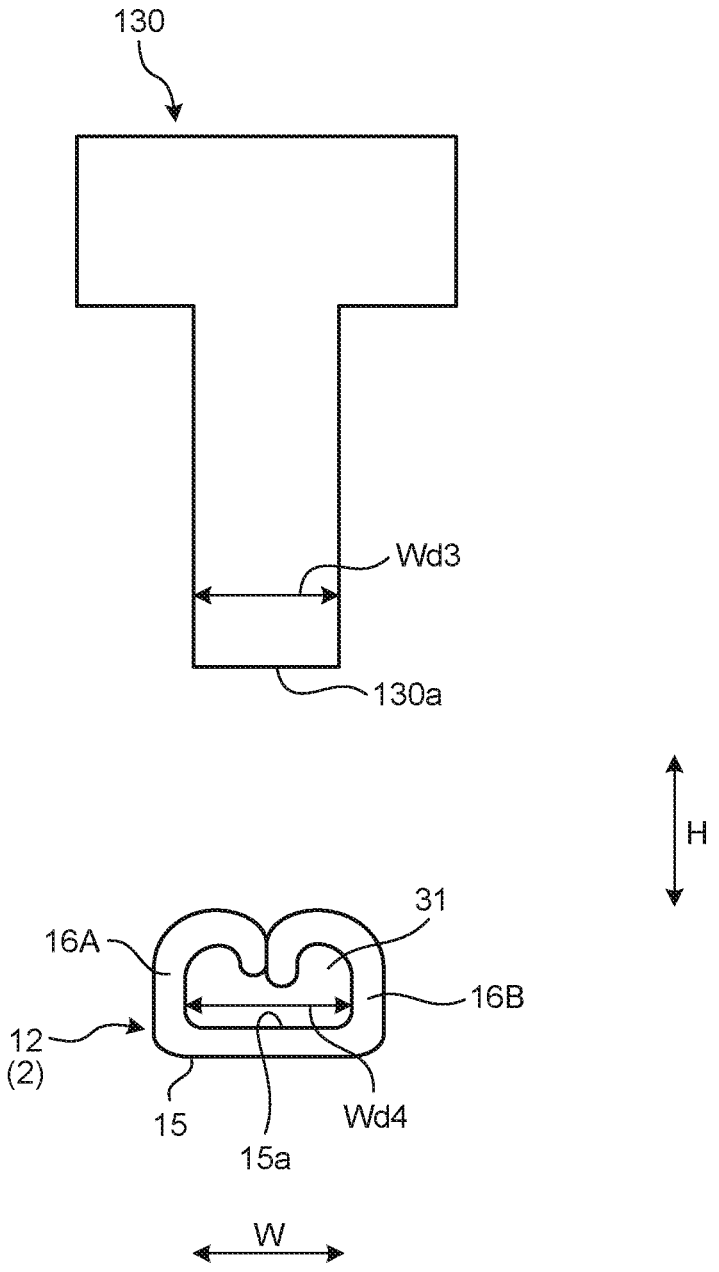
FIG. 14 is a front view illustrating another example of the shape of the machining tool.

FIG. 14 illustrates another example of the shape of the machining tool 130. In a core wire crimping portion 12 illustrated in FIG. 14, the cross-sectional shape of an inner surface 15*a* of the bottom portion 15 is linear. The shape of the blade edge 130*a* of the machining tool 130 is linear so as to correspond to the cross-sectional shape of the inner surface 15*a* of the bottom portion 15. A width Wd3 of the machining tool 130 is smaller than a width Wd4 of the bottom portion 15.

Figure 15:
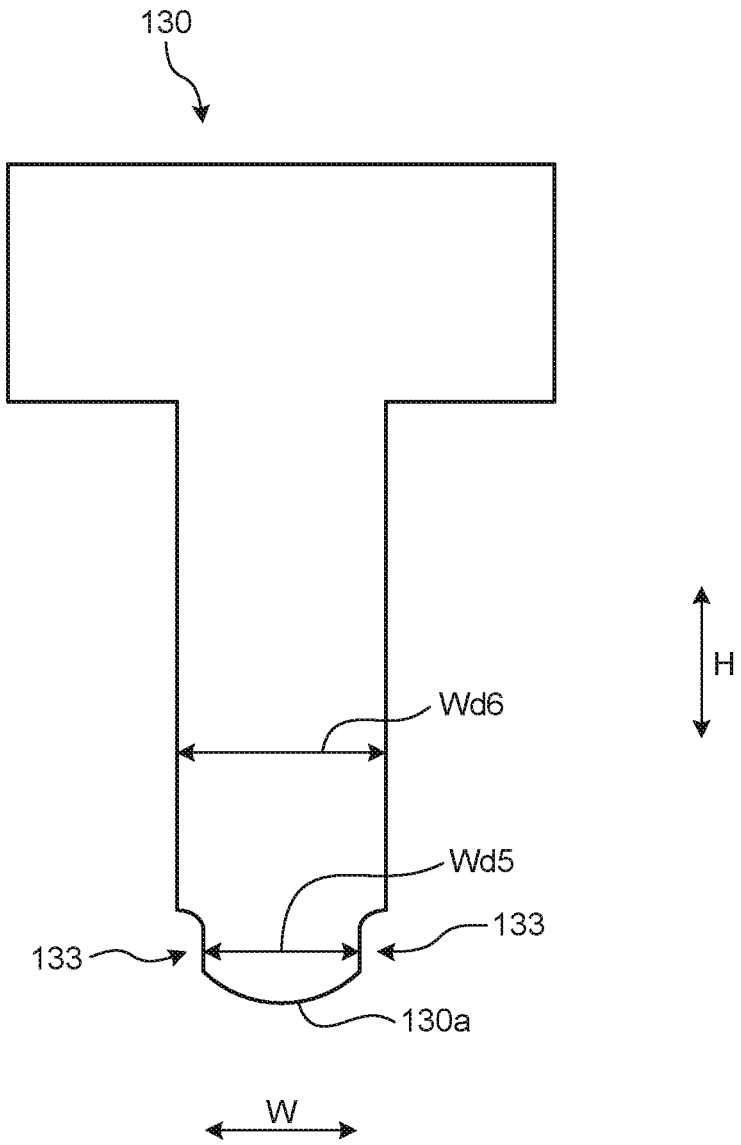
FIG. 15 is a front view illustrating still another example of the shape of the machining tool.
Figure 16:
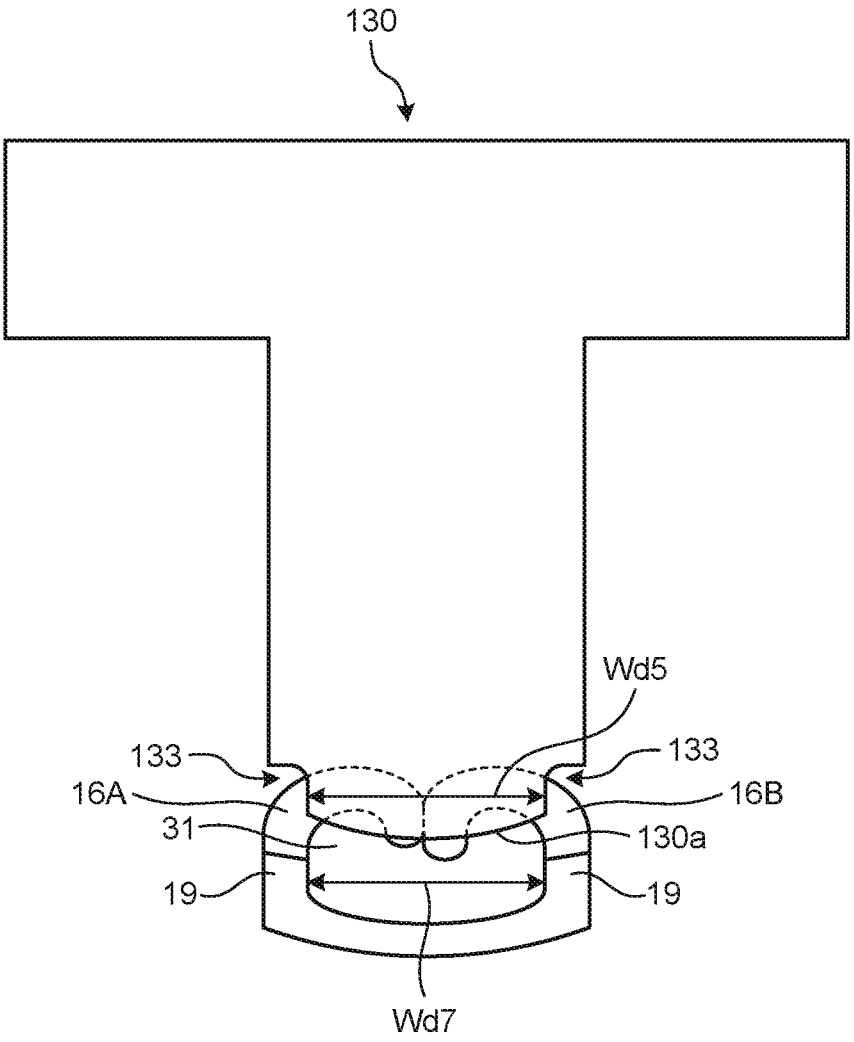
FIG. 16 is a front view for describing a relief portion of the machining tool.
Figure 17:
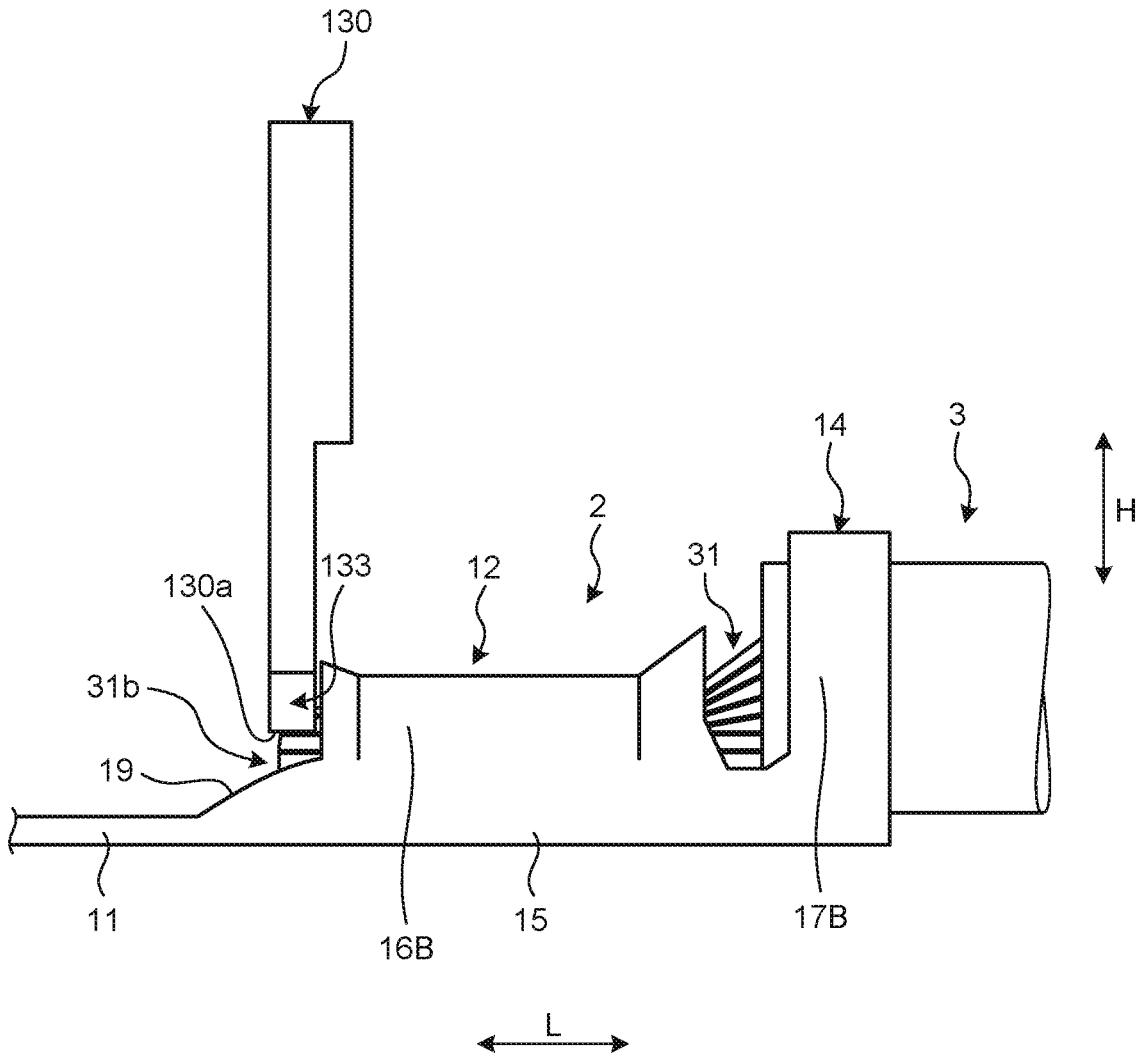
FIG. 17 is a side view for describing the relief portion of the machining tool.

FIG. 15 to FIG. 17 illustrate still another example of the shape of the machining tool 130. As illustrated in FIG. 15, relief portions 133 are formed in the machining tool 130. The relief portions 133 are notch portions formed in the machining tool 130. A width Wd5 of a part at which the relief portions 133 are formed is smaller than a width Wd6 of a part on the base end side. The relief portions 133 are formed at a distal end portion of the machining tool 130 and are provided on both sides in the width direction. In other words, in the machining tool 130, the width Wd5 of the distal end portion is smaller than the width Wd6 of a part on the base end side.

A crimp terminal 2 illustrated in FIG. 16 and FIG. 17 has a pair of side wall portions 19. The side wall portions 19 are continuous to the first swaging piece 16A and the second swaging piece 16B. For example, the side wall portions 19 are formed at the coupling portion 11. Relief portions 133 of the machining tool 130 are formed such that the interference between the side wall portions 19 and the machining tool 130 can be suppressed. As illustrated in FIG. 16, a width Wd5 of the distal end portion of the machining tool 130 is equal to a width Wd7 of a space portion sandwiched by the side wall portions 19 or smaller than the width Wd7 of the space portion. Thus, the interference between the machining tool 130 and the crimp terminal 2 at the bonding step is suppressed. A relief portion may be formed on the crimp terminal 2. For example, the height of a part of the side wall portion 19 that is opposed to the machining tool 130 may be lower than the height of a part of the side wall portion 19 adjacent thereto.

Figure 18:
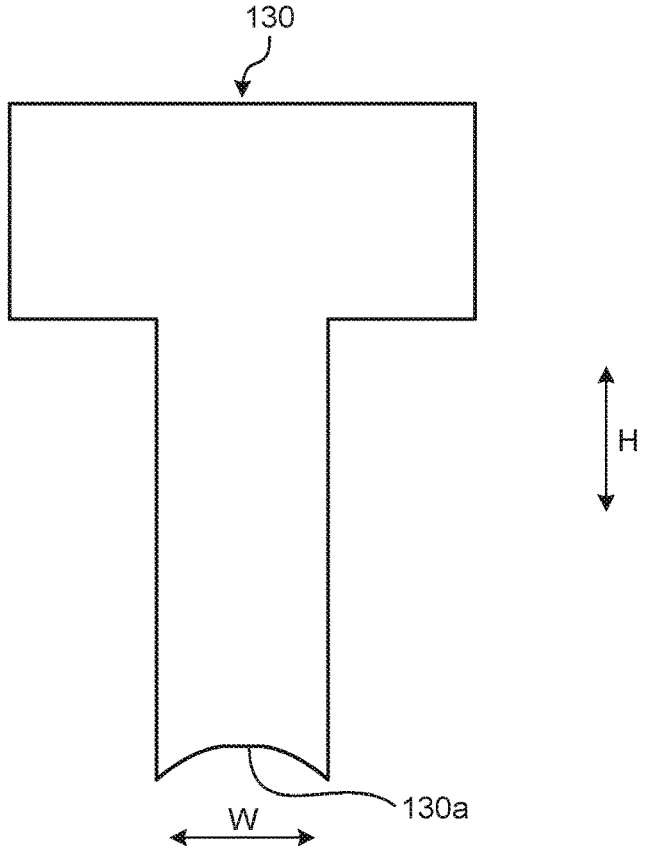
FIG. 18 is a front view illustrating still another example of the shape of the machining tool.
Figure 19:
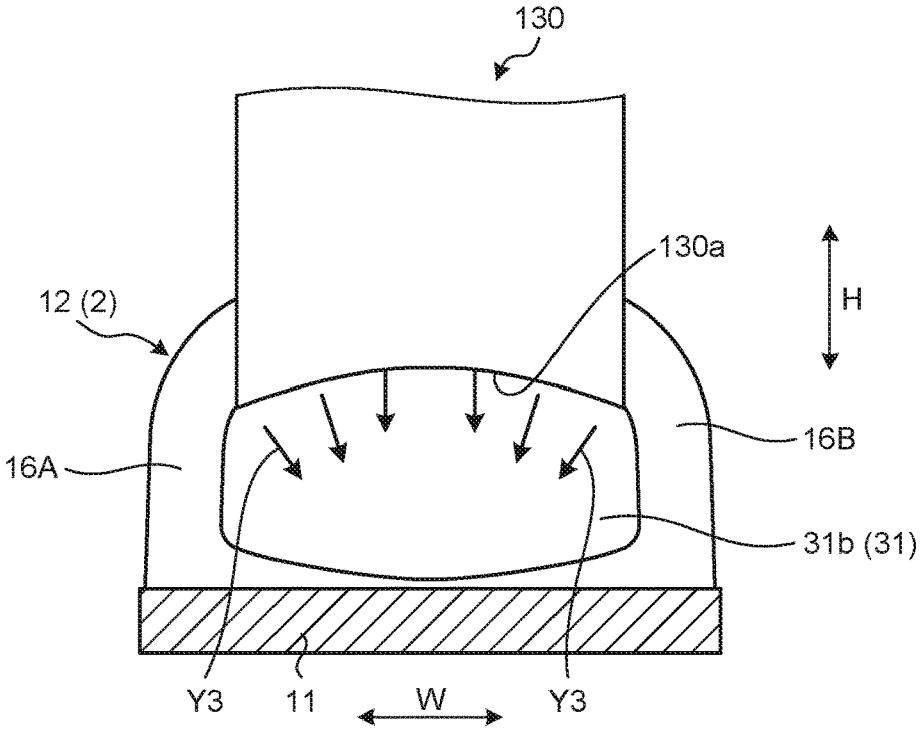
FIG. 19 is a front view illustrating the bonding step.

FIG. 18 illustrates still another example of the shape of the machining tool 130. In a machining tool 130 illustrated in FIG. 18, a blade edge 130*a* has a curved shape in which both end portions in the second direction W protrude downward with respect to a center portion in the second direction W. Thus, as illustrated in FIG. 19, at the bonding step, the blade edge 130*a* of the machining tool 130 compresses the distal end 31*b* of the core wire 31 toward the center in the width direction. As indicated by the arrows Y3 in FIG. 19, both end portions of the blade edge 130*a* press the core wire 31 toward the center in the second direction W. Thus, the distal end 31*b* of the core wire 31 is prevented from being scattered radially at the bonding step.

Figure 20:
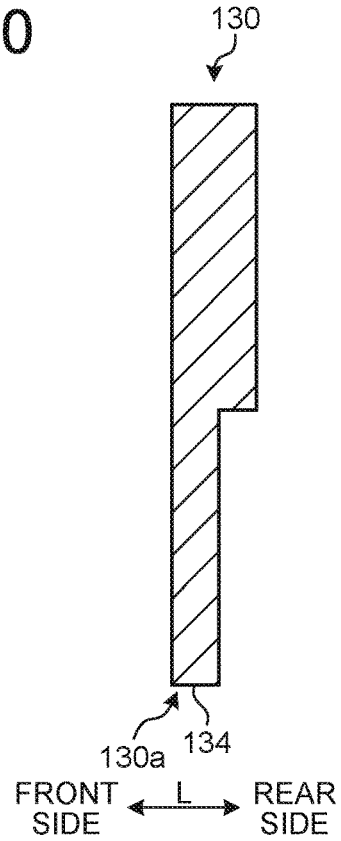
FIG. 20 is a cross-sectional view illustrating an example of the shape of the machining tool.

The cross-sectional shape of the machining tool 130 is not limited to the cross-sectional shapes exemplified above. FIG. 20 illustrates an example of the cross-sectional shape of the machining tool 130. In a machining tool 130 in FIG. 20, a blade edge 130*a* is provided with a pressing surface 134 having a given width. The pressing surface 134 is a surface parallel to the first direction L.

Figure 21:
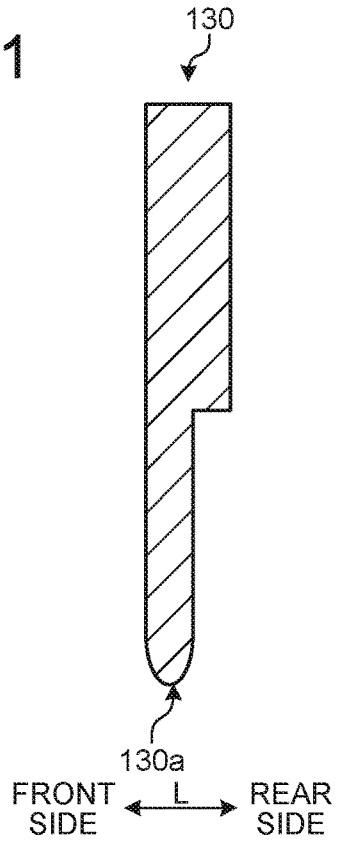
FIG. 21 is a cross-sectional view illustrating another example of the shape of the machining tool.

FIG. 21 illustrates another example of the cross-sectional shape of the machining tool 130. In a machining tool 130 in FIG. 21, the cross-sectional shape of the blade edge 130*a* is a curved surface in which a center portion thereof in the first direction L protrudes more than both end portions. For example, the shape of the center portion of the blade edge 130*a* is an arc shape.

Figure 22:
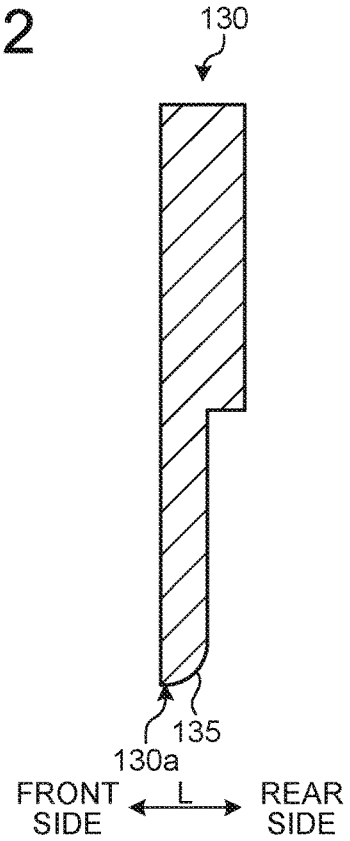
FIG. 22 is a cross-sectional view illustrating still another example of the shape of the machining tool.

FIG. 22 illustrates still another example of the cross-sectional shape of the machining tool 130. In a machining tool 130 in FIG. 22, a convex curved surface 135 is provided instead of the inclined surface 131 illustrated in FIG. 8. The convex curved surface 135 is formed at the blade edge 130*a* on the rear side in the first direction L. For example, the convex curved surface 135 is a curved surface having a substantially arc shape.

Figure 23:
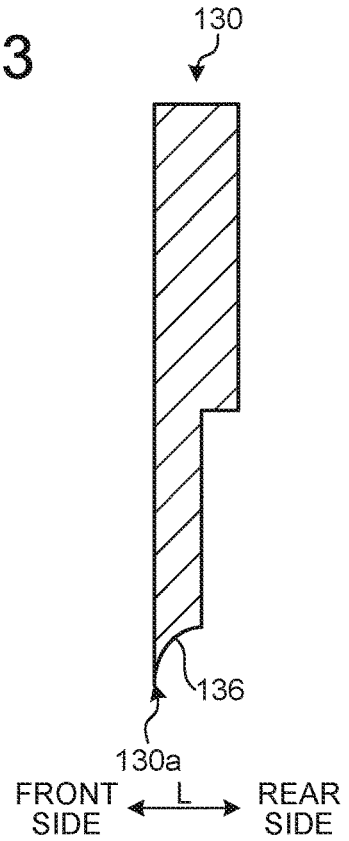
FIG. 23 is a cross-sectional view illustrating still another example of the shape of the machining tool.

FIG. 23 illustrates still another example of the cross-sectional shape of the machining tool 130. In a machining tool 130 in FIG. 23, a concave curved surface 136 is provided. The concave curved surface 136 is formed at the blade edge 130*a* on the rear side in the first direction L. For example, the concave curved surface 136 is a curved surface having a substantially arc shape.

As described above, the electric wire with terminal 1 according to the first embodiment includes the electric wire 3 and the crimp terminal 2. The electric wire 3 includes the core wire 31 having the plurality of element wires 32 and the covering 33 that covers the core wire 31 in the state in which the end portion of the core wire 31 is exposed. The crimp terminal 2 has the core wire crimping portion 12 crimped to the core wire 31 in the state in which the distal end 31*b* of the core wire 31 is exposed to the outside.

The distal end 31*b* of the core wire 31 has the bonding portion 34 at which the element wires 32 are bonded together. The bonding portion 34 is formed by shearing and deforming the distal ends of the element wires 32. The electric wire with terminal 1 in the first embodiment can reduce the electric resistance in the electric wire with terminal 1 without adding additional material or member such as soldering. In other words, the electric wire with terminal 1 in the first embodiment exhibits an effect that the electric performance can be improved with a simple configuration.

In the electric wire with terminal 1 in the first embodiment, the distal ends of the element wires 32 are sheared and deformed in the common direction at the distal end surface 31*c* of the core wire 31. Typically, such shearing deformation is deformation caused when the machining tool 130 slidingly moves on the distal end 31*b* of the core wire 31. Because the bonding portion 34 is formed by deformation processing on the core wire 31, the electric performance of the electric wire with terminal 1 can be improved with a simple configuration.

The method of manufacturing an electric wire with terminal in the first embodiment includes the bonding step and the crimping step. The bonding step is a step for shearing and deforming distal ends of element wires 32 constituting the core wire 31 of the electric wire 3 to form a bonding portion 34 at which the element wires 32 are bonded together. The crimping step is a step for crimping the core wire crimping portion 12 of the crimp terminal 2 to the core wire 31. Because the bonding portion 34 is formed by shearing and deforming the distal ends of the element wires 32, the electric performance of the electric wire with terminal 1 can be improved with a simple configuration.

In the method of manufacturing an electric wire with terminal in the first embodiment, the bonding step and the crimping step are performed in parallel. Thus, the method of manufacturing an electric wire with terminal in the first embodiment can shorten time required for manufacturing the electric wire with terminal 1.

In the method of manufacturing an electric wire with terminal in the first embodiment, the terminal crimping apparatus 100 having the first crimper 121 and the machining tool 130 configured to move in cooperation with the first crimper 121 performs the bonding step and the crimping step. At the bonding step, the terminal crimping apparatus 100 shears and deforms the distal end of the element wire 32 by the machining tool 130 to form the bonding portion 34. At the crimping step, the terminal crimping apparatus 100 crimps the core wire crimping portion 12 to the core wire 31 by the first crimper 121. The terminal crimping apparatus 100 executes the bonding step and the crimping step, and hence the manufacturing process can be simplified.

In the method of manufacturing an electric wire with terminal in the first embodiment, relief portions 133 for suppressing the interference between the machining tool 130 and the crimp terminal 2 at the bonding step are formed in the machining tool 130. Thus, an undesired deformation is prevented from easily occurring in the crimp terminal 2 at the bonding step. A relief portion may be provided to the crimp terminal 2.

In the method of manufacturing an electric wire with terminal in the first embodiment, at the bonding step, the machining tool 130 having the blade edge 130*a* is used to move the blade edge 130*a* slidingly with respect to the distal end surface 31*c* of the core wire 31 to shear and deform the distal end of the element wire 32. The shape of the blade edge 130*a* is a convex shape in which a center portion in the width direction of the crimp terminal 2 protrudes more than both end portions in the width direction. Thus, the interference between the machining tool 130 and the crimp terminal 2 at the bonding step is suppressed.

First Modification of First Embodiment

Figure 24:
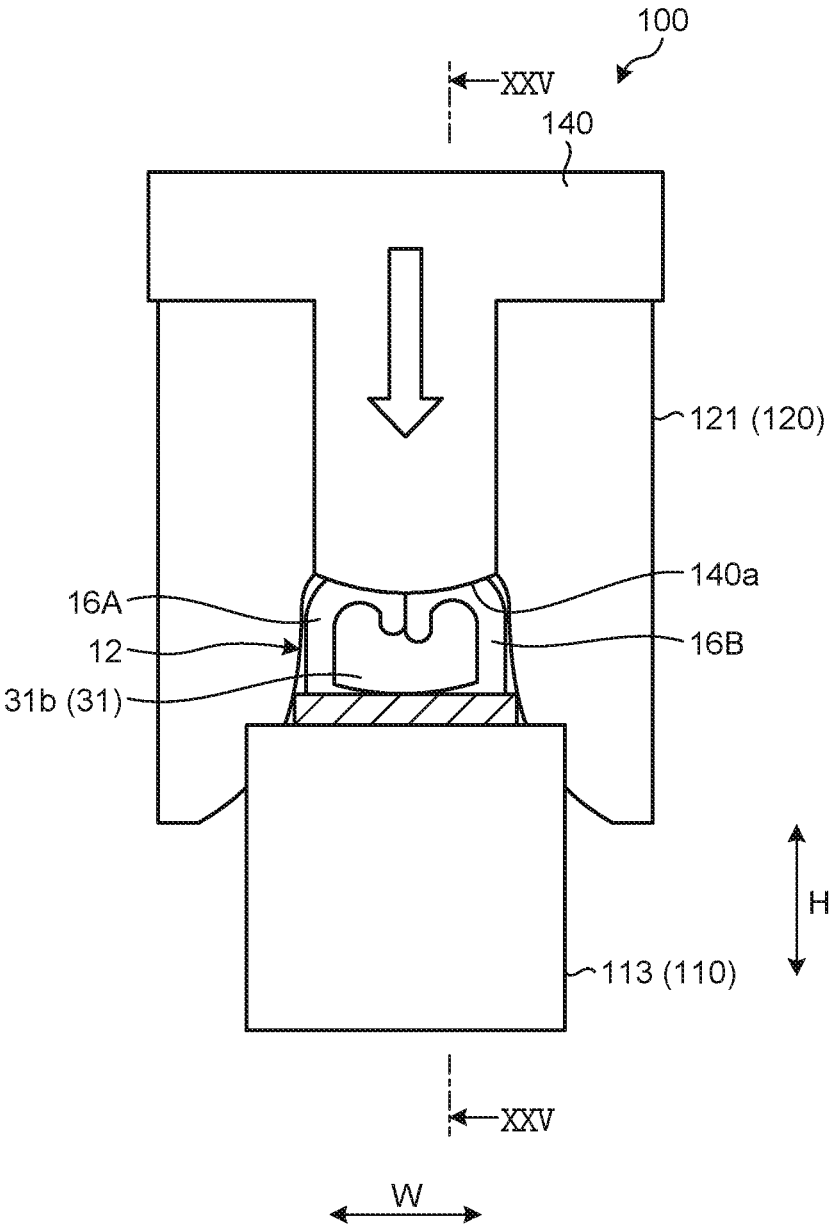
FIG. 24 is a front view for describing a bonding step according to a first modification of the first embodiment.
Figure 25:
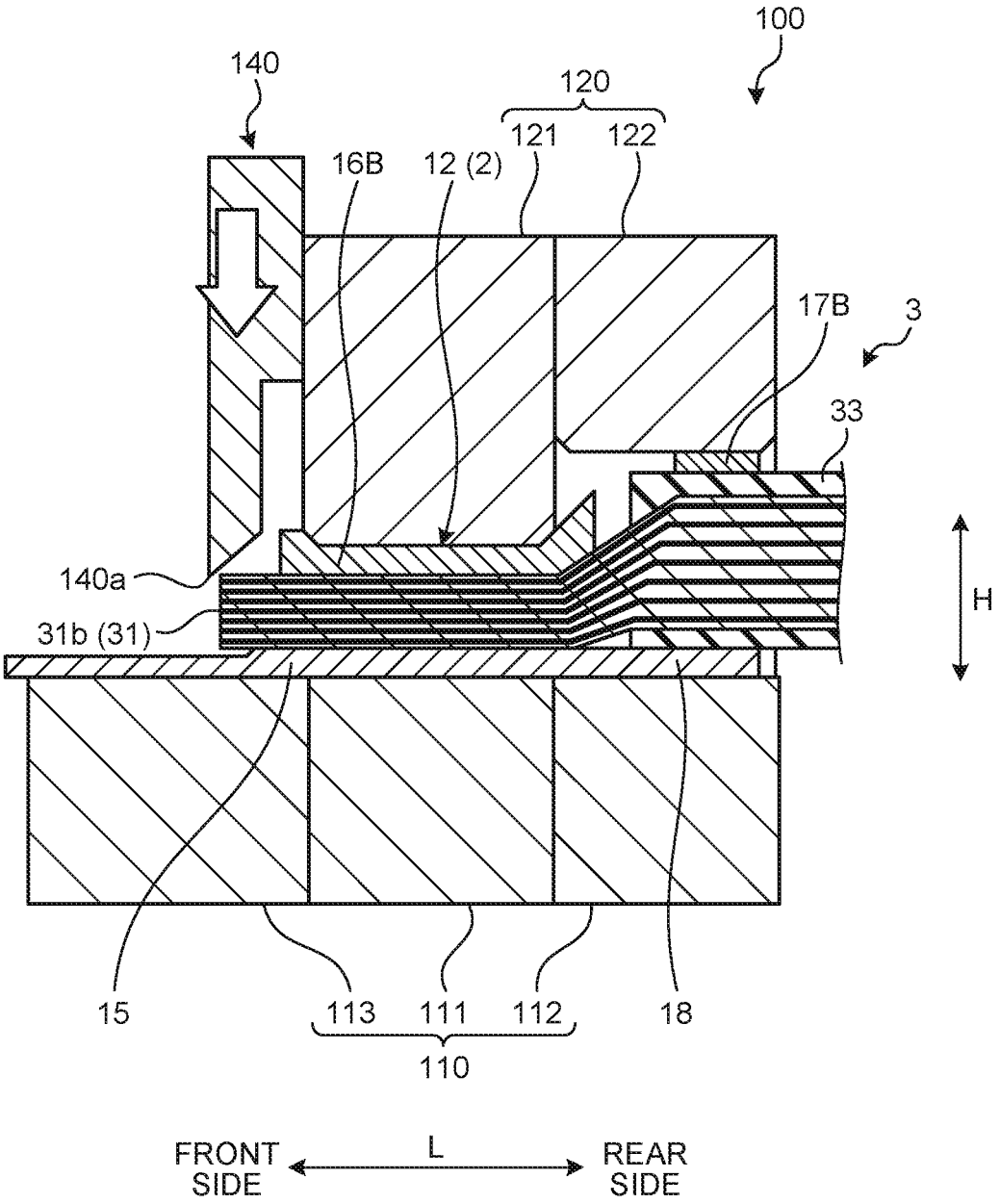
FIG. 25 is a cross-sectional view for describing the bonding step according to the first modification of the first embodiment.

Referring to FIG. 24 and FIG. 25, a first modification of the first embodiment is described. FIG. 24 is a front view for describing a bonding step according to the first modification of the first embodiment. FIG. 25 is a cross-sectional view for describing the bonding step according to the first modification of the first embodiment. FIG. 25 illustrates a cross section taken along the line XXV-XXV in FIG. 24. The first modification of the first embodiment is different from the above-mentioned first embodiment in that, for example, the terminal crimping apparatus 100 forms a bonding portion 34 while holding the second die 120 at the bottom dead center.

A machining tool 140 illustrated in FIG. 24 and FIG. 25 can move relative to the second die 120. The terminal crimping apparatus 100 operates the second die 120 and the machining tool 140 in cooperation with each other. A mechanism configured to operate the second die 120 and a mechanism configured to operate the machining tool 140 may be common or independent from each other. The terminal crimping apparatus 100 forms a bonding portion 34 by lowering the machining tool 140 in a state in which the second die 120 is stopped at the bottom dead center. FIG. 24 and FIG. 25 illustrate the state in which the second die 120 is stopped at the bottom dead center. The machining tool 140 lowers toward the distal end 31*b* of the core wire 31. From this state, the terminal crimping apparatus 100 further lowers the machining tool 140, and shears and deforms the distal end 31*b* by the machining tool 140 to form bonding portions 34. For example, the shape of a blade edge 140*a* of the machining tool 140 is the same as the shape of the blade edge 130*a* in the above-mentioned first embodiment.

According to the first modification of the first embodiment, the bonding step is started in the state in which the core wire crimping portion 12 has already been crimped to the core wire 31. Specifically, the bonding portion 34 is formed after the pressing force applied by the second die 120 to the core wire crimping portion 12 and the core wire 31 becomes maximum. Thus, in the method of manufacturing an electric wire with terminal according to the first modification of the first embodiment, external force less acts on the bonding portion 34 after the bonding portion 34 is formed, and hence the bonding portion 34 is easily stabilized.

Second Modification of First Embodiment

Figure 26:
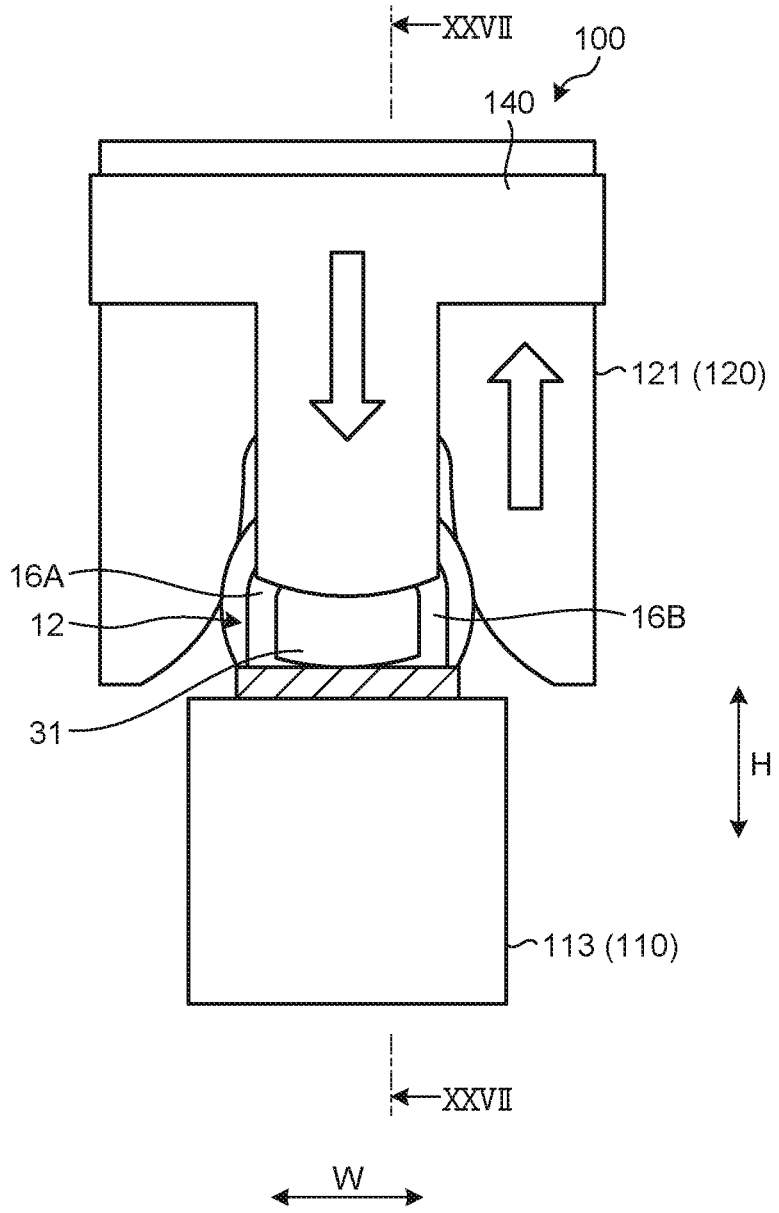
FIG. 26 is a front view for describing a bonding step according to a second modification of the first embodiment.
Figure 27:
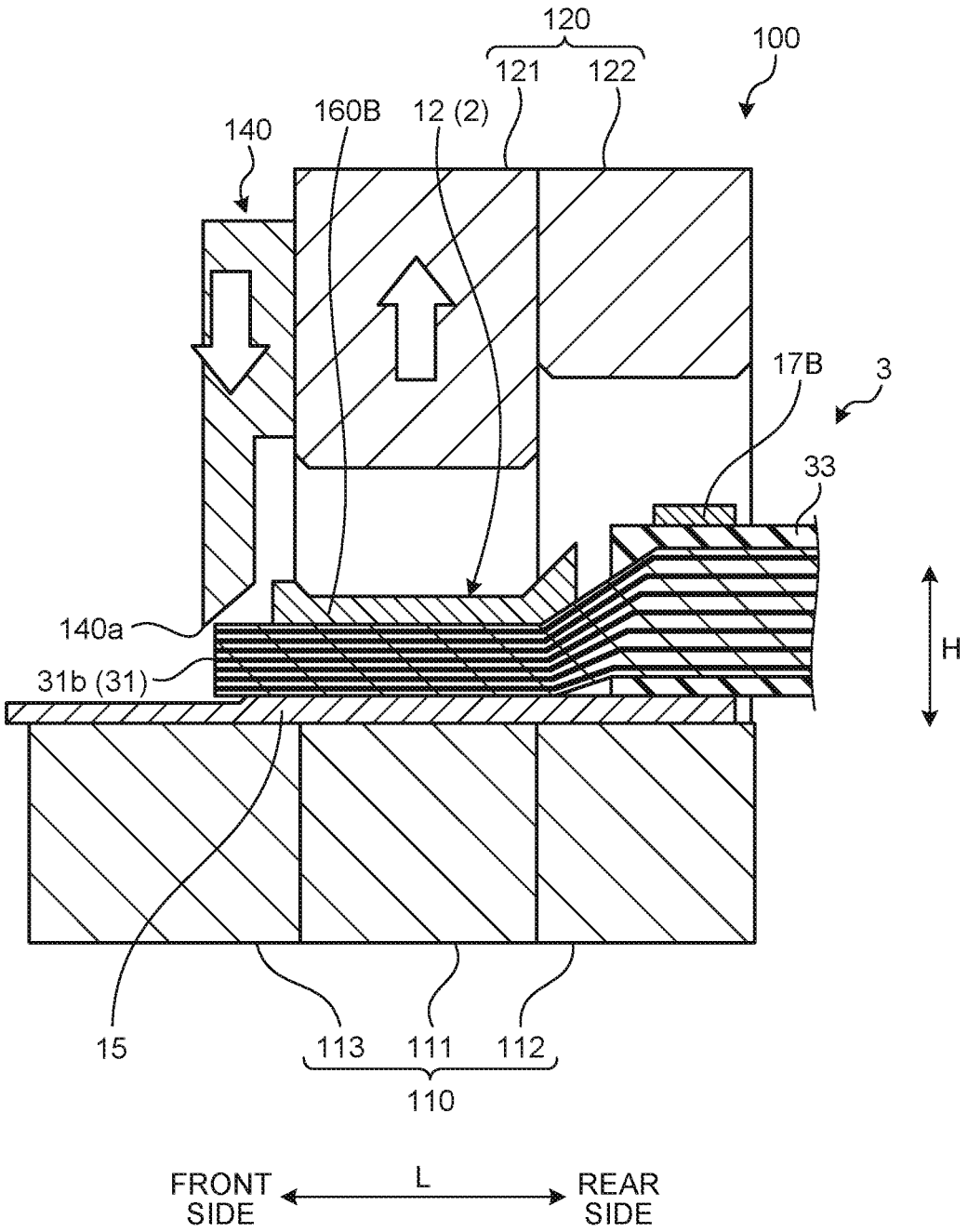
FIG. 27 is a cross-sectional view for describing the bonding step according to the second modification of the first embodiment.

Referring to FIG. 26 and FIG. 27, a second modification of the first embodiment is described. FIG. 26 is a front view for describing a bonding step according to the second modification of the first embodiment. FIG. 27 is a cross-sectional view for describing the bonding step according to the second modification of the first embodiment. FIG. 27 illustrates a cross section taken along the line XXVII-XXVII in FIG. 26. The second modification of the first embodiment is different from the above-mentioned first embodiment in that, for example, the terminal crimping apparatus 100 forms a bonding portion 34 while raising the second die 120.

A machining tool 140 according to the second modification of the first embodiment can move relative to the second die 120 similarly to the machining tool 140 according to the above-mentioned first modification. The terminal crimping apparatus 100 forms a bonding portion 34 by the machining tool 140 after the second die 120 has reached the bottom dead center. At the bonding step according to the second modification, the terminal crimping apparatus 100 raises the second die 120 without stopping the second die 120 at the bottom dead center. Specifically, at the bonding step, the second die 120 rises and the machining tool 140 lowers as illustrated in FIG. 26 and FIG. 27.

According to the second modification of the first embodiment, similarly to the above-mentioned first modification, the bonding step is started in a state in which the core wire crimping portion 12 is crimped to the core wire 31. Thus, the formed bonding portion 34 is easily stabilized. In the case where the bonding step is executed after crimping, the bonding portion 34 may be formed by a device different from the terminal crimping apparatus 100.

Third Modification of First Embodiment

Figure 28:
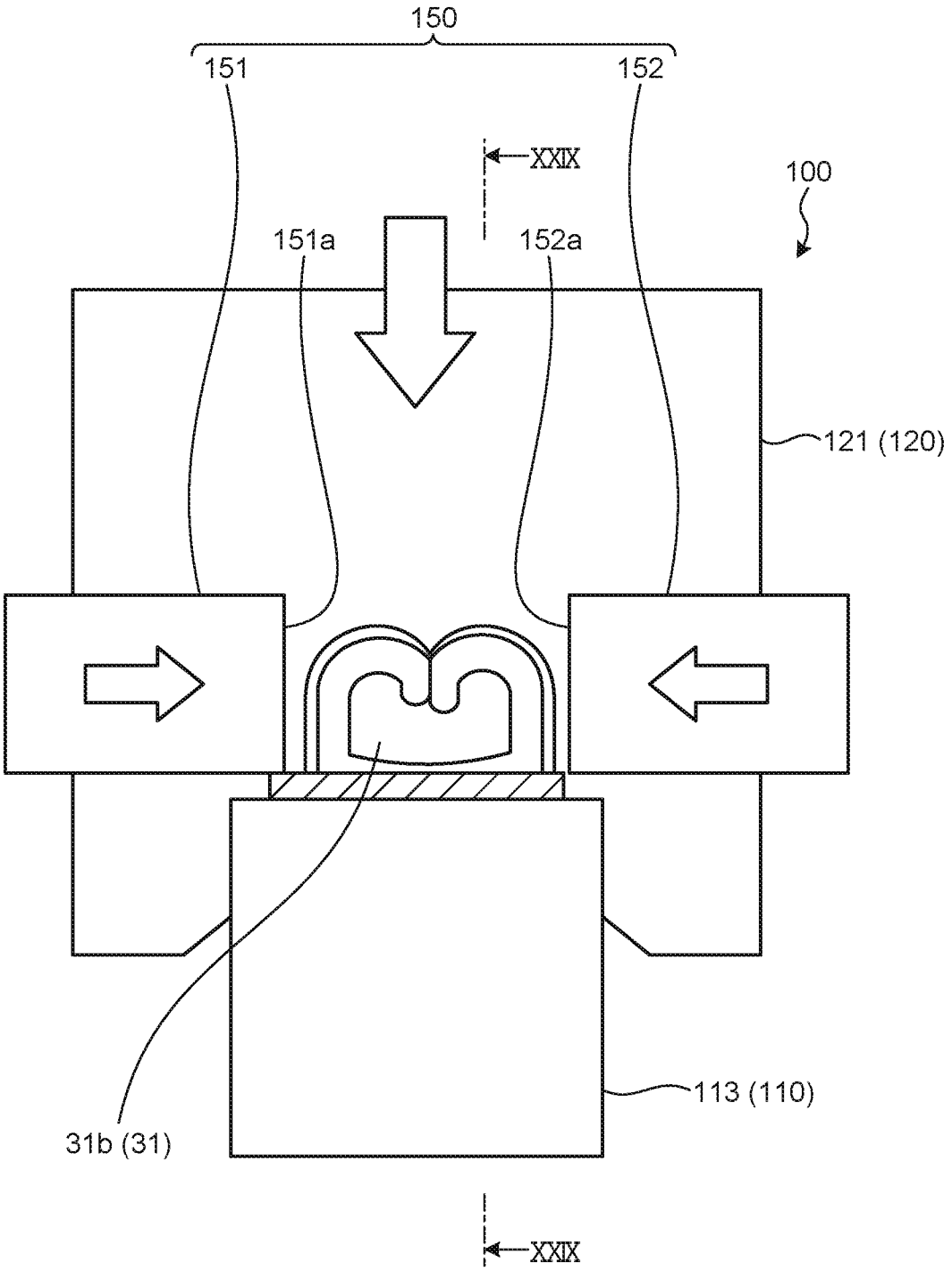
FIG. 28 is a front view for describing a bonding step according to a third modification of the first embodiment.
Figure 29:
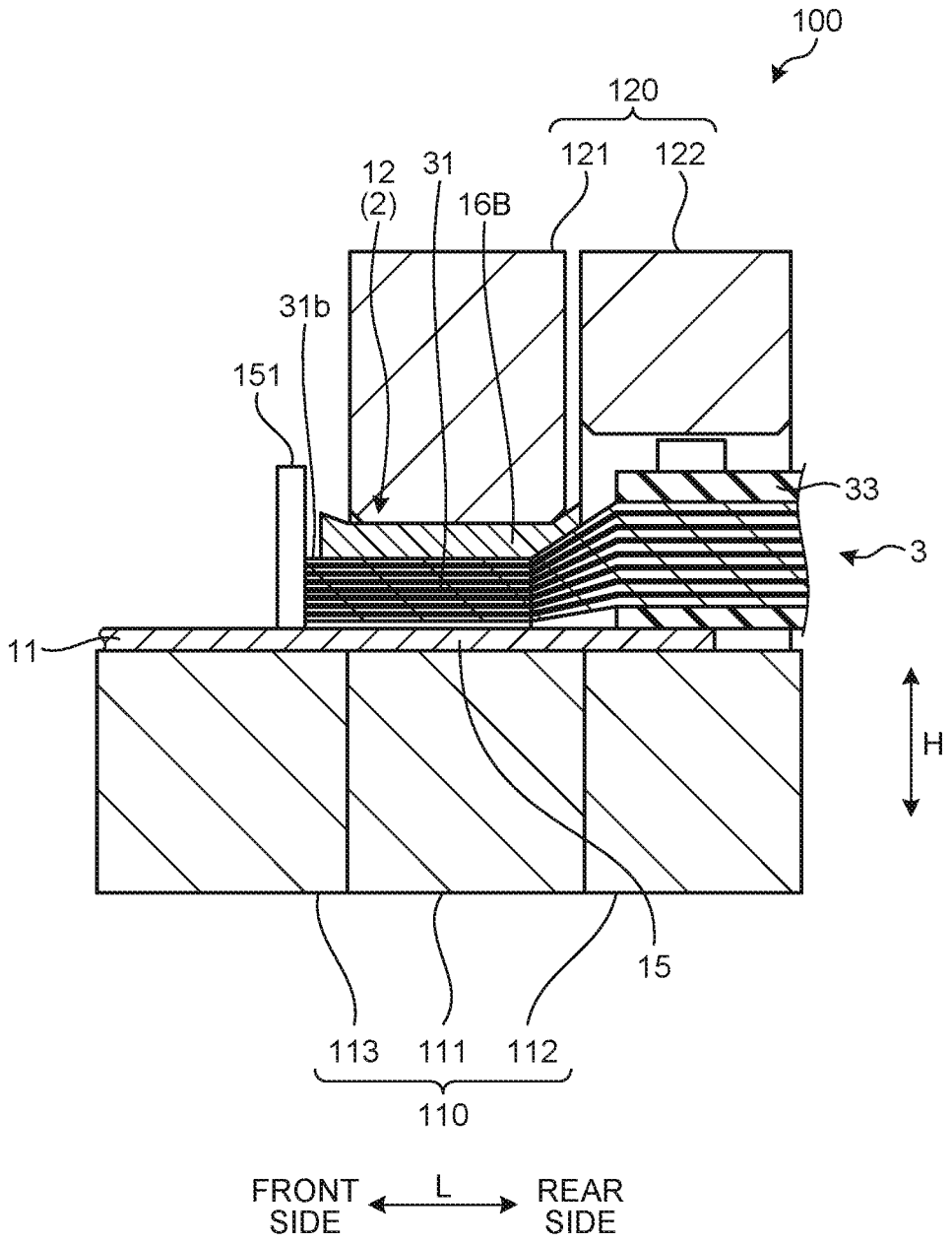
FIG. 29 is a cross-sectional view for describing the bonding step according to the third modification of the first embodiment.

Referring to FIG. 28 and FIG. 29, a third modification of the first embodiment is described. FIG. 28 is a front view for describing a bonding step according to the third modification of the first embodiment. FIG. 29 is a cross-sectional view for describing the bonding step according to the third modification of the first embodiment. FIG. 29 illustrates a cross section taken along the line XXIX-XXIX in FIG. 28. The third modification of the first embodiment is different from the above-mentioned first embodiment in that, for example, a machining tool 150 moves in the second direction W.

The machining tool 150 according to the third modification of the first embodiment includes a first sliding portion 151 and a second sliding portion 152. The first sliding portion 151 and the second sliding portion 152 move in the second direction W. The terminal crimping apparatus 100 operates the second die 120 and the machining tool 150 in cooperation with each other. A mechanism configured to operate the second die 120 and a mechanism configured to operate the machining tool 150 may be common or independent from each other. The two sliding portions 151 and 152 move in opposite directions along the second direction W. A blade edge 151*a* of the first sliding portion 151 and a blade edge 152*a* of the second sliding portion 152 are opposed to each other in the second direction W. The machining tool 150 sandwiches a distal end 31*b* of a core wire 31 between the blade edge 151*a* of the first sliding portion 151 and the blade edge 152*a* of the second sliding portion 152 to form a bonding portion 34. For example, the two blade edges 151*a* and 152*a* have a symmetric shape. For example, the operations of the two blade edges 151*a* and 152*a* are symmetric.

For example, the machining tool 150 forms the bonding portion 34 in parallel to the crimping step. The machining tool 150 may form the bonding portion 34 before the crimping step or after the crimping step. The terminal crimping apparatus 100 may form the bonding portion 34 by the machining tool 150 in a state in which the second die 120 is stopped at the bottom dead center.

Figure 30:
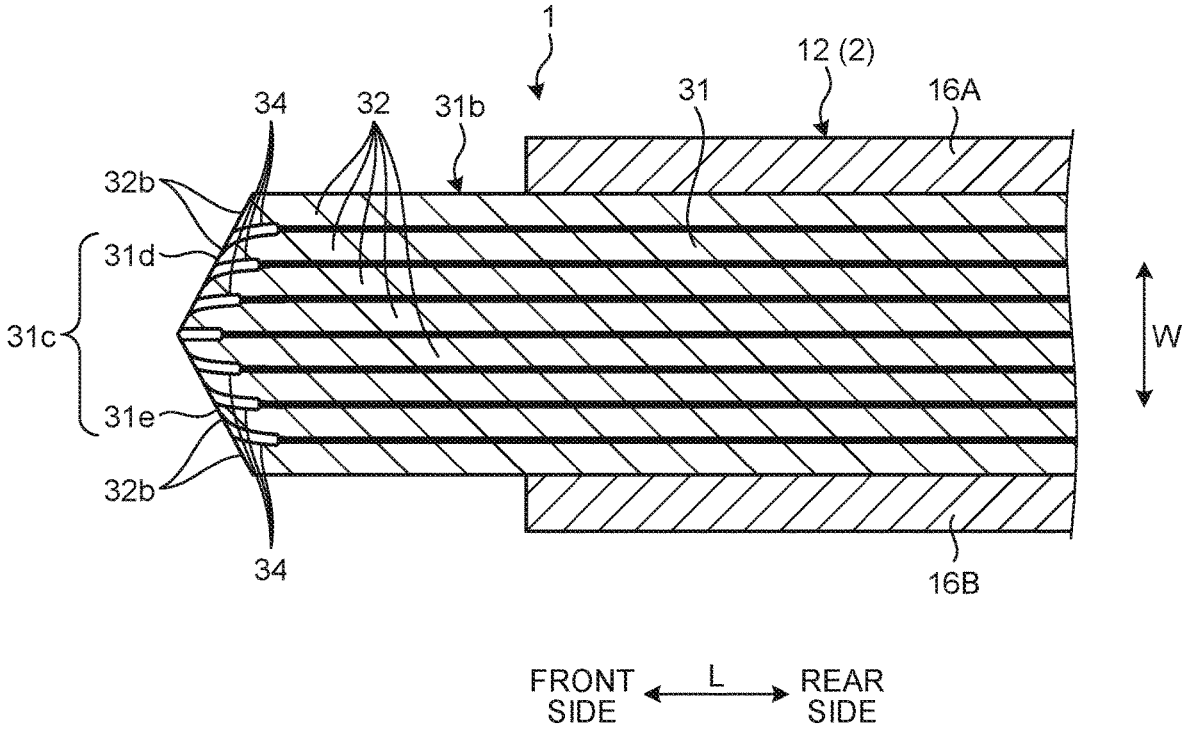
FIG. 30 is a cross-sectional view of a core wire subjected to bonding processing.

FIG. 30 illustrates a cross section of the core wire 31 after subjected to bonding processing by the machining tool 150. The cross section in FIG. 30 is orthogonal to the third direction H. A distal end surface 31*c* of the core wire 31 has a first face 31*d* and a second face 31*e*. The first face 31*d* and the second face 31*e* are faces oriented to the front side and adjacent to each other. In the third modification, the first face 31*d* and the second face 31*e* are adjacent in the second direction W.

The first face 31*d* and the second face 31*e* are surfaces inclined with respect to the first direction L. The boundary of the first face 31*d* and the second face 31*e* is at the center in the second direction W. The first face 31*d* is inclined toward the front side as approaching the second face 31*e* along the second direction W. The second face 31*e* is inclined toward the front side as approaching the first face 31*d* along the second direction W.

At the first face 31*d*, the distal ends of the element wires 32 are sheared and deformed in a direction from the first face 31*d* toward the second face 31*e*. The element wires 32 at the first face 31*d* are deformed by the shearing force acting from the first sliding portion 151 and directed to the second face 31*e*. At the second face 31*e*, on the other hand, the distal ends of the element wires 32 are sheared and deformed in a direction from the second face 31*e* toward the first face 31*d*. The element wires 32 at the second face 31*e* are deformed by the shearing force acting from the second sliding portion 152 and directed to the first face 31*d*.

As described above, in the electric wire with terminal 1 according to the third modification of the first embodiment, the distal end surface 31*c* of the core wire 31 is an inclined surface inclined with respect to the axial direction of the electric wire 3. The machining tool 150 shears and deforms the core wire 31 so as to form the inclined surface, and hence the formation of the bonding portion 34 is easily promoted.

In the electric wire with terminal 1 according to the third modification of the first embodiment, the distal end surface 31*c* of the core wire 31 includes the first face 31*d* and the second face 31*e* adjacent to each other. At the first face 31*d*, the distal ends of the element wires 32 are sheared and deformed in a direction from the first face 31*d*toward the second face 31*e*. At the second face 31*e*, the distal ends of the element wires 32 are sheared and deformed in a direction from the second face 31*e* toward the first face 31*d*. Typically, the two faces 31*d* and 31*e* are formed when the core wire 31 is sheared and deformed by being sandwiched by the two blade edges 151*a* and 152*a*. By sandwiching the core wire 31 by the two blade edges 151*a* and 152*a*, the bonding portions 34 can be easily formed on the entire distal end surface 31*c*.

Fourth Modification of First Embodiment

Figure 31:
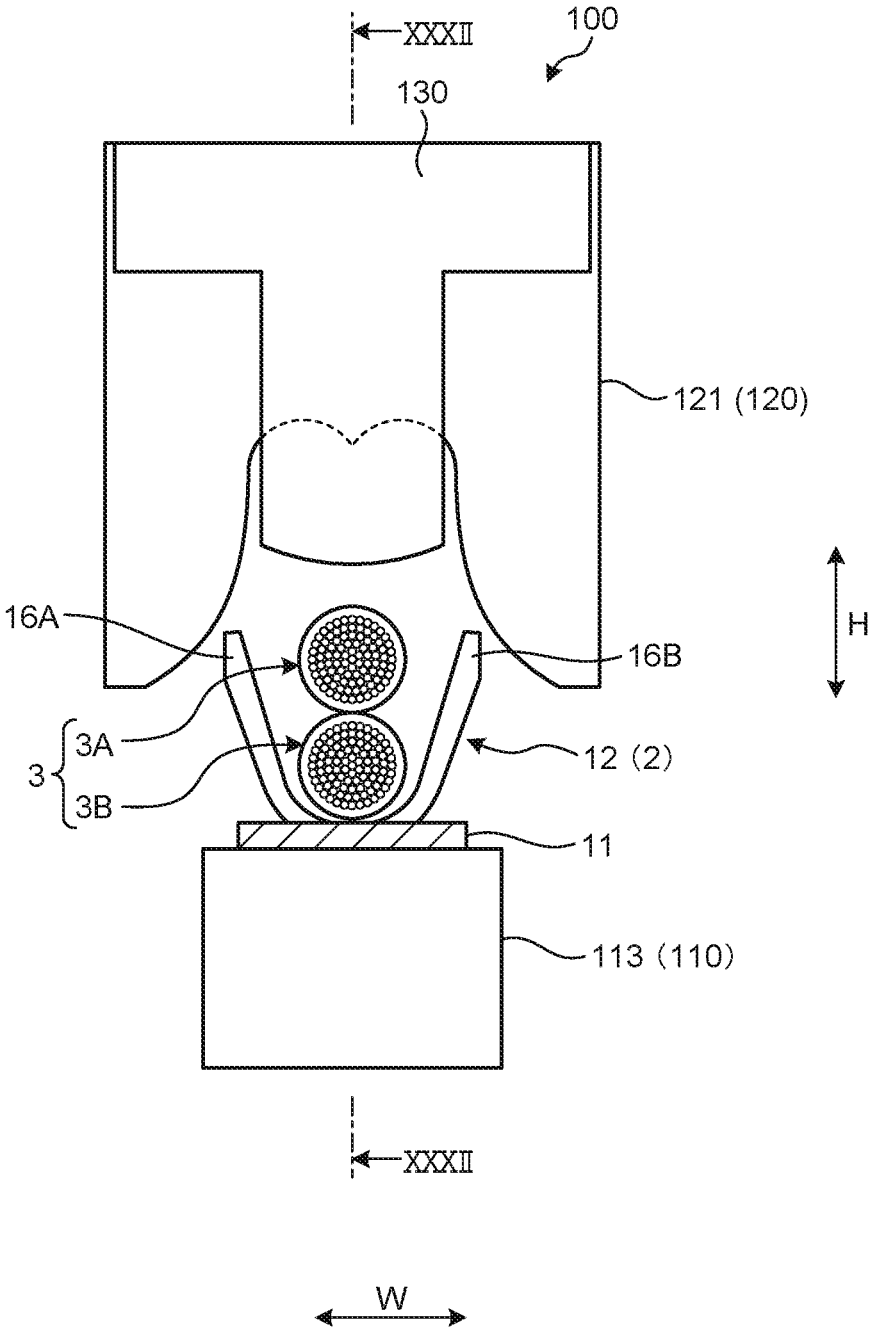
FIG. 31 is a front view for describing a bonding step according to a fourth modification of the first embodiment.
Figure 32:
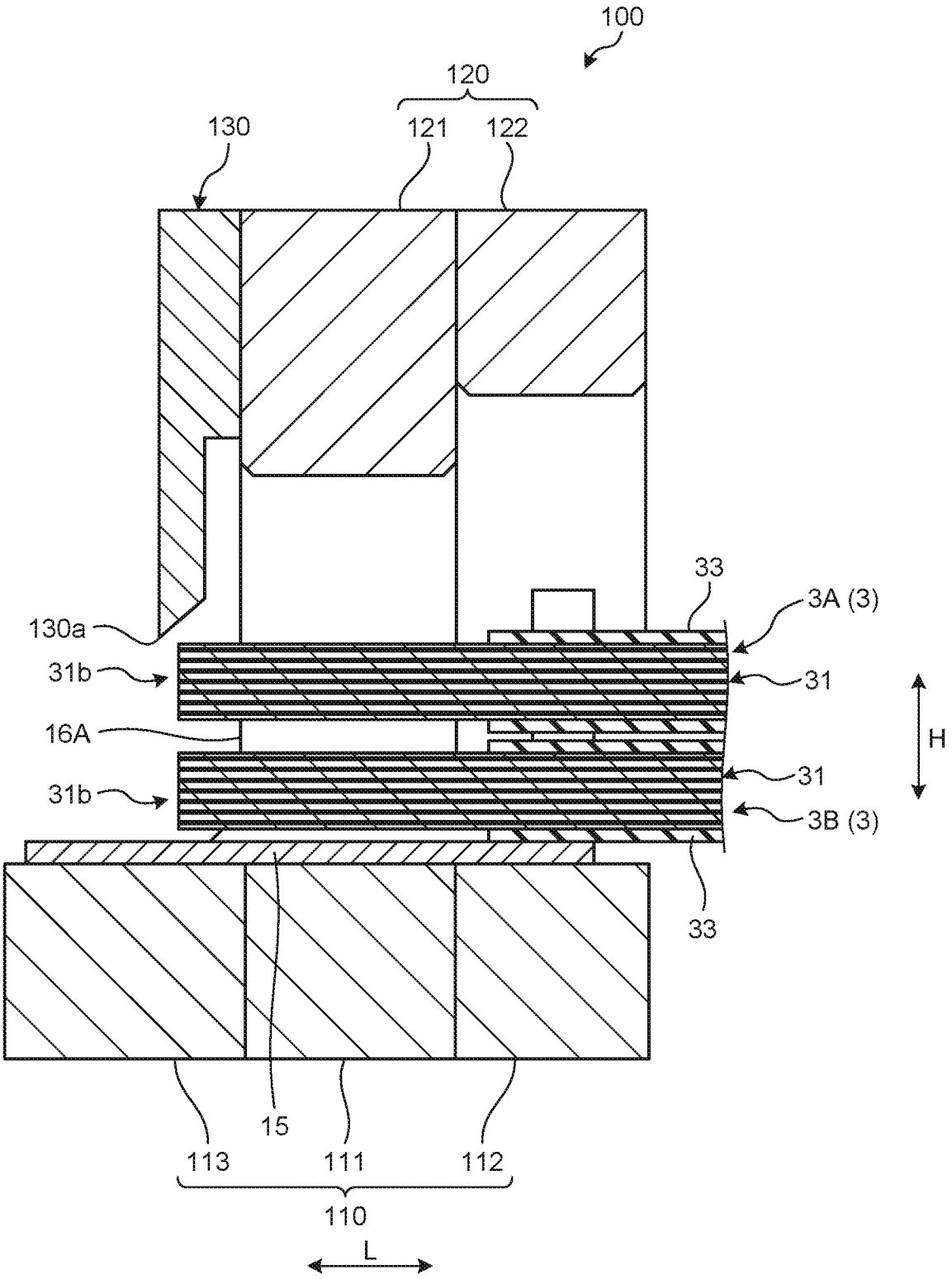
FIG. 32 is a cross-sectional view for describing the bonding step according to the fourth modification of the first embodiment.

Referring to FIG. 31 and FIG. 32, a fourth modification of the first embodiment is described. FIG. 31 is a front view for describing a bonding step according to the fourth modification of the first embodiment. FIG. 32 is a cross-sectional view for describing the bonding step according to the fourth modification of the first embodiment. FIG. 32 illustrates a cross section taken along the line XXXII-XXXII in FIG. 31. The fourth modification of the first embodiment is different from the above-mentioned first embodiment in that, for example, bonding portions 34 are formed on a plurality of core wires 31 at a time.

As illustrated in FIG. 31 and FIG. 32, in the fourth modification, a crimp terminal 2 is clamped to an electric wire 3 having a first electric wire 3A and a second electric wire 3B. For example, the two electric wires 3A and 3B are placed on the crimp terminal 2 while being overlapped in the third direction H. A machining tool 130 plastically deforms distal ends 31*b* of the two electric wires 3A and 3B to form a bonding portion 34. The machining tool 130 may form the bonding portion 34 by bonding a core wire 31 of the first electric wire 3A and a core wire 31 of the second electric wire 3B. In this manner, the core wires 31 of the two electric wires 3A and 3B are metal-bonded, and the electric performance of the electric wire with terminal 1 improves.

Fifth Modification of First Embodiment

Figure 33:
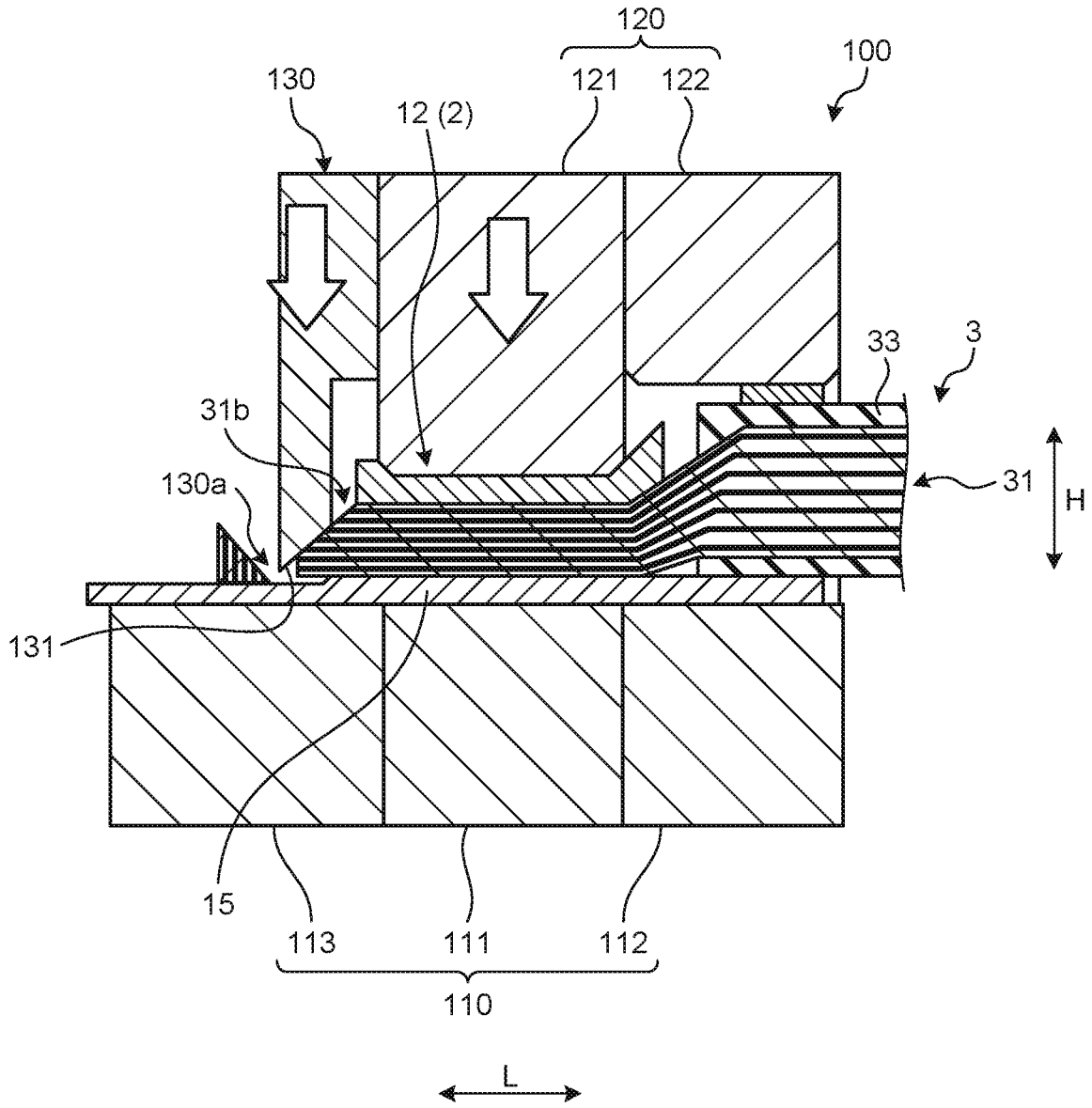
FIG. 33 is a cross-sectional view for describing a bonding step according to a fifth modification of the first embodiment.

Referring to FIG. 33, a fifth modification of the first embodiment is described. FIG. 33 is a cross-sectional view for describing a bonding step according to the fifth modification of the first embodiment. The fifth modification of the first embodiment is different from the above-mentioned first embodiment in that, for example, the cutting step is performed at the same time as the bonding step. The cutting step is a step for cutting an electric wire 3.

As illustrated in FIG. 33, a machining tool 130 according to the fifth modification cuts a part of the core wire 31 on the distal end side. The machining tool 130 forms bonding portions 34 at a part of the core wire 31 on the covering 33 side while cutting the core wire 31. A blade edge 130*a* of the machining tool 130 has a shape capable of cutting the core wire 31. When the core wire 31 is cut by the blade edge 130*a* of the machining tool 130, a new distal end 31*b* is formed in the core wire 31. An inclined surface 131 of the machining tool 130 shears and deforms the newly formed distal end 31*b* to form a bonding portion 34 at the distal end 31*b*.

The machining tool 130 may cut the core wire 31 when the elongation of the core wire 31 at the crimping step is equal to or more than a predetermined amount. At the crimping step, the core wire crimping portion 12 presses the core wire 31 to compress the core wire 31. As a result, the core wire 31 elongates along the first direction L. The distal end 31*b* of the core wire 31 may be located on the front side of the machining tool 130 due to variation in elongation of the core wires 31 at the crimping step. In this case, the machining tool 130 cuts the core wire 31 by the blade edge 130*a*. As a result, the protruding length of the core wire 31 from the core wire crimping portion 12 is prevented from being easily excessive.

Second Embodiment

Figure 34:
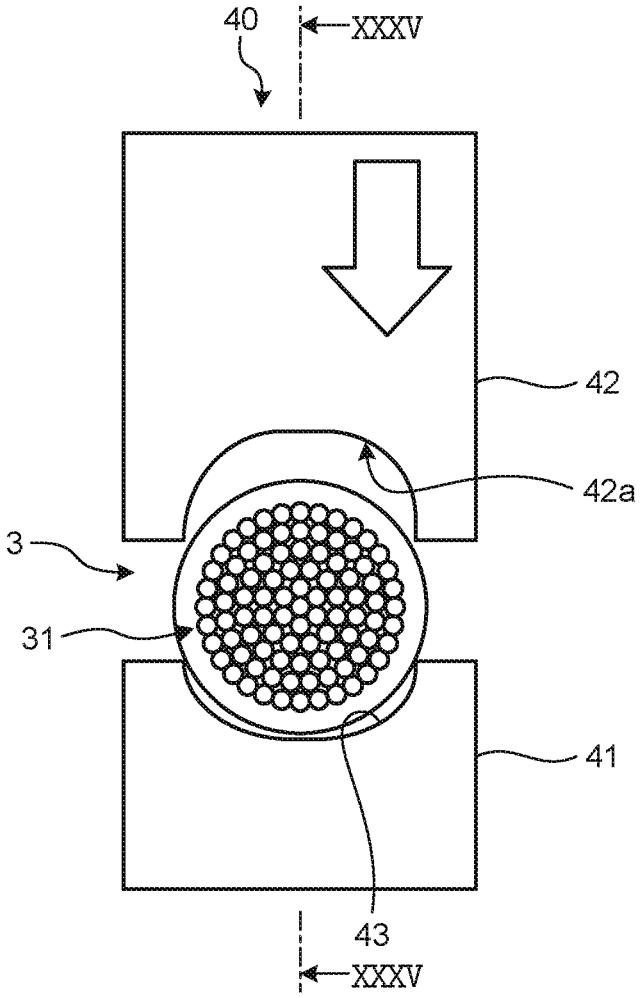
FIG. 34 is a front view for describing a cutting step and a bonding step according to a second embodiment.
Figure 35:
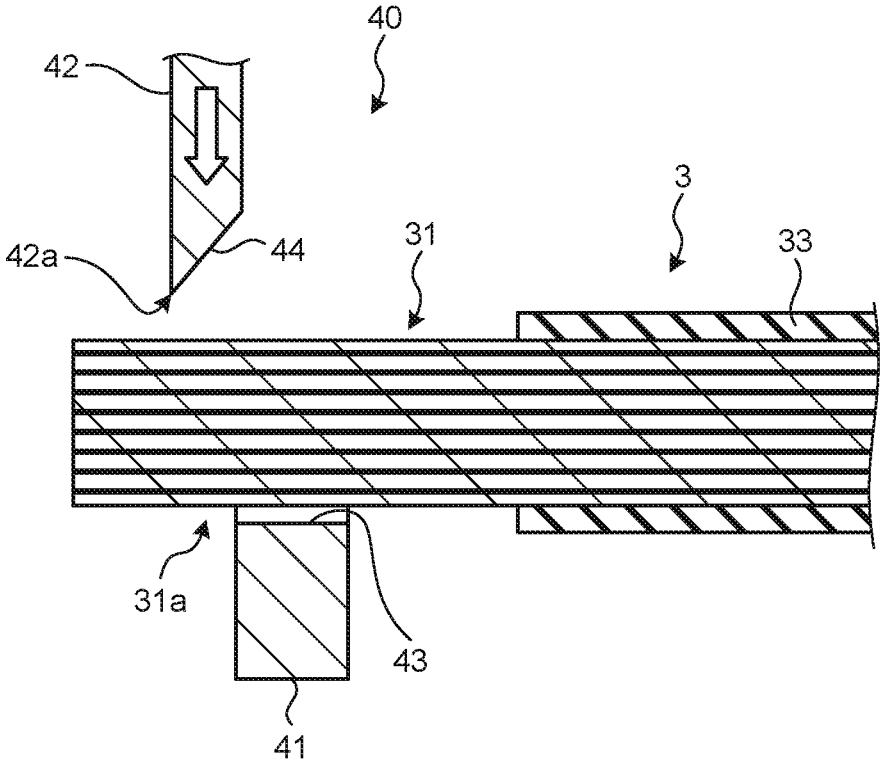
FIG. 35 is a cross-sectional view for describing the cutting step and the bonding step according to the second embodiment.
Figure 36:
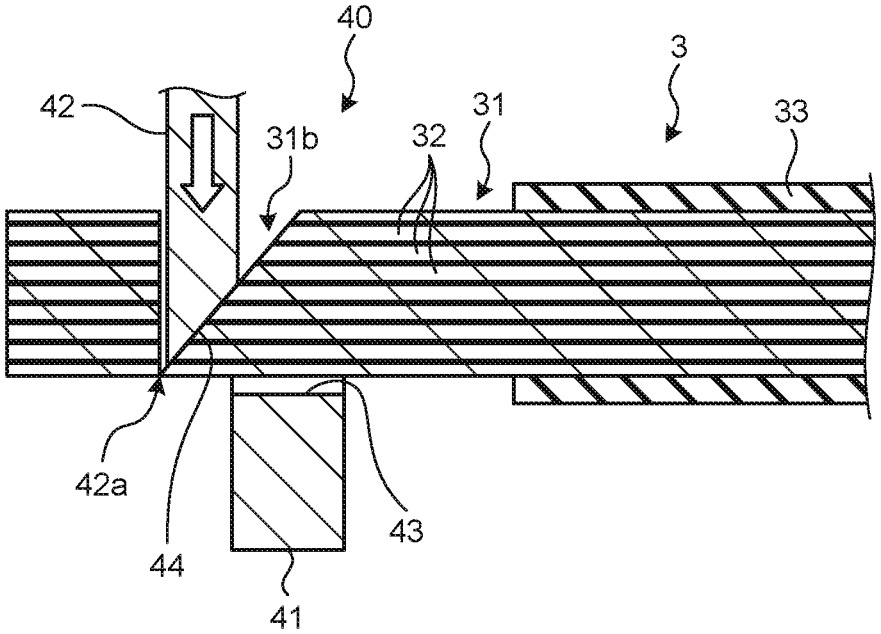
FIG. 36 is another cross-sectional view for describing the cutting step and the bonding step according to the second embodiment.
Figure 37:
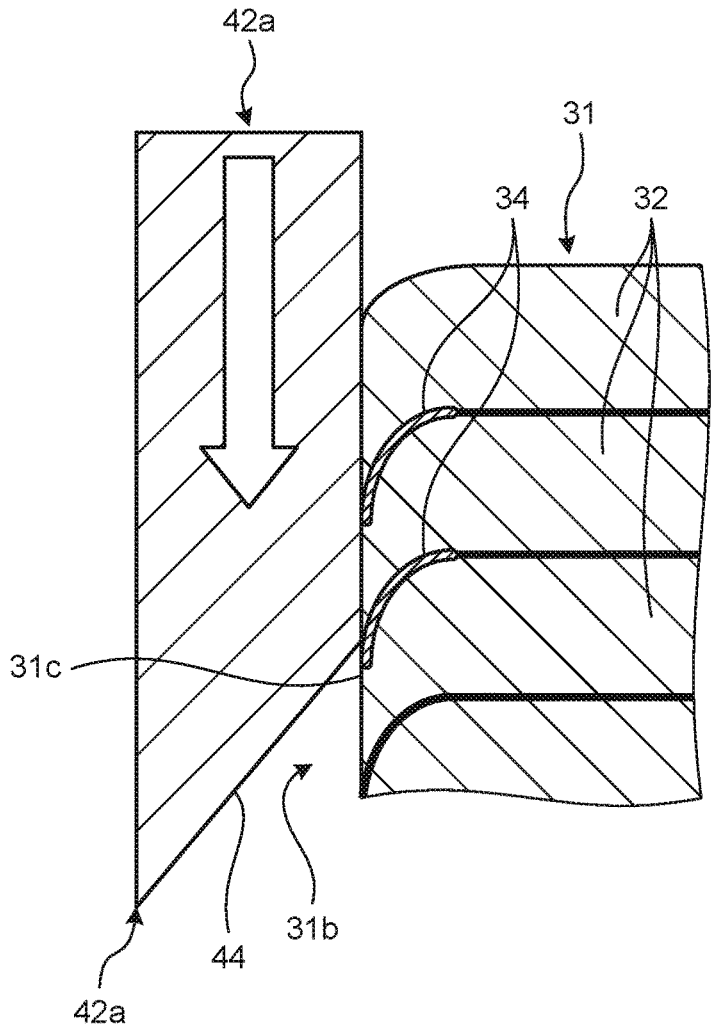
FIG. 37 is a cross-sectional view for describing the formation of bonding portions.
Figure 38:
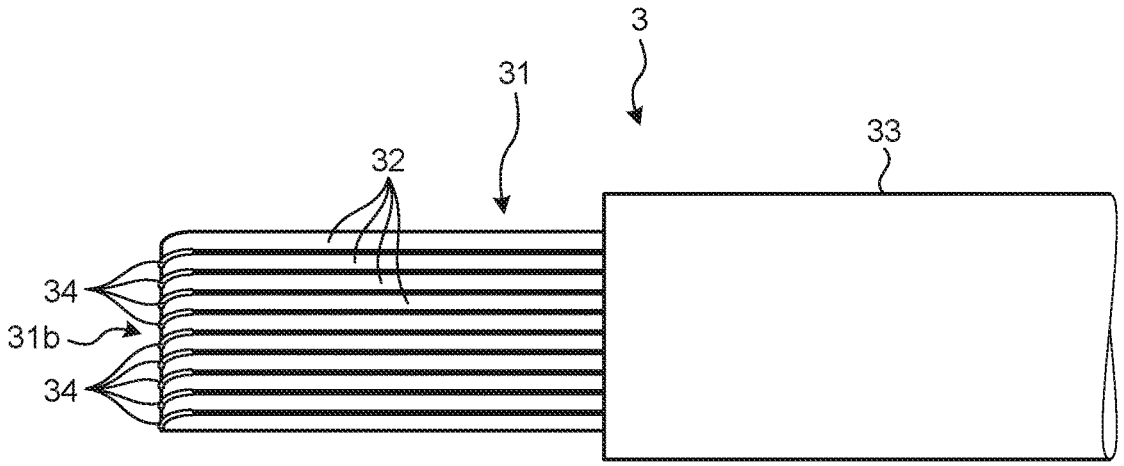
FIG. 38 is a side view illustrating a cut electric wire.

Referring to FIG. 34 to FIG. 50, a second embodiment is described. In the second embodiment, components having the same functions as those described above in the first embodiment are denoted by the same reference symbols, and overlapping descriptions are omitted. FIG. 34 is a front view for describing a cutting step and a bonding step according to the second embodiment. FIG. 35 is a cross-sectional view for describing the cutting step and the bonding step according to the second embodiment. FIG. 36 is another cross-sectional view for describing the cutting step and the bonding step according to the second embodiment. FIG. 37 is a cross-sectional view for describing the formation of bonding portions. FIG. 38 is a side view illustrating an electric wire after cutting. FIG. 35 illustrates a cross section taken along the line XXXV-XXXV in FIG. 34.

In the second embodiment, the cutting step is performed before the crimping step, and at the cutting step, bonding portions 34 are formed in the core wire 31. In other words, the cutting step and the bonding step are performed in parallel. For example, the cutting step and the bonding step are executed by a cutting device 40 illustrated in FIG. 34 and FIG. 35. The cutting device 40 includes a receiving portion 41 and a cutting blade 42. The receiving portion 41 is a member that supports the electric wire 3, and is formed of metal, for example. The receiving portion 41 has a groove portion 43 that supports the electric wire 3. The cross-sectional shape of the groove portion 43 is an arc shape having a radius corresponding to the outer diameter of the electric wire 3.

The cutting blade 42 is a member configured to cut the electric wire 3, and cuts the electric wire 3 by a blade edge 42*a*. For example, the shape of the blade edge 42*a* in front view is, as illustrated in FIG. 34, a curved shape in which both end portions in the width direction protrude more than a center portion in the width direction. For example, the shape of the curved part of the blade edge 42*a* in front view is an arc shape. For example, as illustrated in FIG. 35, the cross-sectional shape of the blade edge 42*a* is a shape in which one surface in the thickness direction is an inclined surface 44. For example, the electric wire 3 is placed on the receiving portion 41 in the state in which the end portion 31*a* of the core wire 31 is exposed. The cutting blade 42 cuts the core wire 31 of the electric wire 3 while relatively moving toward the receiving portion 41.

The inclined surface 44 of the cutting blade 42 is formed on the covering 33 side. Thus, as illustrated in FIG. 36, the blade edge 42*a* of the cutting blade 42 shears and deforms the distal end 31*b* of the core wire 31 by the inclined surface 44 while cutting the core wire 31. As illustrated in FIG. 37, the inclined surface 44 slidingly moves on the distal end surface 31*c* of the core wire 31, and the distal end of each element wire 32 shears and deforms along the movement direction of the blade edge 42*a*. As a result, a bonding portion 34 at which adjacent element wires 32 are bonded is formed at the distal ends of the element wires 32.

Figure 39:
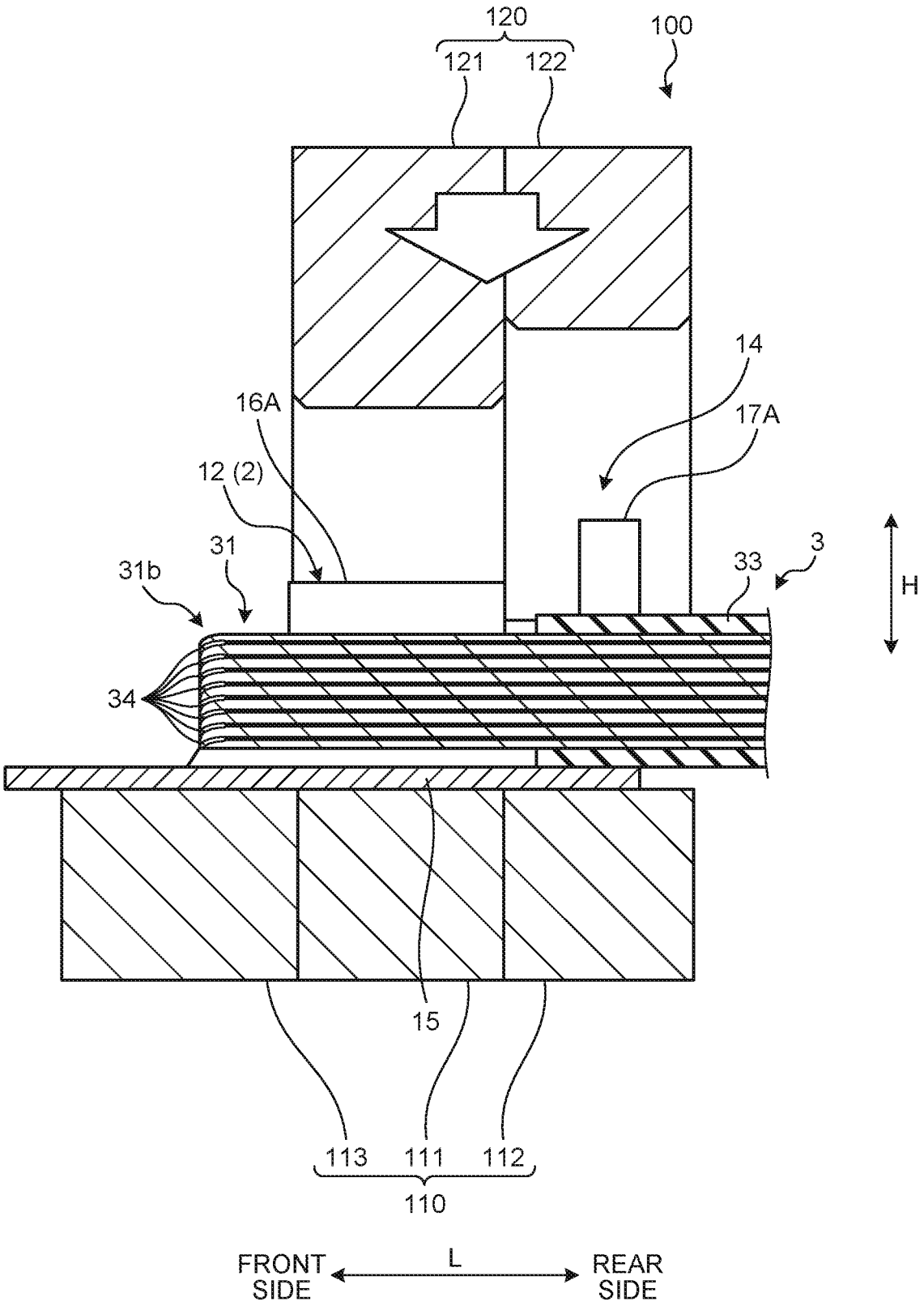
FIG. 39 is a cross-sectional view for describing an installation step in the second embodiment.

FIG. 38 illustrates the electric wire 3 after cutting. In the cut electric wire 3, the distal ends of the element wires 32 are sheared and deformed in the common direction to form the bonding portion 34. In the second embodiment, at an installation step, the electric wire 3 having the bonding portions 34 formed therein is installed on the crimp terminal 2. As illustrated in FIG. 39, at the installation step, the electric wire 3 is installed on the crimp terminal 2 such that the distal end 31*b* of the core wire 31 is located on the front side of the core wire crimping portion 12. It is preferred that the electric wire 3 be installed such that at least the bonding portion 34 is located on the front side of the core wire crimping portion 12.

Figure 40:
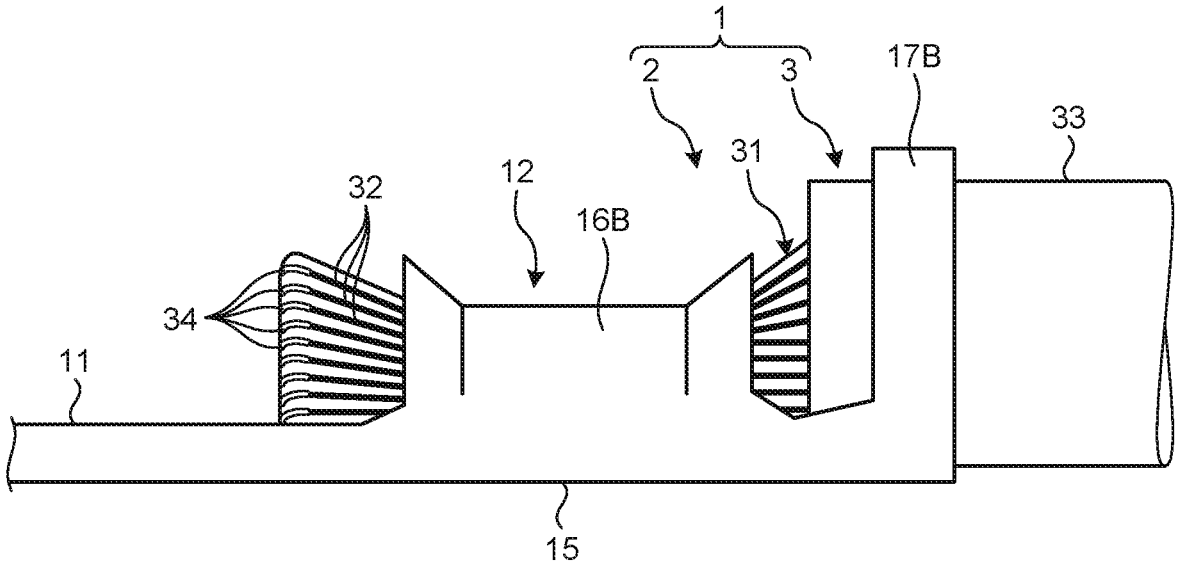
FIG. 40 is a side view of an electric wire with terminal according to the second embodiment.

At the crimping step, the terminal crimping apparatus 100 crimps the core wire crimping portion 12 to the core wire 31, and crimps the covering crimping portion 14 to the covering 33. The first crimper 121 crimps the core wire crimping portion 12 to the core wire 31 in a state in which the bonding portions 34 protrude from the core wire crimping portion 12. As illustrated in FIG. 40, in the crimped electric wire with terminal 1, the bonding portions 34 protrude from the core wire crimping portion 12 to the front side. The element wires 32 are electrically connected to each other through the bonding portions 34, and hence the electric performance in the electric wire with terminal 1 is improved.

Figure 41:
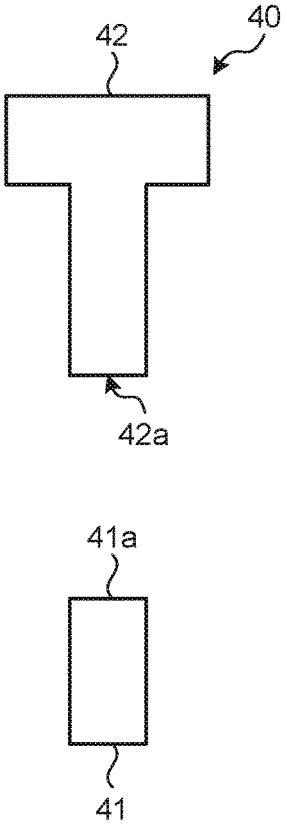
FIG. 41 is a front view illustrating an example of the shape of a cutting device.

The shape of the cutting device 40 is not limited to the shape exemplified above. FIG. 41 is a front view illustrating an example of the shape of the cutting device. In a receiving portion 41 illustrated in FIG. 41, a support surface 41*a* that supports the electric wire 3 is flat. The blade edge 42*a* of the cutting blade 42 has a linear shape in front view.

Figure 42:
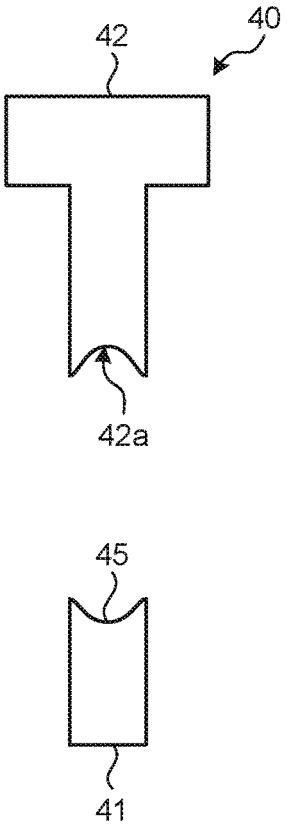
FIG. 42 is a front view illustrating another example of the shape of the cutting device.

FIG. 42 is a front view illustrating another example of the shape of the cutting device. In a receiving portion 41 illustrated in FIG. 42, the shape of a groove portion 45 is different from the shape of the groove portion 43 illustrated in FIG. 34. In the groove portion 45, the shape of a center portion in the width direction is a substantially arc shape, and both end portions have a linear shape. In the shape of the blade edge 42*a* of the cutting blade 42 in front view, the shape of a center portion in the width direction is a substantially arc shape, and both end portions have a linear shape.

Figure 43:
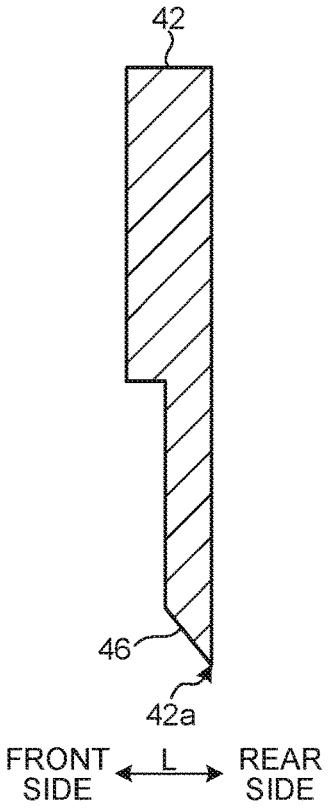
FIG. 43 is a cross-sectional view illustrating an example of the cross-sectional shape of a cutting blade.
Figure 44:
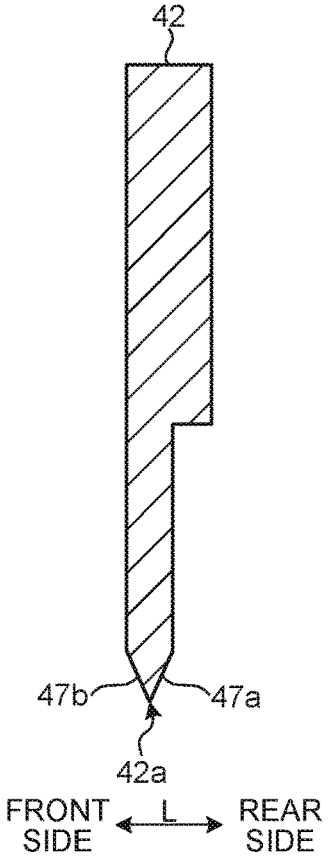
FIG. 44 is a cross-sectional view illustrating another example of the cross-sectional shape of the cutting blade.

FIG. 43 is a cross-sectional view illustrating an example of the cross-sectional shape of the cutting blade. In a cutting blade 42 illustrated in FIG. 43, an inclined surface 46 is provided on the front side in the first direction L. Specifically, the inclined surface 46 of the blade edge 42*a* is inclined so as to approach the covering 33 as approaching the distal end. FIG. 44 is a cross-sectional view illustrating another example of the cross-sectional shape of the cutting blade. In a cutting blade 42 illustrated in FIG. 44, the blade edge 42*a* has inclined surfaces 47*a* and 47*b* on both sides. The cross-sectional shape of the blade edge 42*a* is a shape in which a center portion in the thickness direction protrudes more than both end portions. The cross-sectional shape of the cutting blade 42 may be the cross-sectional shape as illustrated in FIG. 21.

Figure 45:
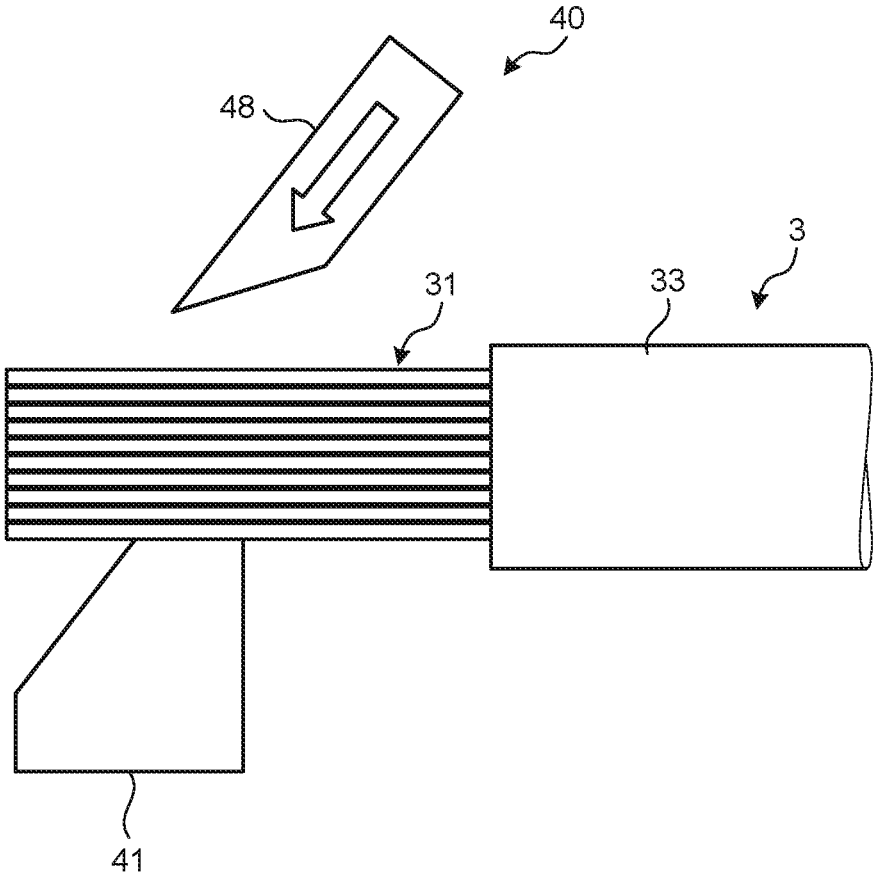
FIG. 45 is a side view of a cutting device configured to cut a core wire along an oblique direction.

The cutting device 40 may cut the core wire 31 in an oblique direction. FIG. 45 illustrates a cutting device 40 configured to cut the core wire 31 along an oblique direction. The cutting device 40 in FIG. 45 includes a receiving portion 41 and a cutting blade 48. The movement direction of the cutting blade 48 is inclined with respect to the axial direction of the electric wire 3. The cutting blade 48 shears and deforms the distal end of the core wire 31 while cutting the core wire 31.

Figure 46:
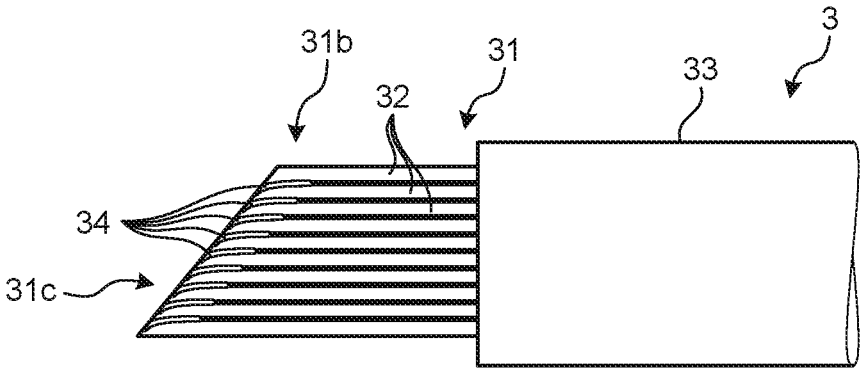
FIG. 46 is a side view of an electric wire in which bonding portions are formed.
Figure 47:
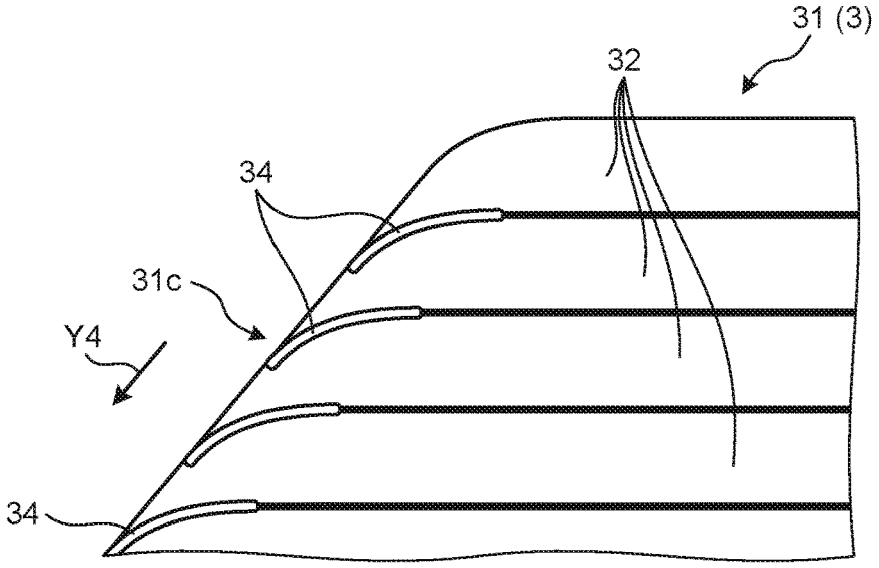
FIG. 47 is a cross-sectional view of the electric wire in which the bonding portions are formed.

In the core wire 31 sheared and deformed by the cutting blade 48, bonding portions 34 are formed as illustrated in FIG. 46. A distal end surface 31*c* of the core wire 31 is inclined with respect to the axial direction of the electric wire 3. As illustrated in FIG. 47, the distal ends of the element wires 32 are plastically deformed along a movement direction Y4 of the cutting blade 48. As a result, adjacent element wires 32 are bonded together to form a bonding portion 34. When the core wire 31 is cut in the oblique direction, the force of stretching in the axial direction may easily act on the element wire 32. Thus, it is expected that the formation of the bonding portions 34 is promoted.

Figure 48:
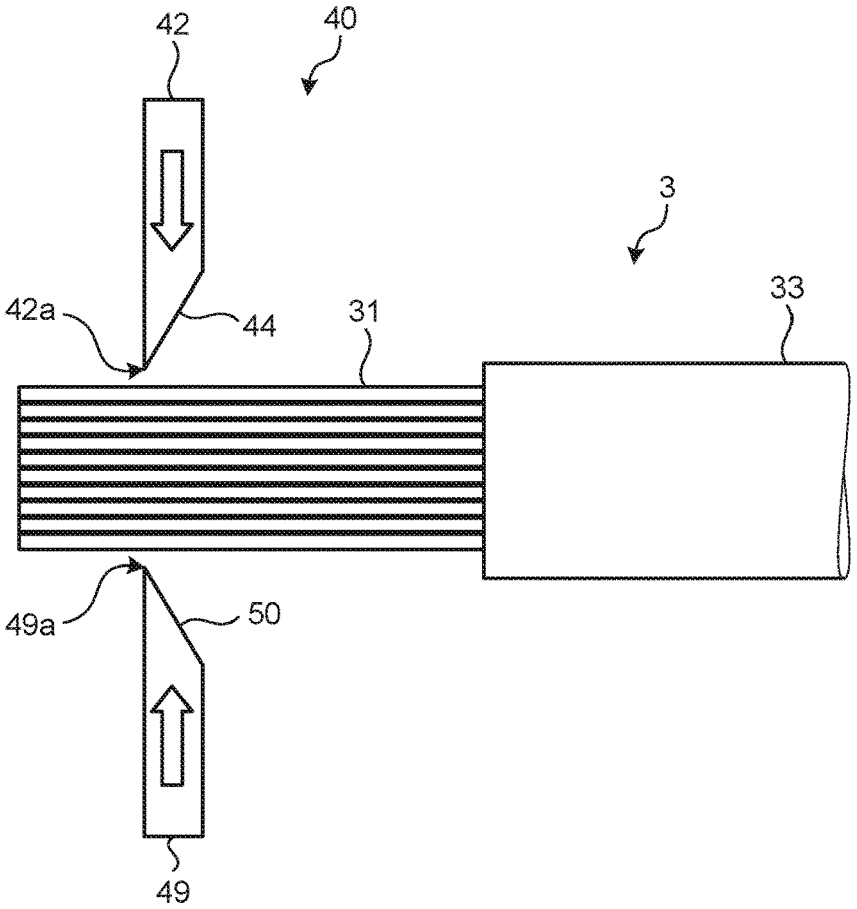
FIG. 48 is a side view of a cutting device including two cutting blades.

The cutting device 40 may cut the core wire 31 by two cutting blades. FIG. 48 illustrates a cutting device 40 configured to cut the core wire 31 by two cutting blades. A cutting device 40 illustrated in FIG. 48 includes a second cutting blade 49 instead of the receiving portion 41. The cutting blade 49 is disposed such that a blade edge 49*a* thereof is opposed to the blade edge 42*a* of the cutting blade 42. In the cutting device 40 illustrated in FIG. 48, the cutting blade 42 and the cutting blade 49 have inclined surfaces 44 and 50 on the same side. The cutting device 40 moves the two cutting blades 42 and 49 in opposite directions. The cutting device 40 holds the electric wire 3 between the two cutting blades 42 and 49 by a holding portion (not shown).

Figure 49:
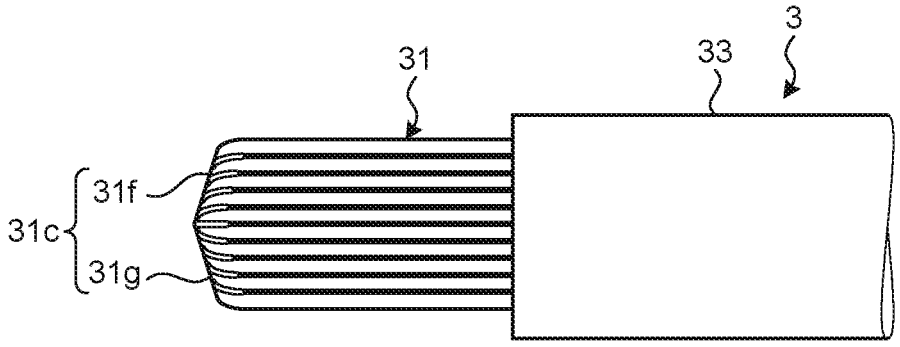
FIG. 49 is a side view of a cut electric wire.

The cutting device 40 moves the two cutting blades 42 and 49 in directions such that the two cutting blades 42 and 49 approach each other, and cuts the core wire 31 while sandwiching the core wire 31 between the blade edge 42*a* and the blade edge 49*a*. As illustrated in FIG. 49, a distal end surface 31*c* of the cut core wire 31 has a first face 31*f* and a second face 31*g* adjacent to each other. The first face 31*f* and the second face 31*g* are surfaces inclined with respect to the axial direction of the electric wire 3. The boundary of the first face 31*f* and the second face 31*g* is formed at substantially the center of the core wire 31. The first face 31*f* is inclined such that the boundary with the second face 31*g* protrudes most. The second face 31*g* is inclined such that the boundary with the first face 31*f* protrudes most.

Figure 50:
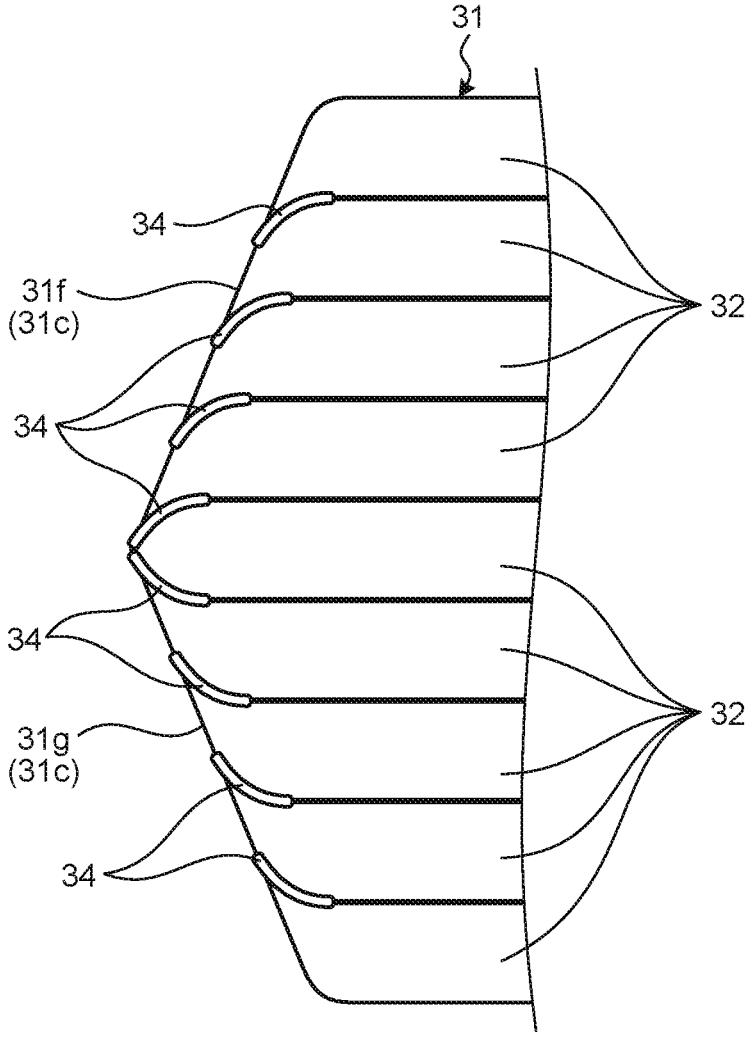
FIG. 50 is a cross-sectional view of the electric wire in which the bonding portions are formed.

At the first face 31*f*, the distal ends of the element wires 32 are sheared and deformed in a direction from the first face 31*f* toward the second face 31*g*. At the second face 31*g*, the distal ends of the element wires 32 are sheared and deformed in a direction from the second face 31*g* toward the first face 31*f*. As illustrated in FIG. 50, at the first face 31*f* and the second face 31*g*, the bonding portions 34 bonded to the adjacent element wires 32 are formed on the element wires 32.

First Modification of Second Embodiment

Figure 51:
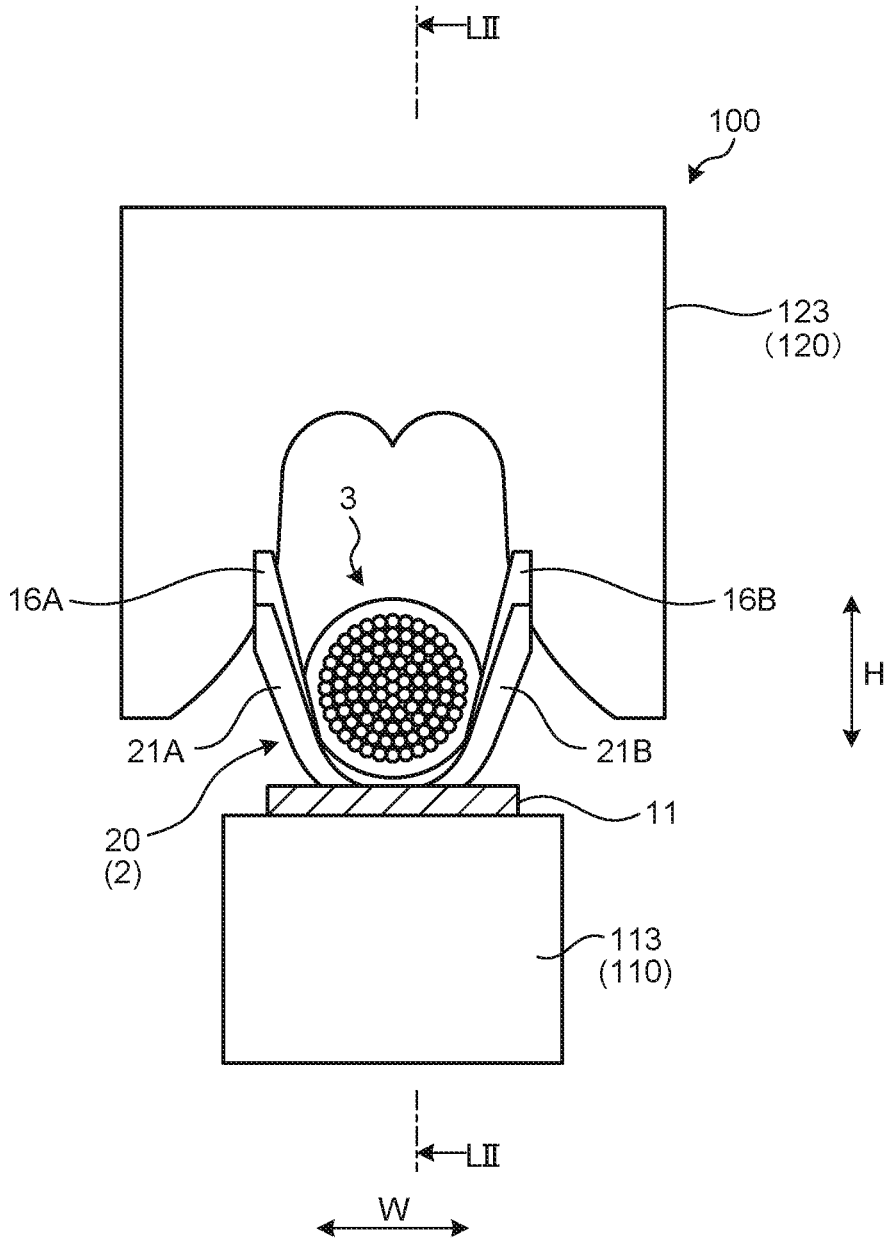
FIG. 51 is a front view for describing a crimping step according to a first modification of the second embodiment.
Figure 52:
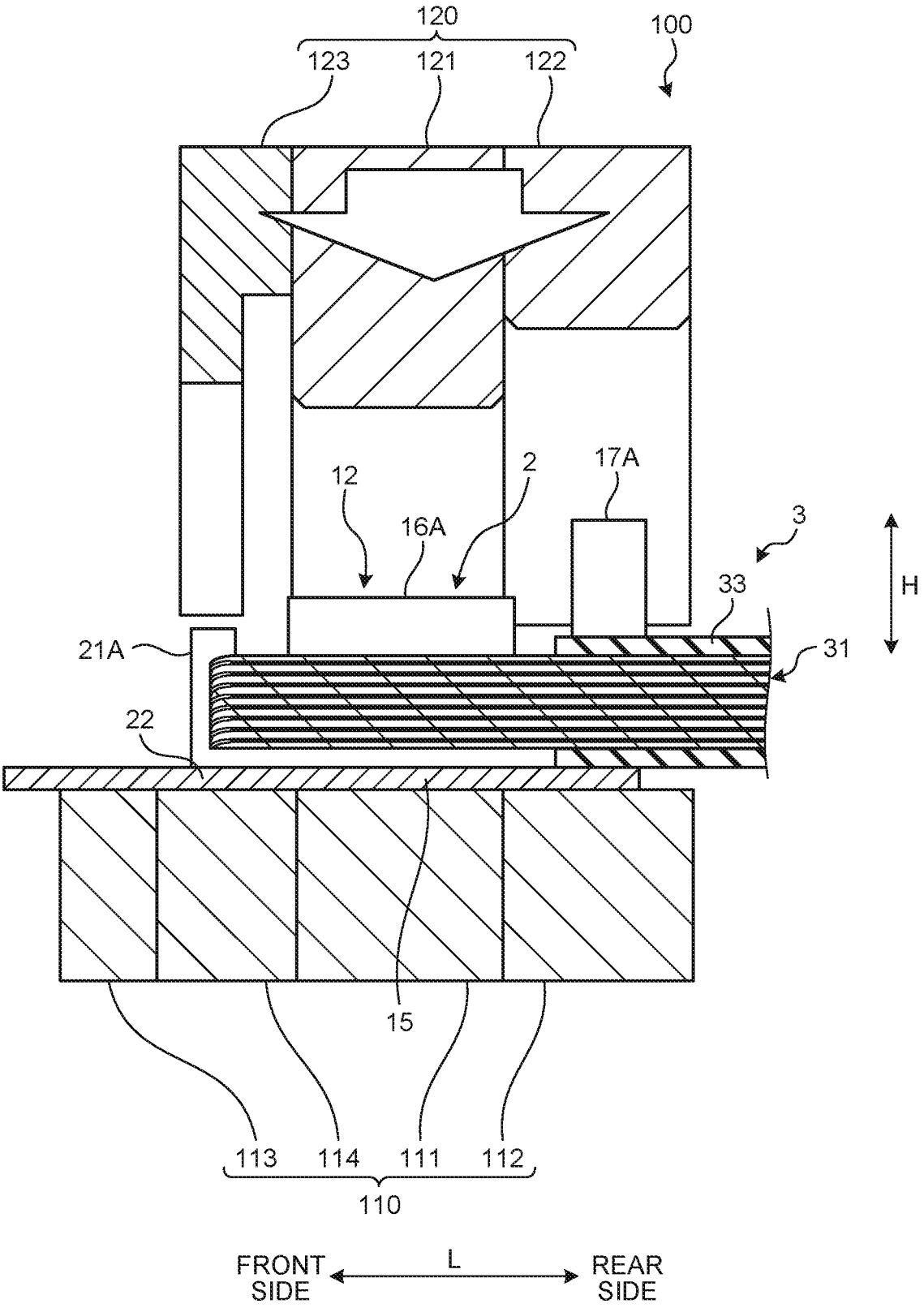
FIG. 52 is a cross-sectional view for describing the crimping step according to the first modification of the second embodiment.
Figure 53:
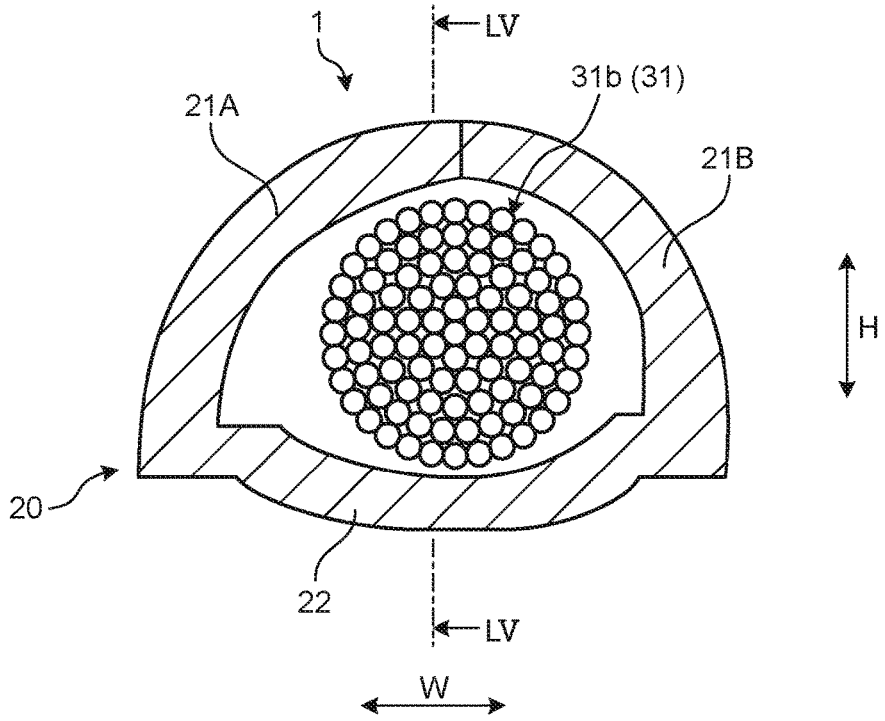
FIG. 53 is a front view of an electric wire with terminal according to the first modification of the second embodiment.
Figure 54:
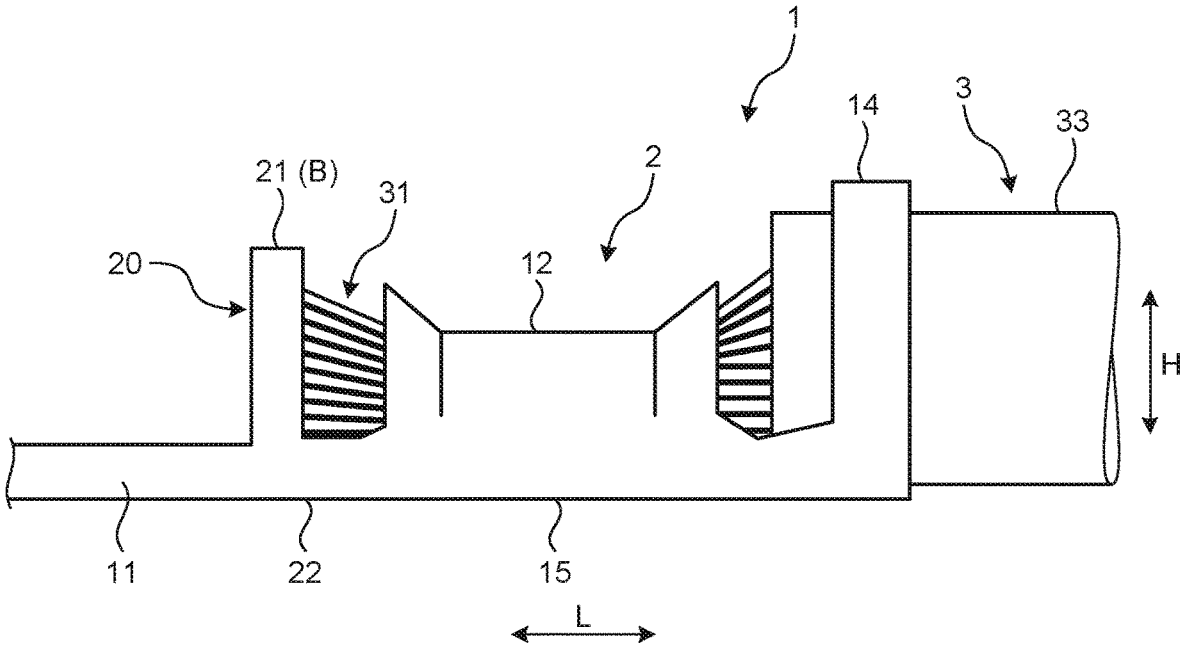
FIG. 54 is a side view of the electric wire with terminal according to the first modification of the second embodiment.
Figure 55:
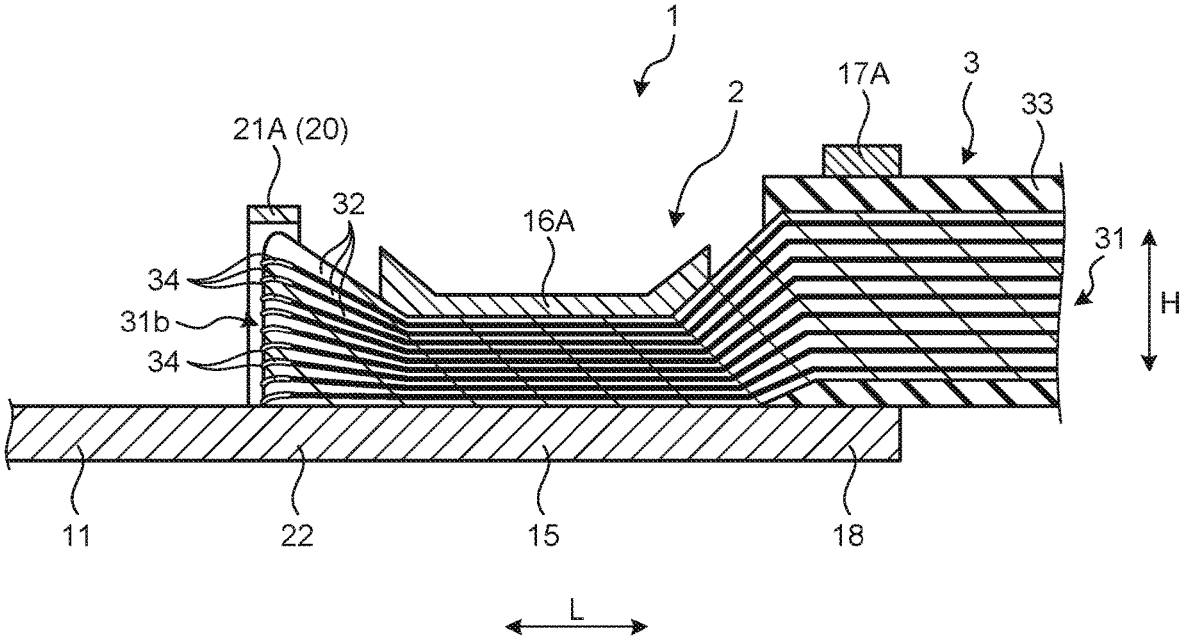
FIG. 55 is a cross-sectional view of the electric wire with terminal according to the first modification of the second embodiment.

Referring to FIG. 51 to FIG. 57, a first modification of the second embodiment is described. FIG. 51 is a front view for describing a crimping step according to the first modification of the second embodiment. FIG. 52 is a cross-sectional view for describing the crimping step according to the first modification of the second embodiment. FIG. 53 is a front view of an electric wire with terminal according to the first modification of the second embodiment. FIG. 54 is a side view of the electric wire with terminal according to the first modification of the second embodiment. FIG. 55 is a cross-sectional view of the electric wire with terminal according to the first modification of the second embodiment. FIG. 55 illustrates a cross section taken along the line LV-LV in FIG. 53.

The first modification of the second embodiment is different from the above-mentioned second embodiment in that, for example, the crimp terminal 2 has a covering portion 20. As illustrated in FIG. 51 and FIG. 52, the crimp terminal 2 according to the first modification of the second embodiment has the covering portion 20. The covering portion 20 is configured to cover a distal end 31*b* of the core wire 31. The covering portion 20 has a first covering piece 21A, a second covering piece 21B, and a bottom portion 22. The covering portion 20 is disposed between the core wire crimping portion 12 and the coupling portion 11. One end of the bottom portion 22 in the first direction L is continuous to the bottom portion 15 of the core wire crimping portion 12, and the other end thereof is continuous to the coupling portion 11.

The first covering piece 21A and the second covering piece 21B are disposed apart away from the swaging pieces 16A and 16B. The first covering piece 21A extends from one end of the bottom portion 22 in the second direction W, and the second covering piece 21B extends from the other end of the bottom portion 22 in the second direction W. The covering portion 20 is formed such that the first covering piece 21A, the second covering piece 21B, and the bottom portion 22 have a U shape. The first covering piece 21A is disposed on the same side as the first swaging piece 16A in the second direction W. The second covering piece 21B is disposed on the same side as the second swaging piece 16B in the second direction W.

As illustrated in FIG. 52, a terminal crimping apparatus 100 has a fourth anvil 114 that supports the covering portion 20 and a third crimper 123 configured to deform the covering portion 20. The fourth anvil 114 is disposed between the first anvil 111 and the third anvil 113. The third crimper 123 is disposed on the front side of the first crimper 121, and is opposed to the fourth anvil 114 in the third direction H.

As illustrated in FIG. 52, the electric wire 3 is installed on the crimp terminal 2 such that the distal end 31*b* of the core wire 31 is located at the covering portion 20. More specifically, the electric wire 3 is installed such that the distal end 31*b* is located between the first covering piece 21A and the second covering piece 21B. At the crimping step, the third crimper 123 deforms the first covering piece 21A and the second covering piece 21B. For example, as illustrated in FIG. 53, the third crimper 123 deforms the two covering pieces 21A and 21B such that the bottom portion 22, the first covering piece 21A, and the second covering piece 21B form a ring shape. In the covering portion 20 illustrated in FIG. 53, a distal end of the first covering piece 21A and a distal end of the second covering piece 21B are in contact with each other, and the two covering pieces 21A and 21B form an arc shape. The first covering piece 21A and the second covering piece 21B cover the distal end 31*b* of the core wire 31 from the outer peripheral side, and protect the distal end 31*b*.

For example, the two covering pieces 21A and 21B may cover the distal end 31*b* in the state in which compression force does not act on the distal end 31*b*. Alternatively, the two covering pieces 21A and 21B may cover the distal end 31*b* while pressing the distal end 31*b* against the bottom portion 22. It is desired that the pressing force in this case have a magnitude that does not lose the shape of the bonding portion 34 at the distal end 31*b*, in other words, a magnitude that does not separate the element wires 32 bonded by the bonding portion 34 from each other.

Figure 56:
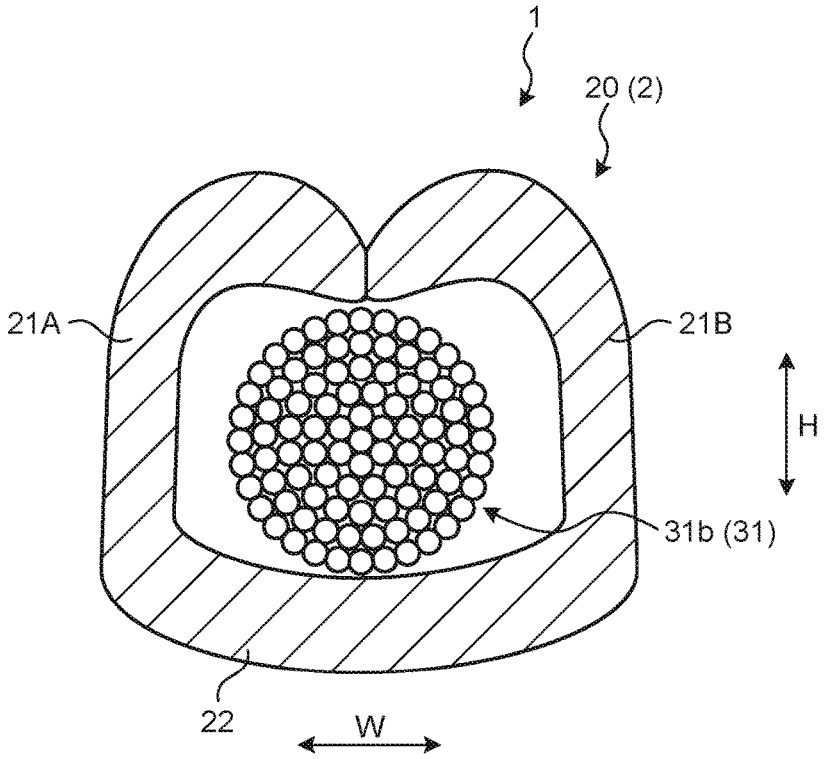
FIG. 56 is a cross-sectional view illustrating an example of the shape of a covering portion.

FIG. 56 illustrates an example of the shape of the covering portion 20. At the crimping step, the two covering pieces 21A and 21B may be deformed such that the distal ends face obliquely downward. In the covering portion 20 illustrated in FIG. 56, distal end parts of the two covering pieces 21A and 21B are curved so as to approach the bottom portion 22 as approaching the distal end. The two covering pieces 21A and 21B may press the core wire 31 toward the bottom portion 22 by the distal ends thereof.

Figure 57:
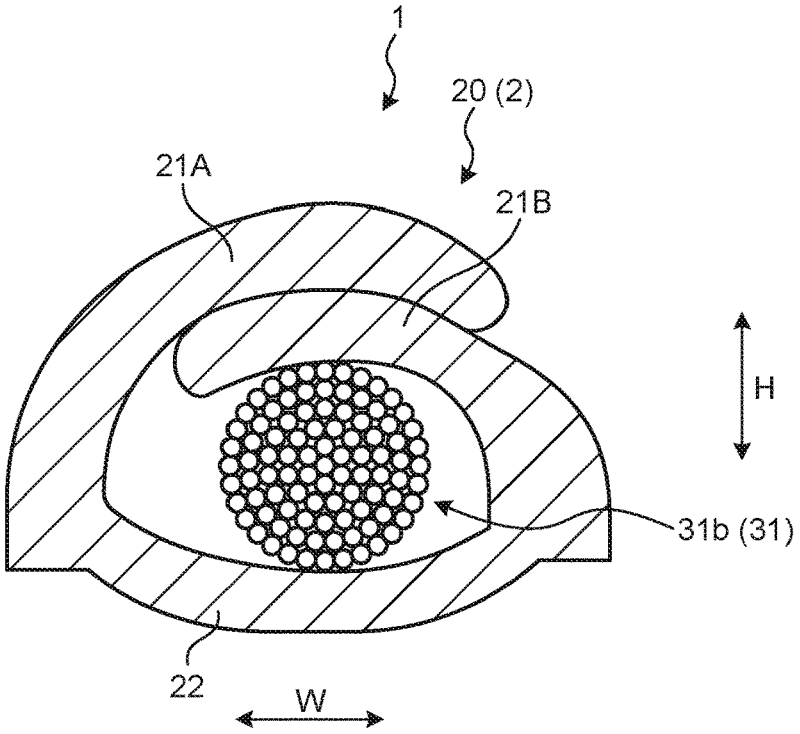
FIG. 57 is a cross-sectional view illustrating another example of the shape of the covering portion.

FIG. 57 illustrates another example of the shape of the covering portion 20. The two covering pieces 21A and 21B may cover the distal end 31*b* while overlapping with each other. In the covering portion 20 illustrated in FIG. 57, the first covering piece 21A overlaps on the outer side of the second covering piece 21B. The second covering piece 21B may press the core wire 31 against the bottom portion 22.

As described above, in the method of manufacturing an electric wire with terminal according to the first modification of the second embodiment, at the crimping step, the covering portion 20 included in the crimp terminal 2 covers the distal end 31*b* of the core wire 31 from the outer peripheral side. The covering portion 20 protects the distal end 31*b* of the core wire 31 from contact with another member, and restricts the action of external force on the bonding portion 34. Thus, the method of manufacturing an electric wire with terminal according to the first modification can protect the bonding portion 34 to improve electric performance of the electric wire with terminal 1.

The electric wire with terminal 1 according to the first modification of the second embodiment has the covering portion 20 that covers the distal end 31*b* of the core wire 31 from the outer peripheral side. Thus, the electric wire with terminal 1 according to the first modification can improve electric performance.

Second Modification of Second Embodiment

Figure 58:
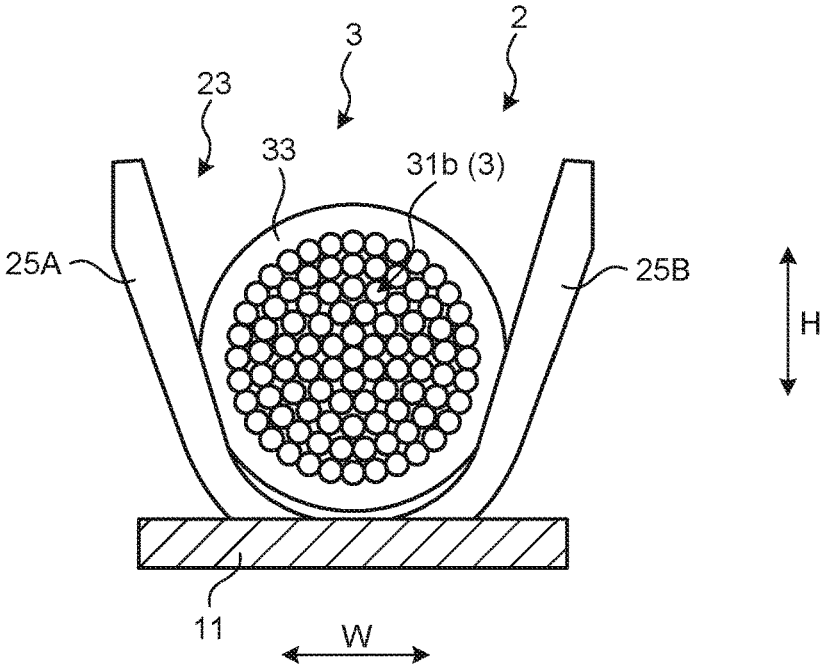
FIG. 58 is a front view illustrating a crimp terminal according to a second modification of the second embodiment.
Figure 59:
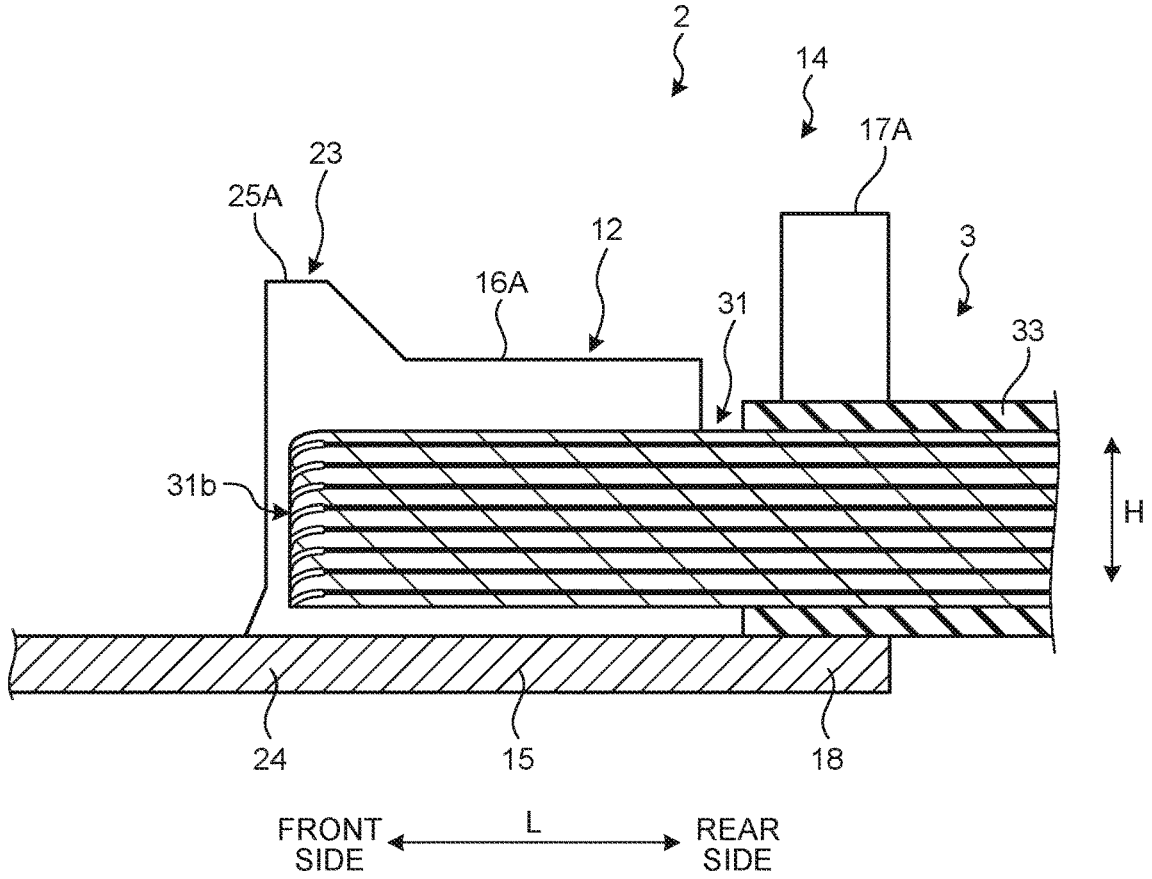
FIG. 59 is a side view illustrating the crimp terminal according to the second modification of the second embodiment.
Figure 60:
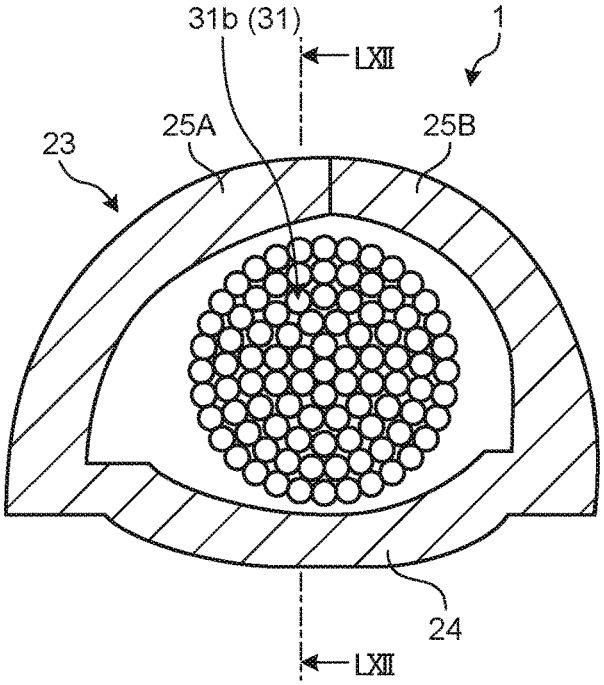
FIG. 60 is a front view of an electric wire with terminal according to the second modification of the second embodiment.
Figure 61:
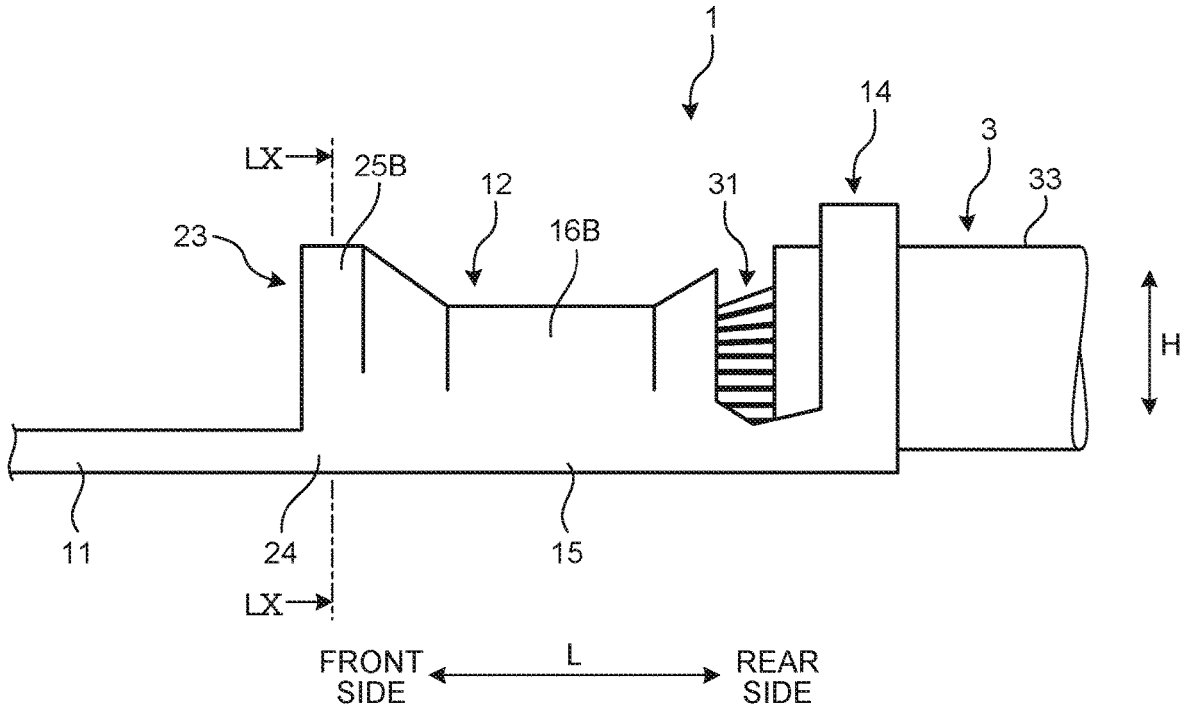
FIG. 61 is a side view of the electric wire with terminal according to the second modification of the second embodiment.
Figure 62:
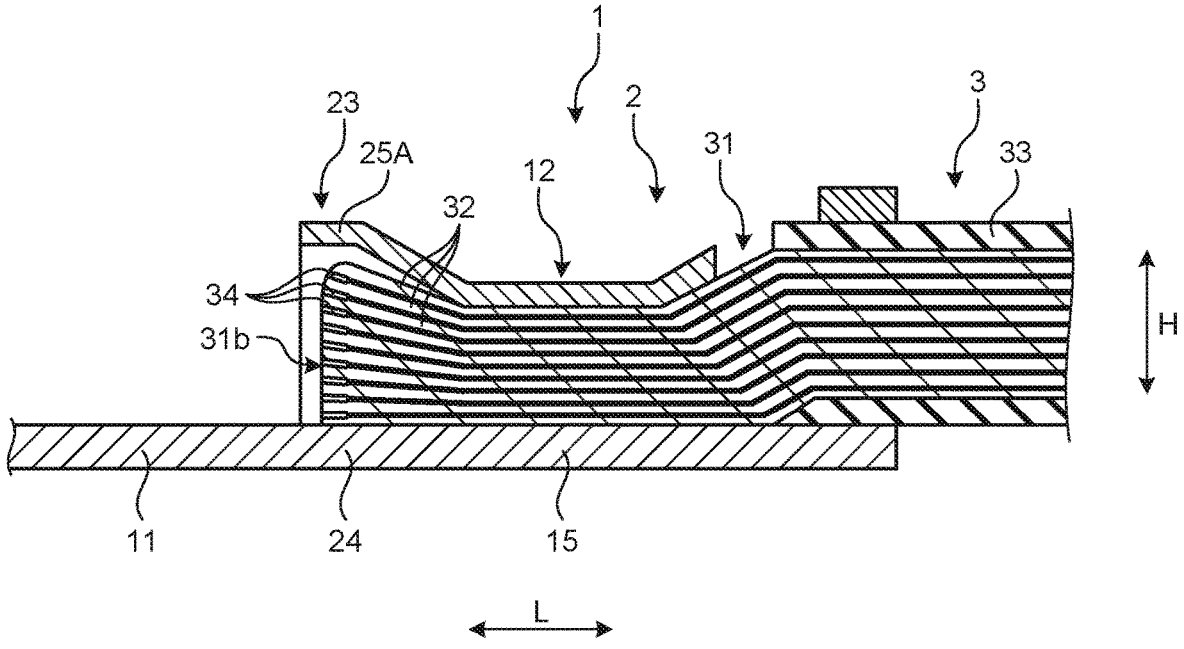
FIG. 62 is a cross-sectional view of the electric wire with terminal according to the second modification of the second embodiment.

Referring to FIG. 58 to FIG. 62, a second modification of the second embodiment is described. FIG. 58 is a front view illustrating a crimp terminal according to the second modification of the second embodiment. FIG. 59 is a side view illustrating the crimp terminal according to the second modification of the second embodiment. FIG. 60 is a front view of an electric wire with terminal according to the second modification of the second embodiment. FIG. 61 is a side view of the electric wire with terminal according to the second modification of the second embodiment. FIG. 62 is a cross-sectional view of the electric wire with terminal according to the second modification of the second embodiment.

In a crimp terminal 2 illustrated in FIG. 58, a covering portion 23 is formed integrally with the core wire crimping portion 12. The covering portion 23 has a first covering piece 25A, a second covering piece 25B, and a bottom portion 24. The bottom portion 24 is continuous to the front end of the bottom portion 15 of the core wire crimping portion 12. The first covering piece 25A extends from one end of the bottom portion 24 in the second direction W, and the second covering piece 25B extends from the other end of the bottom portion 24 in the second direction W. The first covering piece 25A is continuous to the front end of the first swaging piece 16A of the core wire crimping portion 12. The second covering piece 25B is continuous to the front end of the second swaging piece 16B of the core wire crimping portion 12. The covering portion 23 is formed such that the first covering piece 25A, the second covering piece 25B, and the bottom portion 24 have a U shape.

For example, the crimp terminal 2 is swaged to the electric wire 3 by the terminal crimping apparatus 100 (see FIG. 52) having the third crimper 123. For example, the third crimper 123 deforms the two covering pieces 25A and 25B as illustrated in FIG. 60. In the covering portion 23 illustrated in FIG. 60, a distal end of the first covering piece 25A and a distal end of the second covering piece 25B are in contact with each other, and the two covering pieces 25A and 25B form an arc shape. The first covering piece 25A and the second covering piece 25B cover the distal end 31*b* of the core wire 31 from the outer peripheral side, and protect the distal end 31*b*. For example, the core wire crimping portion 12 is crimped to the core wire 31 in a form called "B crimp".

The covering portion 23 may cover the distal end 31*b* in the state in which the compression force does not act on the distal end 31*b* of the core wire 31, and may compress the distal end 31*b* by a force that does not separate the bonded element wires 32 from each other.

Third Modification of Second Embodiment

Figure 63:
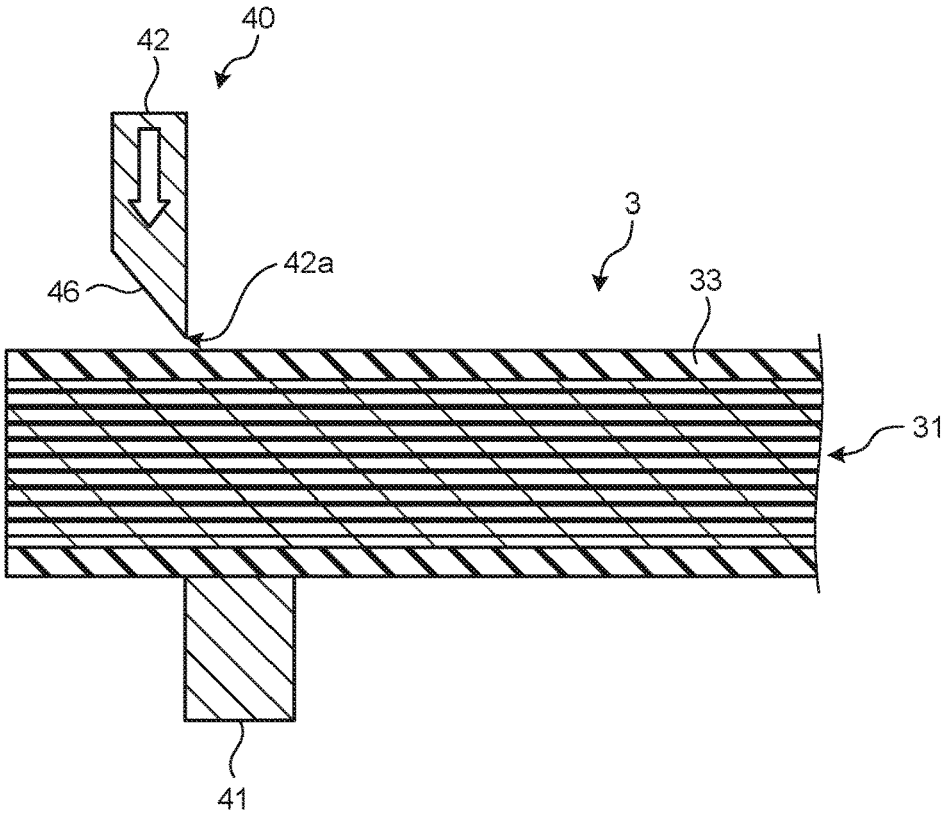
FIG. 63 is a cross-sectional view for describing a cutting step according to a third modification of the second embodiment.
Figure 64:
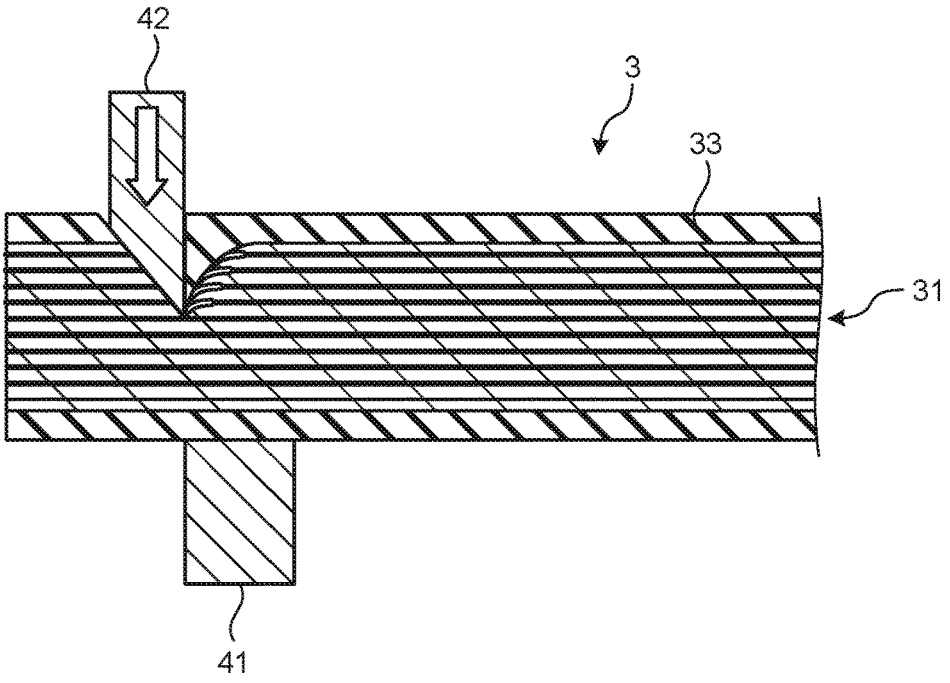
FIG. 64 is another cross-sectional view for describing the cutting step according to the third modification of the second embodiment.
Figure 65:
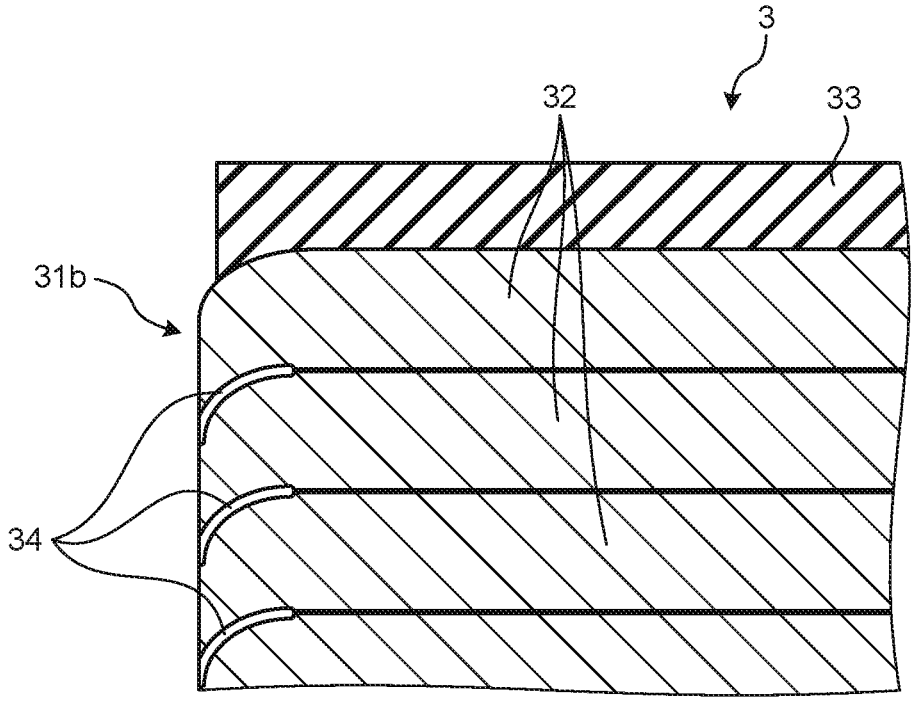
FIG. 65 is a cross-sectional view of an electric wire in which bonding portions are formed.
Figure 66:
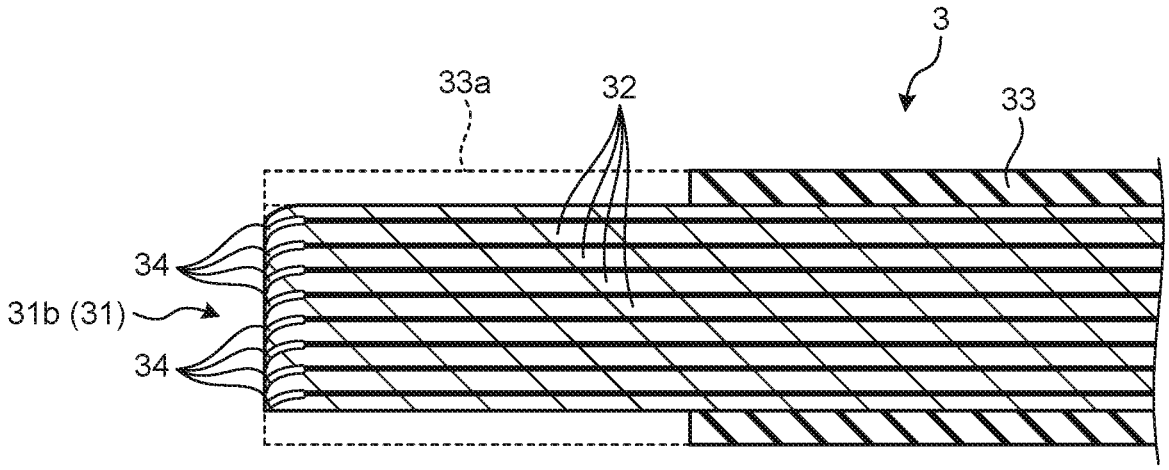
FIG. 66 is a cross-sectional view for describing a removal step according to the third modification of the second embodiment.

Referring to FIG. 63 to FIG. 76, a third modification of the second embodiment is described. FIG. 63 is a cross-sectional view for describing a cutting step according to the third modification of the second embodiment. FIG. 64 is another cross-sectional view for describing the cutting step according to the third modification of the second embodiment. FIG. 65 is a cross-sectional view of an electric wire in which bonding portions are formed. FIG. 66 is a cross-sectional view for describing a removal step according to the third modification of the second embodiment.

The third modification of the second embodiment is different from the above-mentioned second embodiment in that, for example, the removal step is performed after the cutting step and the bonding step are performed. As illustrated in FIG. 63 and FIG. 64, in a method of manufacturing an electric wire with terminal according to the third modification of the second embodiment, the core wire 31 is cut at a location covered with the covering 33.

As illustrated in FIG. 63, the electric wire 3 is set to the cutting device 40 such that a part of the core wire 31 covered with the covering 33 is opposed to the cutting blade 42. As illustrated in FIG. 64, the cutting blade 42 cuts the covering 33 and the core wire 31 to remove a distal end portion of the electric wire 3. At this time, the cutting blade 42 shears and deforms the distal end of the core wire 31 to form bonding portions 34. As illustrated in FIG. 65, a bonding portion 34 at which adjacent element wires 32 are bonded is formed at a distal end of the element wire 32. In this manner, in the third modification of the second embodiment, the cutting step and the bonding step are performed in parallel on the core wire 31 that has been covered by the covering 33.

After the cutting step and the bonding step are completed, as illustrated in FIG. 66, a terminal portion 33*a* of the covering 33 is removed. After this removal step, the crimping step is performed to crimp the crimp terminal 2 to the electric wire 3, and the electric wire with terminal 1 is completed.

Figure 67:
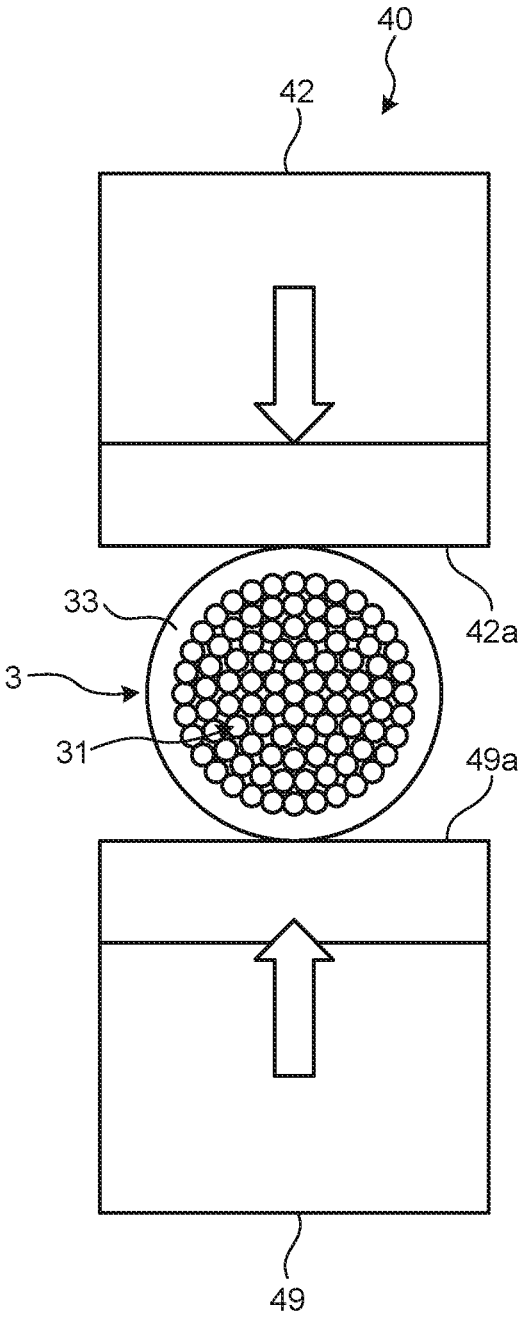
FIG. 67 is a front view illustrating an example of a cutting step.
Figure 68:
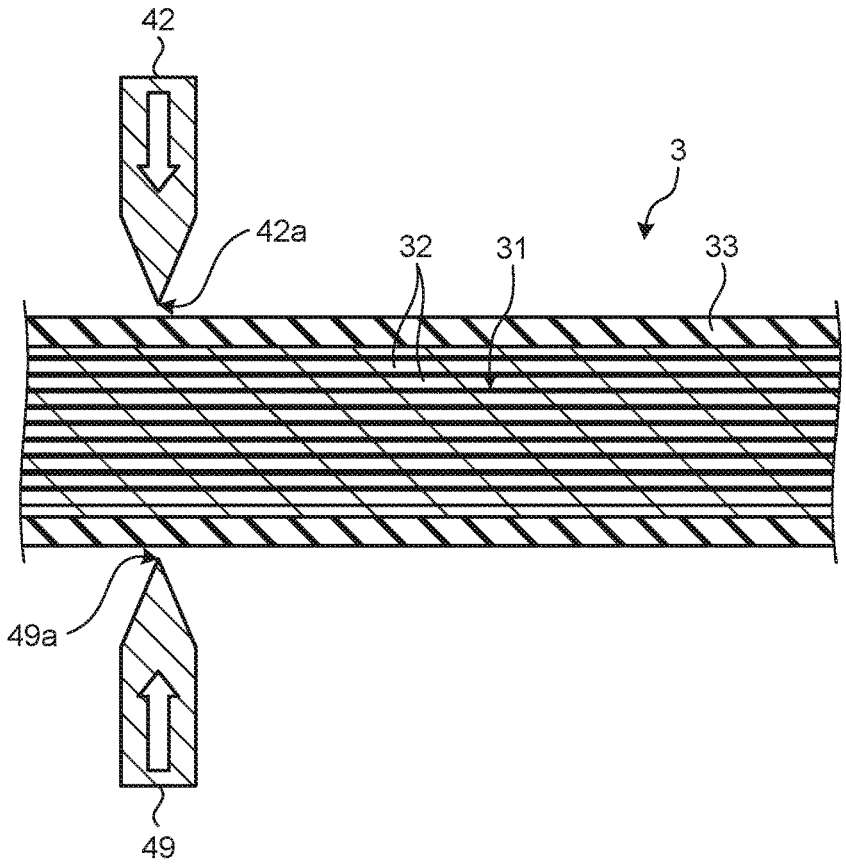
FIG. 68 is a cross-sectional view illustrating an example of the cutting step.
Figure 69:
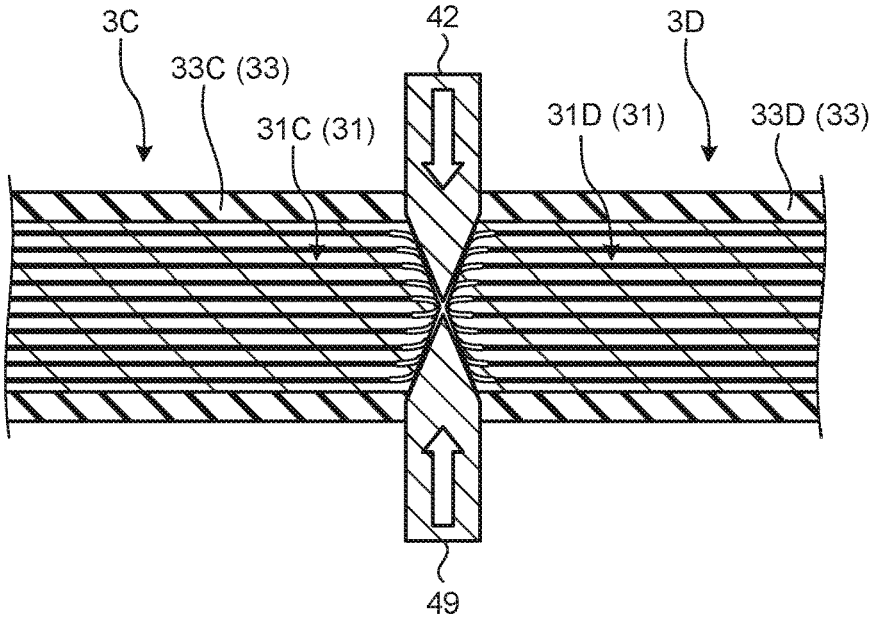
FIG. 69 is another cross-sectional view illustrating an example of the cutting step.
Figure 70:
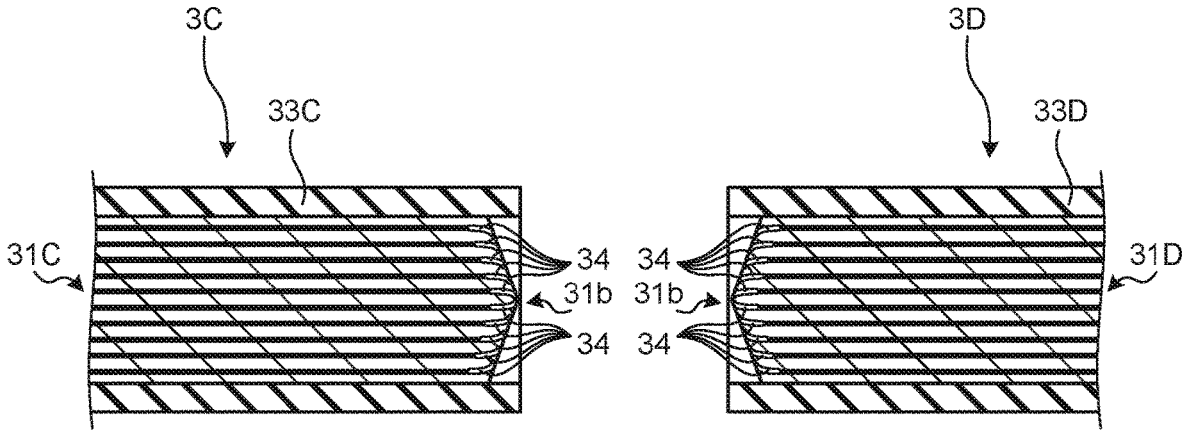
FIG. 70 is a cross-sectional view of a cut electric wire.

As described with reference to FIG. 67 to FIG. 69, bonding portions 34 may be formed in two electric wires 3C and 3D formed by cutting. As illustrated in FIG. 68 and FIG. 69, the cutting device 40 cuts and divides a single electric wire 3 into two electric wires 3C and 3D. The cutting device 40 cuts the electric wire 3 by two cutting blades 42 and 49. The cutting blades 42 and 49 cut a part of the core wire 31 covered by the covering 33. For example, the blade edges 42*a* and 49*a* of the cutting blades 42 and 49 are inclined surfaces on both sides. The two cutting blades 42 and 49 shear and deform the distal ends of the core wires 31 while cutting the core wires 31. As a result, as illustrated in FIG. 70, bonding portions 34 are formed at the distal ends of the element wires 32 in a core wire 31C of the electric wire 3C, and bonding portions 34 are formed at the distal ends of the element wires 32 in a core wire 31D of the electric wire 3D.

Figure 71:
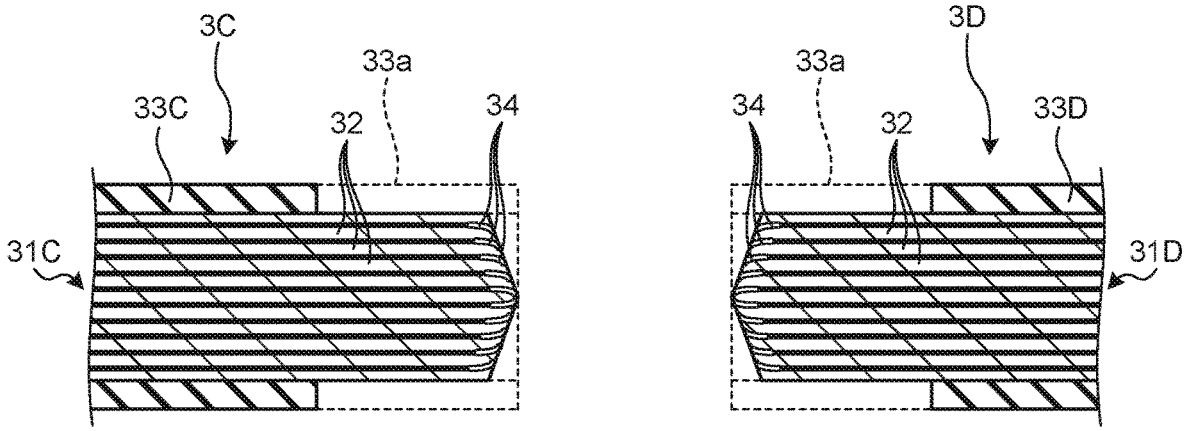
FIG. 71 is a cross-sectional view for describing the removal step.
Figure 72:
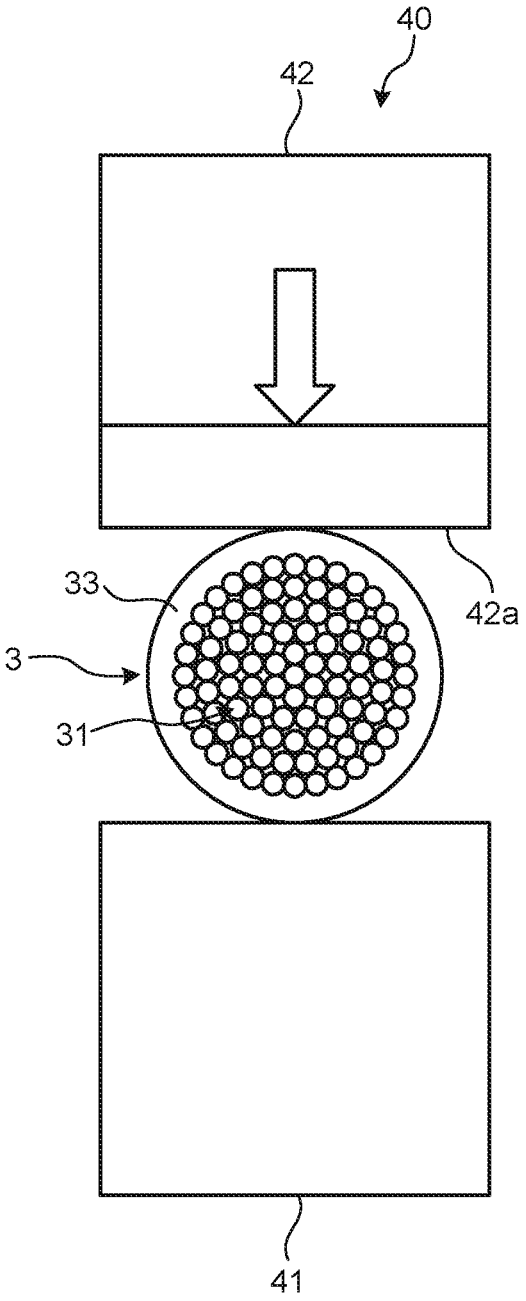
FIG. 72 is a front view illustrating an example of the cutting step.
Figure 73:
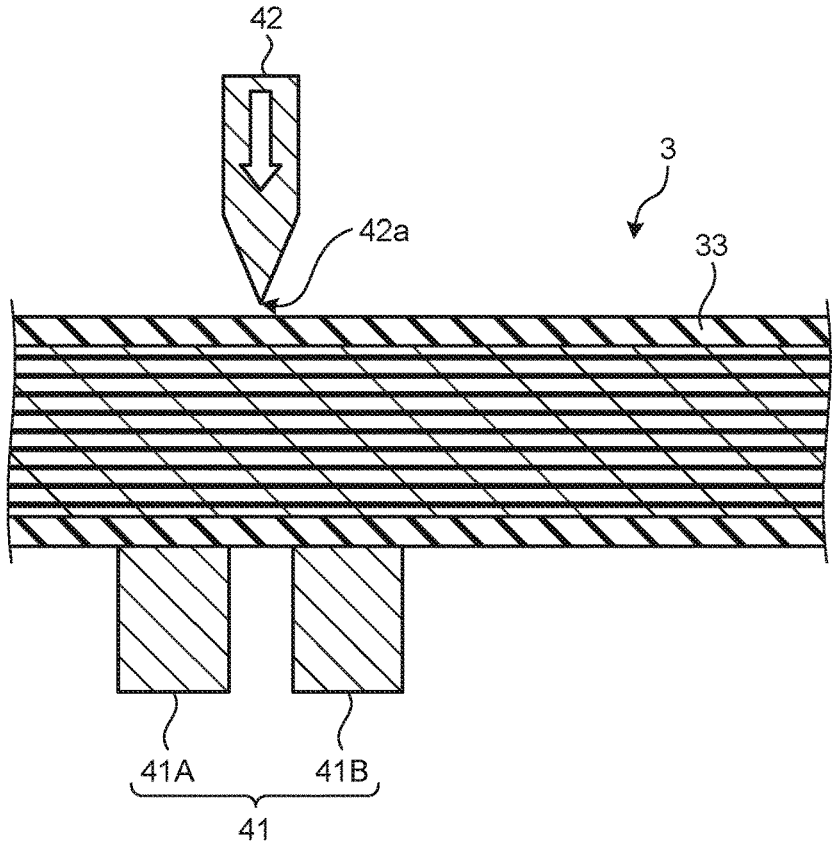
FIG. 73 is a cross-sectional view illustrating an example of the cutting step.

After the cutting step and the bonding step are completed, as illustrated in FIG. 71, a terminal portion 33*a* is removed from a covering 33C of the electric wire 3C, and a terminal portion 33*a* is removed from a covering 33D of the electric wire 3D. The bonding portions 34 can be simultaneously formed on the two electric wires 3C and 3D, and the manufacturing time are shortened.

As described above with reference to FIG. 72 to FIG. 74, a single electric wire 3 may be divided in two electric wires 3E and 3F by a single cutting blade 42. In a cutting device 40 illustrated in FIG. 73, a receiving portion 41 includes a first receiving portion 41A and a second receiving portion 41B. The first receiving portion 41A and the second receiving portion 41B are disposed away from each other such that the cutting blade 42 can enter therebetween. The cutting blade 42 is disposed to be opposed to a gap between the first receiving portion 41A and the second receiving portion 41B. The electric wire 3 is supported by the first receiving portion 41A and the second receiving portion 41B.

Figure 74:
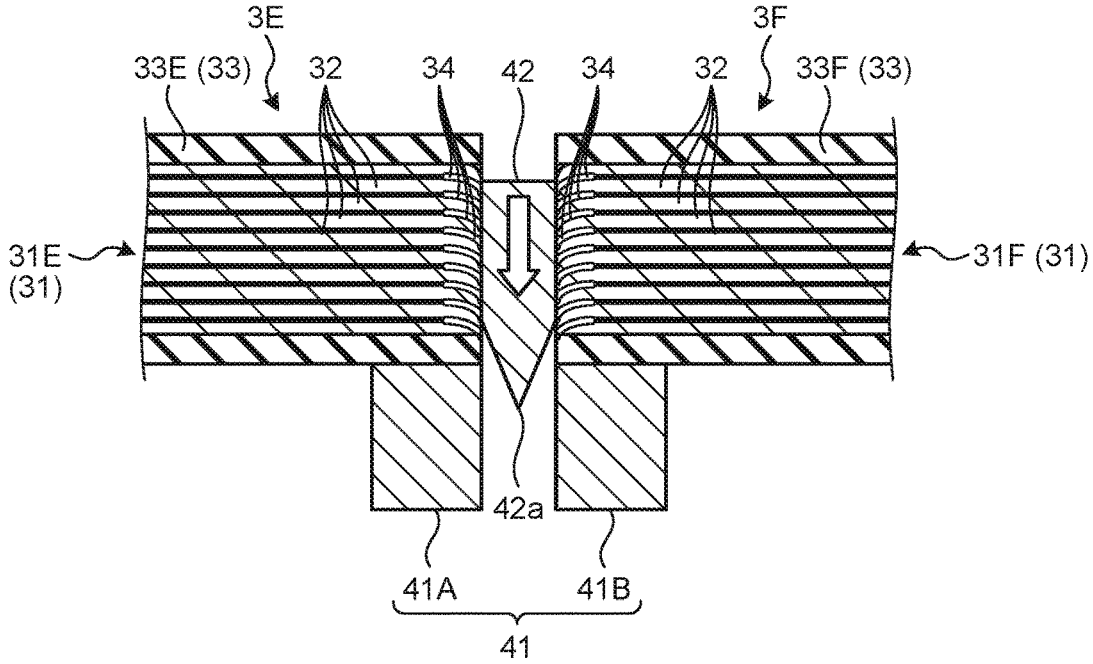
FIG. 74 is another cross-sectional view illustrating an example of the cutting step.
Figure 75:
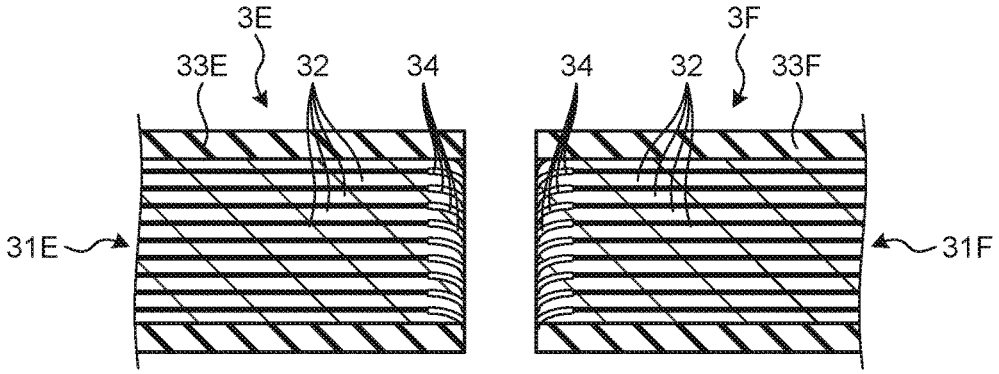
FIG. 75 is a cross-sectional view of a cut electric wire.

As illustrated in FIG. 74, the cutting blade 42 cuts the covering 33 and the core wire 31 to divide a single electric wire 3 into two electric wires 3E and 3F. The cutting blade 42 shears and deforms the distal end of the core wire 31 while cutting the core wire 31. As a result, as illustrated in FIG. 75, bonding portions 34 are formed at distal ends of element wires 32 in a core wire 31E of the electric wire 3E, and bonding portions 34 are formed at distal ends of element wires 32 in a core wire 31F of the electric wire 3F.

Figure 76:
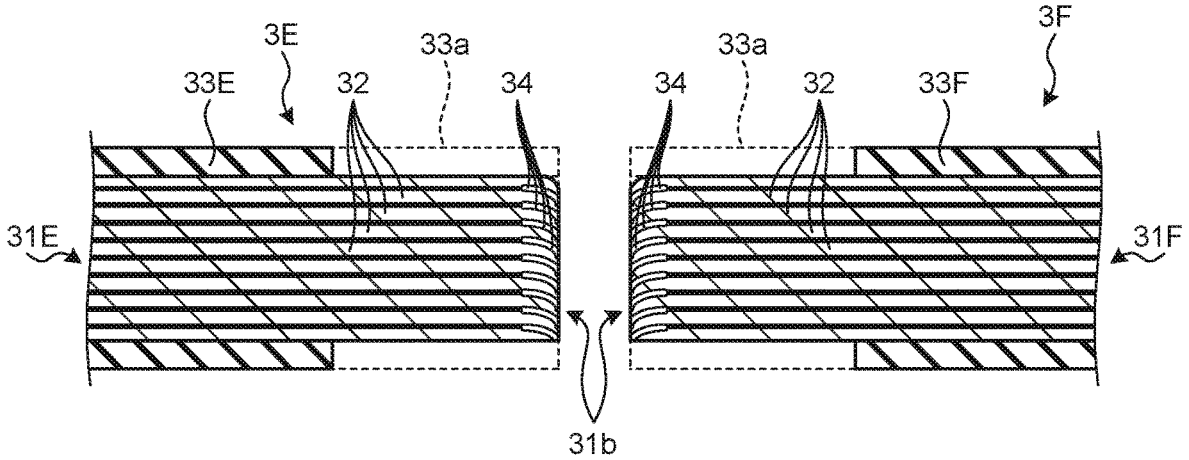
FIG. 76 is a cross-sectional view for describing the removal step.

After the cutting step and the bonding step are completed, as illustrated in FIG. 76, a terminal portion 33*a* is removed from a covering 33E of the electric wire 3E, and a terminal portion 33*a* is removed from a covering 33F of the electric wire 3F.

Other Modifications

Other modifications are described. At the bonding step, the temperature of the machining tool 130, 140, or 150 or the cutting blade 42, 48, or 49 may be increased to soften the core wire 31. For example, the terminal crimping apparatus 100 may include a heater configured to heat the machining tool 130, 140, or 150. By pressing the machining tool 130, 140, or 150 increased in temperature against the core wire 31, the deformation of the core wire 31 can be promoted to bond the element wires 32 together efficiently. The cutting device 40 may include a heater configured to heat the cutting blade 42, 48, or 49.

At the bonding step, the core wire 31 may be deformed while vibrating the machining tool 130, 140, or 150 or the cutting blade 42, 48, or 49 by ultrasonic waves. The ultrasonic vibration can cause the element wires 32 to slidingly move on each other more strongly.

How the swaging pieces 16A and 16B are swaged to the core wire 31 is not limited to the form called "B crimp". For example, the swaging pieces 16A and 16B may be wound around the bonding portions 34 such that the second swaging piece 16B overlaps the first swaging piece 16A. When the swaging pieces 16A and 16B are crimped by an overlap method, the swaging pieces 16A and 16B may be configured to integrally cover both the core wire 31 and the covering 33.

How the covering crimping portion 14 is swaged to the covering 33 is not limited to the form called "B crimp". For example, the swaging pieces 17A and 17B may be crimped by an overlap method. The crimp terminal 2 is not necessarily required to have the covering crimping portion 14.

The contents disclosed in each of the above-mentioned embodiments and modifications can be appropriately combined for implementation.

The electric wire with terminal according to the present embodiments and modifications include: the electric wire including: the core wire having the element wires; and the covering that covers the core wire in the state in which the end portion of the core wire is exposed; and the crimp terminal including the core wire crimping portion crimped to the core wire in the state in which the distal end of the core wire protrudes to the outside. The distal end of the core wire has the bonding portion at which the element wires are bonded together, and the bonding portion is formed by shearing and deforming the distal ends of the element wires. The electric wire with terminal according to the present embodiments and modifications exhibit an effect that electric performance can be improved with a simple configuration without adding additional material.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An electric wire with terminal, comprising:

an electric wire including a core wire having a plurality of element wires, and a covering that covers the core wire in a state in which an end portion of the core wire is exposed; and a crimp terminal including a core wire crimping portion crimped to the core wire in a state in which a distal end of the core wire protrudes to an outside, wherein the distal end of the core wire has a bonding portion at tips of the element wires and at which the element wires are bonded together, and the bonding portion is formed by shearing the tips of the element wires and deforming distal ends of the element wires.

2. The electric wire with terminal according to claim 1, wherein a distal end surface of the core wire is an inclined surface inclined with respect to an axial direction of the electric wire.

3. The electric wire with terminal according to claim 1, wherein at a distal end surface of the core wire, distal ends of the element wires are sheared and deformed toward a common direction.

4. The electric wire with terminal according to claim 2, wherein at a distal end surface of the core wire, distal ends of the element wires are sheared and deformed toward a common direction.

5. The electric wire with terminal according to claim 1, wherein a distal end surface of the core wire includes a first face and a second face adjacent to each other, at the first face, distal ends of the element wires are sheared and deformed in a direction from the first face toward the second face, and at the second face, distal ends of the element wires are sheared and deformed in a direction from the second face toward the first face.

6. The electric wire with terminal according to claim 2, wherein distal end surface of the core wire includes a first face and a second face adjacent to each other, at the first face, distal ends of the element wires are sheared and deformed in a direction from the first face toward the second face, and at the second face, distal ends of the element wires are sheared and deformed in a direction from the second face toward the first face.

7. A method of manufacturing an electric wire with terminal, comprising steps of:

bonding by shearing tips of a plurality of element wires and deforming distal ends of the plurality of the element wires constituting a core wire of an electric wire to form a bonding portion at tips of the element wires and at which the element wires are bonded together; and crimping a core wire crimping portion of a crimp terminal to the core wire.

8. The method of manufacturing an electric wire with terminal according to claim 7, wherein the bonding and the crimping are performed by a terminal crimping apparatus including a crimper and a machining tool configured to move in cooperation with the crimper, the bonding includes shearing and deforming a distal end of the element wire by the machining tool to form the bonding portion, and the crimping includes crimping the core wire crimping portion to the core wire by the crimper.

9. The method of manufacturing an electric wire with terminal according to claim 7, wherein the crimping further includes covering a distal end of the core wire from an outer peripheral side thereof by a covering portion of the crimp terminal.

10. An electric wire with terminal, comprising:

an electric wire including a core wire having a plurality of element wires, and a covering that covers the core wire in a state in which an end portion of the core wire is exposed; and a crimp terminal including a core wire crimping portion crimped to the core wire, wherein a bonding portion at tips of the element wires and at which distal ends of the element wires are bonded together is formed by shearing the tips of the element wires at a distal end of the core wire, and the crimp terminal has a covering portion that covers the distal end of the core wire from an outer peripheral side thereof.

11. The electric wire with terminal according to claim 1, wherein the tips of the element wires face away from the core wire crimping portion.

* * * * *